US011512484B2

(12) United States Patent
Richardson et al.

(10) Patent No.: US 11,512,484 B2
(45) Date of Patent: Nov. 29, 2022

(54) METHODS AND APPARATUS FOR RESTORING, REPAIRING, REINFORCING AND/OR PROTECTING STRUCTURES USING CONCRETE

(71) Applicant: CFS Concrete Forming Systems Inc., Vancouver (CA)

(72) Inventors: George David Richardson, Vancouver (CA); Semion Krivulin, Richmond (CA); Jorge Ricardo Rosas-Gracida, Burnaby (CA); Zi Li Fang, New Westminster (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 0 days.

(21) Appl. No.: 16/858,522

(22) Filed: Apr. 24, 2020

(65) Prior Publication Data

US 2020/0318370 A1 Oct. 8, 2020

Related U.S. Application Data

(63) Continuation of application No. 15/849,474, filed on Dec. 20, 2017, now Pat. No. 10,662,661, which is a (Continued)

(51) Int. Cl.
*E04G 23/02* (2006.01)
*E02D 37/00* (2006.01)

(52) U.S. Cl.
CPC ..... *E04G 23/0218* (2013.01); *E02D 37/00* (2013.01); *E04G 23/02* (2013.01); *E04G 23/0203* (2013.01)

(58) Field of Classification Search
CPC . E04G 23/02; E04G 23/0218; E04G 23/0203; E02D 37/00; E04B 2/84;
(Continued)

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — Theodore V Adamos
(74) *Attorney, Agent, or Firm* — Todd A. Rattray; Oyen Wiggs Green & Mutala LLP

(57) ABSTRACT

Methods are provided for repairing an existing structure to cover at least a portion of the existing structure with a repair structure. Such methods comprise mounting one or more standoff retainers to the existing structure; coupling one or more standoffs to the standoff retainers such that the standoffs extend away from the existing structure; coupling one or more cladding panels to the standoffs such that the panels are spaced apart from the structure to provide a space therebetween; and introducing a curable material to the space between the panels and the existing structure, the panels acting as at least a portion of a formwork for containing the curable material until the curable material cures to provide a repair structure cladded, at least in part, by the panels. Corresponding apparatus for effecting such methods are also provided.

24 Claims, 35 Drawing Sheets

Related U.S. Application Data continuation of application No. 15/145,665, filed on May 3, 2016, now Pat. No. 9,879,436, which is a continuation of application No. 14/611,055, filed on Jan. 30, 2015, now Pat. No. 9,359,780, which is a continuation of application No. 12/794,607, filed on Jun. 4, 2010, now Pat. No. 8,943,774, which is a continuation-in-part of application No. PCT/CA2010/000003, filed on Jan. 7, 2010.

(60) Provisional application No. 61/223,378, filed on Jul. 6, 2009, provisional application No. 61/143,151, filed on Jan. 7, 2009.

(58) Field of Classification Search
CPC ..... E04B 2/8635; E04B 2/8641; E04B 2002/8676; Y10T 403/57
See application file for complete search history.

(56) References Cited

U.S. PATENT DOCUMENTS 510,720 A 12/1893 Stewart, Jr.
820,246 A 5/1906 Nidds
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A * 7/1944 Slaughter ..... B29C 66/43 52/578
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,043,407 A 7/1962 Earl
3,063,122 A 11/1962 Katz
3,100,677 A 8/1963 Frank et al.
3,128,851 A 4/1964 Deridder et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A * 12/1966 Bowden ..... E04G 13/021 249/48
3,301,147 A 1/1967 William et al.
3,321,884 A 5/1967 Klaue
3,385,182 A 5/1968 Harvey
3,468,088 A 9/1969 Miller
3,545,152 A 12/1970 Knohl
3,555,751 A 1/1971 Thorgusen
3,555,762 A 1/1971 Costanzo
3,588,027 A 6/1971 Bowden
3,682,434 A 8/1972 Boenig
3,760,544 A * 9/1973 Hawes ..... E04B 1/6162 52/468
3,769,769 A 11/1973 Kohl
3,788,020 A 1/1974 Gregori
3,813,839 A 6/1974 Simpson et al.
3,822,557 A 7/1974 Frederick
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,114,388 A 9/1978 Straub
4,162,640 A 7/1979 Arnold
4,180,956 A 1/1980 Gross
4,182,087 A * 1/1980 Schall ..... E02D 5/03 4/506
4,193,243 A 3/1980 Tiner
4,276,730 A 7/1981 Lewis
4,299,070 A 11/1981 Oltmanns et al.
4,332,119 A * 6/1982 Toews ..... E04B 2/72 52/481.1
4,351,870 A 9/1982 English
4,383,674 A 5/1983 Fricker
4,385,850 A 5/1983 Bobath
4,386,543 A 6/1983 Walker, Jr.
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,633,558 A 1/1987 Spaulding
4,664,560 A 5/1987 Cortlever
4,695,033 A 9/1987 Imaeda et al.
4,703,602 A 11/1987 Pardo
4,731,964 A 3/1988 Phillips
4,736,563 A 4/1988 Bilhorn
4,731,971 A 5/1988 Terkl
4,742,665 A 5/1988 Baierl
4,754,668 A 7/1988 Oetiker
4,808,039 A 2/1989 Fischer
4,856,754 A 8/1989 Yokota et al.
4,866,891 A 9/1989 Young
4,892,052 A 1/1990 Zook et al.
4,930,282 A 6/1990 Meadows
4,946,056 A 8/1990 Stannard
4,951,992 A 8/1990 Hockney
4,995,191 A 2/1991 Davis
5,014,480 A 5/1991 Guarriello et al.
5,028,368 A 7/1991 Grau
5,050,362 A 9/1991 Tal et al.
5,058,855 A 10/1991 Ward
5,078,360 A 1/1992 Spera
5,106,233 A 4/1992 Breaux
5,124,102 A 6/1992 Serafini
5,170,605 A 12/1992 Huddle
5,185,193 A 2/1993 Phenicie et al.
5,187,843 A 2/1993 Lynch
5,216,863 A 6/1993 Nessa et al.
5,243,805 A 9/1993 Fricker
5,247,773 A * 9/1993 Weir ..... E01F 8/0011 52/592.3
5,265,750 A 11/1993 Whiteley
5,292,208 A 3/1994 Berger
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.

(56) References Cited

U.S. PATENT DOCUMENTS 5,553,430 A 9/1996 Majnaric et al.
5,591,265 A 1/1997 Tusch
5,608,999 A * 3/1997 McNamara ..... E04B 1/12 52/220.1
5,625,989 A 5/1997 Brubaker et al.
5,714,045 A 2/1998 Lasa et al.
5,729,944 A 3/1998 De Zen
5,735,097 A 4/1998 Cheyne
5,740,648 A 4/1998 Piccone
5,747,134 A 5/1998 Mohammed et al.
5,758,467 A 6/1998 Snear et al.
5,791,103 A 8/1998 Coolman
5,816,010 A 10/1998 Conn
5,824,347 A 10/1998 Serafini
5,860,262 A 1/1999 Johnson
5,860,267 A 1/1999 Pervan
5,876,810 A 3/1999 Bodine et al.
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.
6,185,884 B1 2/2001 Myers et al.
6,189,269 B1 2/2001 De Zen
6,199,340 B1 3/2001 Davis
6,209,278 B1 4/2001 Tychsen
6,212,845 B1 4/2001 De Zen
6,219,984 B1 4/2001 Piccone
6,220,779 B1 4/2001 Warner et al.
6,226,950 B1 5/2001 Davis
6,247,280 B1 * 6/2001 Grinshpun ..... E04B 2/8635 52/309.12
6,286,281 B1 9/2001 Johnson
6,293,067 B1 9/2001 Meendering et al.
6,357,196 B1 3/2002 McCombs
6,378,261 B1 4/2002 Agsten
6,387,309 B1 5/2002 Kojima
6,405,508 B1 6/2002 Janesky
6,430,885 B1 8/2002 Ito
6,435,470 B1 8/2002 Lahham et al.
6,435,471 B1 8/2002 Piccone
6,438,918 B2 8/2002 Moore et al.
6,467,136 B1 10/2002 Graham
6,530,185 B1 3/2003 Scott et al.
6,539,643 B1 4/2003 Gleeson
6,550,194 B2 4/2003 Jackson et al.
6,584,748 B2 7/2003 Bresnahan
6,588,165 B1 7/2003 Wright
6,622,452 B2 9/2003 Alvaro
6,647,689 B2 11/2003 Pletzer et al.
6,691,976 B2 2/2004 Myers et al.
6,694,692 B2 2/2004 Piccone
6,832,456 B1 12/2004 Bilowol
6,866,445 B2 3/2005 Semler
6,935,081 B2 8/2005 Dunn et al.
7,007,433 B2 3/2006 Boyer
7,188,576 B2 3/2007 Bogard et al.
7,320,201 B2 1/2008 Kitchen et al.
7,406,801 B2 8/2008 Zeng et al.
7,415,801 B2 8/2008 Zeng et al.
7,444,788 B2 11/2008 Morin et al.
7,584,583 B2 9/2009 Bergelin et al.
7,763,345 B2 7/2010 Chen et al.
7,765,762 B2 8/2010 Gulbrandsen et al.
7,818,936 B2 10/2010 Morin et al.
7,901,537 B2 3/2011 Jones et al.
8,071,193 B2 12/2011 Windmöller
8,074,418 B2 12/2011 Thiagarajan et al.
8,316,598 B2 11/2012 Flynn et al.
8,322,102 B2 12/2012 Krieger
8,485,493 B2 7/2013 Wells et al.
8,544,232 B2 10/2013 Wybo et al.
8,707,648 B2 4/2014 Timko et al.
8,769,904 B1 * 7/2014 Brandt ..... E04F 15/02038 52/588.1
8,806,839 B2 8/2014 Zhou
8,859,898 B2 10/2014 Frye
8,881,483 B2 11/2014 Caboni
8,925,275 B2 1/2015 Meersseman et al.
8,959,871 B2 2/2015 Parenti et al.
8,985,888 B2 * 3/2015 Kawasaki ..... F16B 21/082 403/361
8,992,131 B2 3/2015 Castonguay et al.
9,003,737 B2 4/2015 Solomon et al.
9,156,233 B2 10/2015 Dossche et al.
9,315,987 B2 * 4/2016 Richardson ..... E04G 23/0218
9,328,518 B2 5/2016 Bilge
9,347,226 B2 5/2016 Ouellet
9,745,758 B2 8/2017 Baert et al.
9,850,658 B2 12/2017 Alcala Ordaz
9,913,083 B2 3/2018 Rosendahl
9,993,340 B2 6/2018 Foroni et al.
10,246,883 B2 4/2019 Derelov
10,287,777 B2 5/2019 Boo
10,400,457 B2 9/2019 Simon
10,480,186 B2 11/2019 Tanguay et al.
10,563,410 B2 2/2020 Horton et al.
10,619,357 B2 4/2020 Segaert et al.
10,731,333 B2 * 8/2020 Richardson ..... E04B 2/8635
2003/0005659 A1 1/2003 Moore, Jr.
2003/0085482 A1 5/2003 Sincock et al.
2003/0155683 A1 8/2003 Pietrobon
2004/0010994 A1 1/2004 Piccone
2004/0020149 A1 2/2004 Messiqua
2004/0093817 A1 5/2004 Pujol Barcons
2004/0216408 A1 11/2004 Hohmann, Jr.
2005/0016083 A1 * 1/2005 Morin ..... E04C 2/34 52/79.14
2005/0016103 A1 1/2005 Piccone
2005/0055938 A1 3/2005 Secondino
2006/0179762 A1 * 8/2006 Thome ..... E04F 13/0805 52/506.01
2006/0185270 A1 8/2006 Handley et al.
2006/0185291 A1 8/2006 Mathe
2006/0213140 A1 9/2006 Morin et al.
2006/0251865 A1 * 11/2006 Hinterneder ..... F24S 70/14 428/188
2007/0028544 A1 2/2007 Messiqua et al.
2007/0044416 A1 3/2007 Van Dijk
2007/0107341 A1 5/2007 Zhu
2007/0193169 A1 8/2007 Emblin
2008/0163664 A1 7/2008 Battenfeld
2008/0168734 A1 7/2008 Degen et al.
2009/0120027 A1 5/2009 Amend
2009/0229214 A1 8/2009 Nelson
2009/0269130 A1 10/2009 Williams
2010/0047608 A1 2/2010 Seccombe
2010/0050552 A1 3/2010 Richardson et al.
2010/0071304 A1 3/2010 Richardson et al.
2010/0212241 A1 8/2010 Holroyd
2010/0251657 A1 * 10/2010 Richardson ..... E04G 11/06 52/588.1
2010/0275547 A1 11/2010 Kamata
2010/0325984 A1 12/2010 Richardson et al.
2011/0000161 A1 1/2011 Aube
2011/0099932 A1 5/2011 Saulce
2011/0131914 A1 6/2011 Richardson et al.
2011/0146189 A1 6/2011 Courey
2011/0277410 A1 11/2011 Richardson
2012/0014745 A1 1/2012 Rosendahl
2012/0056344 A1 * 3/2012 Richardson ..... E04B 1/6116 264/35
2012/0192515 A1 8/2012 Petta
2013/0081345 A1 4/2013 Sheehy
2014/0305063 A1 10/2014 Kim
2014/0360121 A1 * 12/2014 Richardson ..... E04F 13/24 52/588.1
2015/0082724 A1 3/2015 Amend
2015/0135635 A1 * 5/2015 Richardson ..... E04G 23/0218 52/742.13

(56) References Cited

U.S. PATENT DOCUMENTS

| | | | | |
|---|---|---|---|---|
| 2016/0289960 | A1 | 10/2016 | Darwell | |
| 2016/0340899 | A1* | 11/2016 | Piccone | E04B 2/86 |
| 2016/0376799 | A1* | 12/2016 | Richardson | E04G 17/00 29/453 |
| 2017/0218627 | A1 | 8/2017 | Neil | |
| 2019/0032341 | A1 | 1/2019 | Fleet | |
| 2020/0131780 | A1 | 4/2020 | De Rick | |

FOREIGN PATENT DOCUMENTS

| | | | |
|---|---|---|---|
| CA | 1316366 | | 4/1993 |
| CA | 2097226 | | 11/1994 |
| CA | 2141463 | | 8/1996 |
| CA | 2070079 | | 6/1997 |
| CA | 2170681 | | 8/1997 |
| CA | 2218600 | | 6/1998 |
| CA | 2215939 | | 8/1999 |
| CA | 2226497 | | 10/1999 |
| CA | 2243905 | | 1/2000 |
| CA | 2255256 | | 1/2000 |
| CA | 2244537 | | 2/2000 |
| CA | 2418885 | | 8/2003 |
| CA | 2502343 | | 5/2004 |
| CA | 2502392 | | 5/2004 |
| CA | 2499450 | | 9/2005 |
| CA | 2577217 | | 1/2006 |
| CA | 2629202 | | 4/2008 |
| CA | 2716118 | | 8/2008 |
| CA | 2681963 | | 10/2008 |
| CA | 2654992 | | 8/2010 |
| CA | 2751134 | | 12/2011 |
| CA | 2855742 | | 5/2013 |
| CA | 2979918 | A1 | 3/2018 |
| CH | 317758 | | 1/1957 |
| CH | 401422 | A | 10/1965 |
| CH | 669235 | | 2/1989 |
| CN | 2272915 | Y | 1/1998 |
| CN | 2529936 | | 1/2003 |
| CN | 105781053 | A | 7/2016 |
| DE | 1684357 | | 4/1967 |
| DE | 1812590 | | 6/1970 |
| DE | 2062723 | | 8/1972 |
| DE | 3003446 | | 8/1981 |
| DE | 3202385 | A1 | 8/1983 |
| DE | 3234489 | | 3/1984 |
| DE | 3727956 | | 5/1988 |
| DE | 3918676 | A1 | 8/1990 |
| DE | 19503948 | A1 | 8/1996 |
| DE | 29803155 | | 6/1998 |
| DE | 20017114 | U1 | 1/2001 |
| DE | 202014006376 | U1 | 12/2014 |
| DE | 202018104844 | U1 | 11/2018 |
| DE | 202018107451 | U1 | 4/2019 |
| EP | 0025420 | | 3/1981 |
| EP | 0055504 | | 7/1982 |
| EP | 0141782 | | 5/1985 |
| EP | 0179046 | | 4/1986 |
| EP | 0381339 | A2 | 8/1990 |
| EP | 0328228 | B1 | 6/1991 |
| EP | 0757137 | | 2/1997 |
| EP | 0735226 | B1 | 8/1999 |
| EP | 1854937 | A1 | 11/2007 |
| EP | 2169133 | | 3/2010 |
| EP | 2799643 | A2 | 11/2014 |
| FR | 0507787 | | 7/1920 |
| FR | 1381945 | | 11/1964 |
| FR | 1603005 | | 4/1971 |
| FR | 2364314 | | 4/1978 |
| FR | 2535417 | | 5/1984 |
| FR | 2721054 | | 6/1994 |
| FR | 2717848 | | 9/1995 |
| FR | 2733264 | A1 | 10/1996 |
| FR | 2669364 | | 3/2012 |
| GB | 137221 | | 1/1920 |
| GB | 779916 | | 7/1957 |
| GB | 1243173 | | 8/1971 |
| GB | 1253447 | | 11/1971 |
| GB | 1408868 | A | 10/1975 |
| GB | 2141661 | | 1/1985 |
| GB | 2205624 | | 12/1988 |
| JP | 05133028 | | 5/1993 |
| JP | 09041612 | | 2/1997 |
| JP | 2008223335 | | 9/2008 |
| NL | 2013486 | | 1/2017 |
| SE | 206538 | | 8/1966 |
| WO | 8204088 | | 11/1982 |
| WO | 9500724 | | 1/1995 |
| WO | 9607799 | | 3/1996 |
| WO | 9635845 | | 11/1996 |
| WO | 9743496 | | 11/1997 |
| WO | 0163066 | | 8/2001 |
| WO | 0173240 | | 10/2001 |
| WO | 03006760 | | 1/2003 |
| WO | 2004088064 | | 10/2004 |
| WO | 2005040526 | | 5/2005 |
| WO | 2008074926 | | 6/2008 |
| WO | 2008119178 | | 10/2008 |
| WO | 2009059410 | | 5/2009 |
| WO | 2009092158 | | 7/2009 |
| WO | 2010012061 | | 2/2010 |
| WO | 2010037211 | | 4/2010 |
| WO | 2010078645 | | 7/2010 |
| WO | 2010094111 | | 8/2010 |
| WO | 2012003587 | A1 | 1/2012 |
| WO | 2014121337 | | 8/2014 |
| WO | 2017/132477 | A1 | 8/2017 |
| WO | 2019/197393 | A1 | 10/2019 |

OTHER PUBLICATIONS

Vector Corrosion Technologies Marketing Materials, 2007.
Vector Corrosion Technologies Marketing Materials, 2008.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.
The Digigraph System, http://www.digigraph-housing.com/web/system.ht, accessed online Jan. 2012.

* cited by examiner 1120
1185B
1185A
1183
1154
1181A
1141A
1147A
1143A
1145B
1145A
1181B
210
1145A
1145B
1145A
1145B
1154
1183
1185A
1185B
1089A
1089B
1085'
1085
312,314
1047
1045B
310
1043
1041
1045,1045A
1085'
1085
1045,1045A
1081
1043
1041
1087
1045,1045A

METHODS AND APPARATUS FOR RESTORING, REPAIRING, REINFORCING AND/OR PROTECTING STRUCTURES USING CONCRETE

RELATED APPLICATIONS

This application is a continuation of U.S. application Ser. No. 15/849,474 filed 20 Dec. 2017, which is in turn a continuation of U.S. application Ser. No. 15/145,665 filed 3 May 2016 which is in turn a continuation of U.S. application Ser. No. 14/611,055 filed 30 Jan. 2015 which in turn is a continuation of U.S. application Ser. No. 12/794,607 filed 4 Jun. 2010. Application Ser. No. 12/794,607 is a continuation-in-part of PCT application No. PCT/CA2010/000003 filed 7 Jan. 2010 which in turn claims priority from U.S. application No. 61/143,151 filed 7 Jan. 2009 and U.S. application 61/223,378 filed 6 Jul. 2009. Application Ser. No. 12/794,607 also claims the benefit under 35 USC § 119(e) of the priority of U.S. application No. 61/223,378 filed 6 Jul. 2009. All of the applications referred to in this paragraph are hereby incorporated herein by reference.

TECHNICAL FIELD

The invention relates to methods and apparatus for restoring, repairing, reinforcing and/or protecting a variety of structures using concrete or other curable material(s).

BACKGROUND

Concrete is used to construct a variety of structures, such as building walls and floors, bridge supports, dams, columns, raised platforms and the like. Typically, concrete structures are formed using embedded reinforcement bars (often referred to as rebar) or similar steel reinforcement material, which provides the resultant structure with increased strength. Over time, corrosion of the embedded reinforcement material can impair the integrity of the embedded reinforcement material, the surrounding concrete and the overall structure. Similar degradation of structural integrity can occur with or without corrosion over sufficiently long periods of time, in structures subject to large forces, in structures deployed in harsh environments, in structures coming into contact with destructive materials or the like.

FIG. 1 shows an example of a damaged concrete structure 10. Structure 10 is generally rectangular in cross-section and comprises undamaged in section 10A and damaged in section 10B. The damage to structure 10 has changed the cross-sectional shape of damaged section 10B. While damaged section 10B remains generally rectangular, its surface profile is relatively uneven. In some portions 12 of structure 10, the concrete damage is sufficient to expose reinforcement material 14 (e.g. steel rebar).

There is a desire for methods and apparatus for repairing and/or restoring concrete structures which have been degraded or which are otherwise in need of repair and/or restoration.

Some structures have been fabricated with inferior or sub-standard structural integrity. By way of non-limiting example, some older structures may have been fabricated in accordance with seismic engineering specifications that are lower than, or otherwise lack conformity, with current seismic engineering standards. There is a desire to reinforce existing structures to upgrade their structural integrity or other aspects thereof.

There is also a desire to protect structures from damage which may be caused by, or related to, the environment in which the structure is deployed and/or the materials which come into contact with the structure. By way of non-limiting example, structures fabricated from metal or concrete can be damaged when they are deployed in environments that are in or near salt water or in environments where the structures are exposed to salt or other chemicals used to de-ice roads.

Structures for which it is desirable to repair, restore, reinforce and/or protect are not limited to concrete structures. There are similar desires for structures fabricated from other materials.

BRIEF DESCRIPTION OF THE DRAWINGS

In drawings which depict non-limiting embodiments of the invention:

FIG. 15A is an isometric view of an apparatus for repairing the FIG. 5A structure according to another embodiment;

DETAILED DESCRIPTION

Figure 2A:
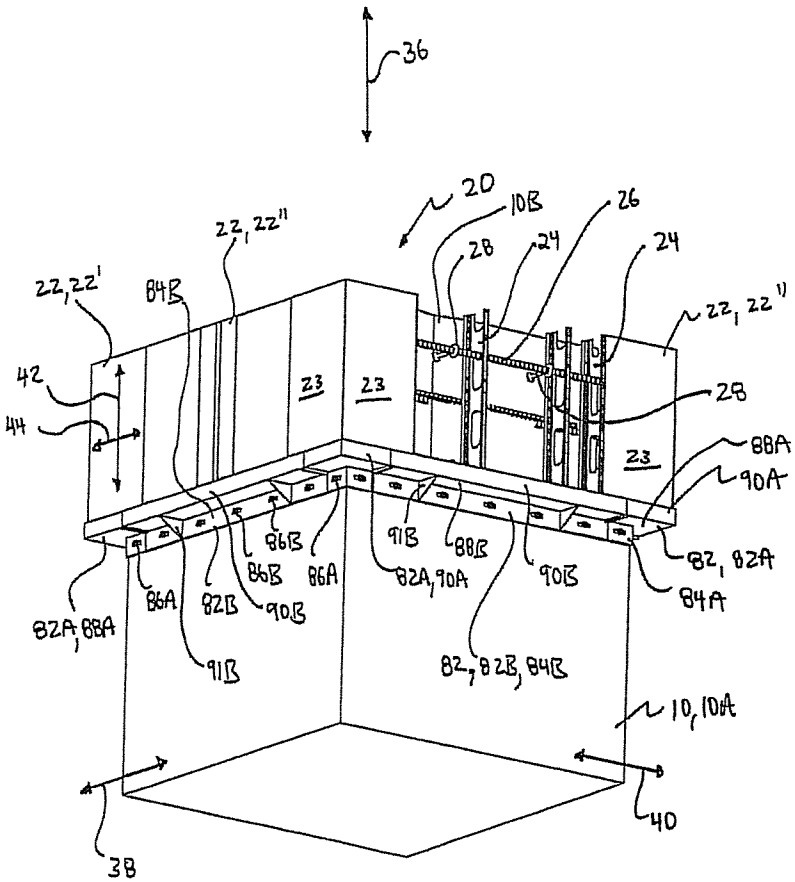
FIG. 2A is a partially cut-away isometric view of an apparatus for repairing the FIG. 1 structure according to a particular embodiment.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Apparatus and methods according to various embodiments may be used to repair, restore, reinforce and/or protect existing structures using concrete and/or similar curable materials. For brevity, in this description and the accompanying claims, apparatus and methods according to various embodiments may be described as being used to "repair" existing structures. In this context, the verb "to repair" and its various derivatives should be understood to have a broad meaning which may include, without limitation, to restore, to reinforce and/or to protect the existing structure. Similarly, structures added to existing structures in accordance with particular embodiments of the invention may be referred to in this description and the accompanying claims as "repair structures". However, such "repair structures" should be understood in a broad context to include additive structures which may, without limitation, repair, restore, reinforce and/or protect existing structures. Further, many of the existing structures shown and described herein exhibit damaged portions which may be repaired in accordance with particular embodiments of the invention. In general, however, it is not necessary that existing structures be damaged and the methods and apparatus of particular aspects of the invention may be used to repair, restore, reinforce or protect existing structures which may be damaged or undamaged.

One aspect of the invention provides a method for repairing an existing structure to cover at least a portion of the existing structure with a repair structure. The method comprises: mounting one or more standoff retainers to the existing structure; coupling one or more standoffs to the standoff retainers such that the standoffs extend away from the existing structure; coupling one or more cladding panels to the standoffs such that the panels are spaced apart from the existing structure to provide a space therebetween; and introducing a curable material to the space between the panels and the existing structure, the panels acting as at least a portion of a formwork for containing the curable material until the curable material cures to provide a repair structure cladded, at least in part, by the panels.

Another aspect of the invention provides an apparatus for repairing an existing structure to cover at least a portion of the existing structure with a repair structure. The apparatus comprises: one or more standoff retainers mounted to the existing structure; one or more standoffs coupled to the standoff retainers, the standoffs extending away from the existing structure; and one or more cladding panels coupled to the standoffs, the panels spaced apart from the existing structure to provide a space therebetween. Curable material is introduced to the space between the panels and the existing structure and the panels act as at least a portion of a formwork for containing the curable material until the curable material cures to provide a repair structure cladded, at least in part, by the panels.

Another aspect of the invention provides a method for repairing an existing structure to cover at least a portion of the existing structure with a repair structure. The method comprises: providing a plurality of cladding panels to define at least a portion of an exterior of the repair structure at a location spaced apart from the existing structure; bracing the cladding panels from an exterior thereof; interposing anchoring components between the panels and the existing structure wherein interposing the anchoring components comprises coupling the anchoring components to the panels; introducing a curable material to the space between the panels and the existing structure, the panels containing the curable material until the curable material cures; and removing the bracing after the curable material cures to provide a repair structure cladded, at least in part, by the panels. An associated apparatus is also provided.

Another aspect of the invention provides a method for repairing an existing structure to cover at least a portion of the existing structure with a repair structure. The method comprises: mounting one or more form retainers to the existing structure, the form retainers extending outwardly away from the existing structure; coupling one or more form components to the form retainers, the form components defining at least a portion of an exterior of the repair structure at a location spaced outwardly apart from the existing structure; and introducing a curable material to the space between the form components and the existing structure, the form components containing the curable material until the curable material cures provide a repair structure. An associated apparatus is also provided.

Kits may also be provided in accordance with some aspects of the invention. Such kits may comprise portions of the apparatus according to various embodiments and may facilitate effecting one or more methods according to various embodiments.

Figure 1:
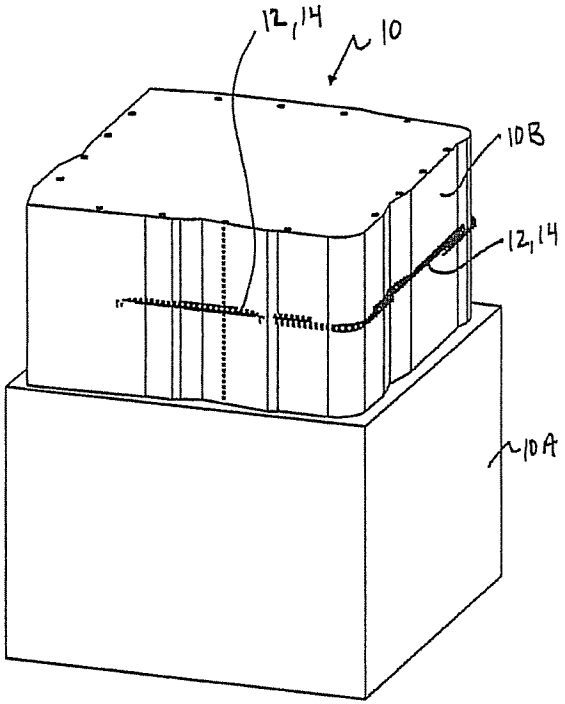
FIG. 1 shows an example of a concrete structure which has been damaged.
Figure 2B:
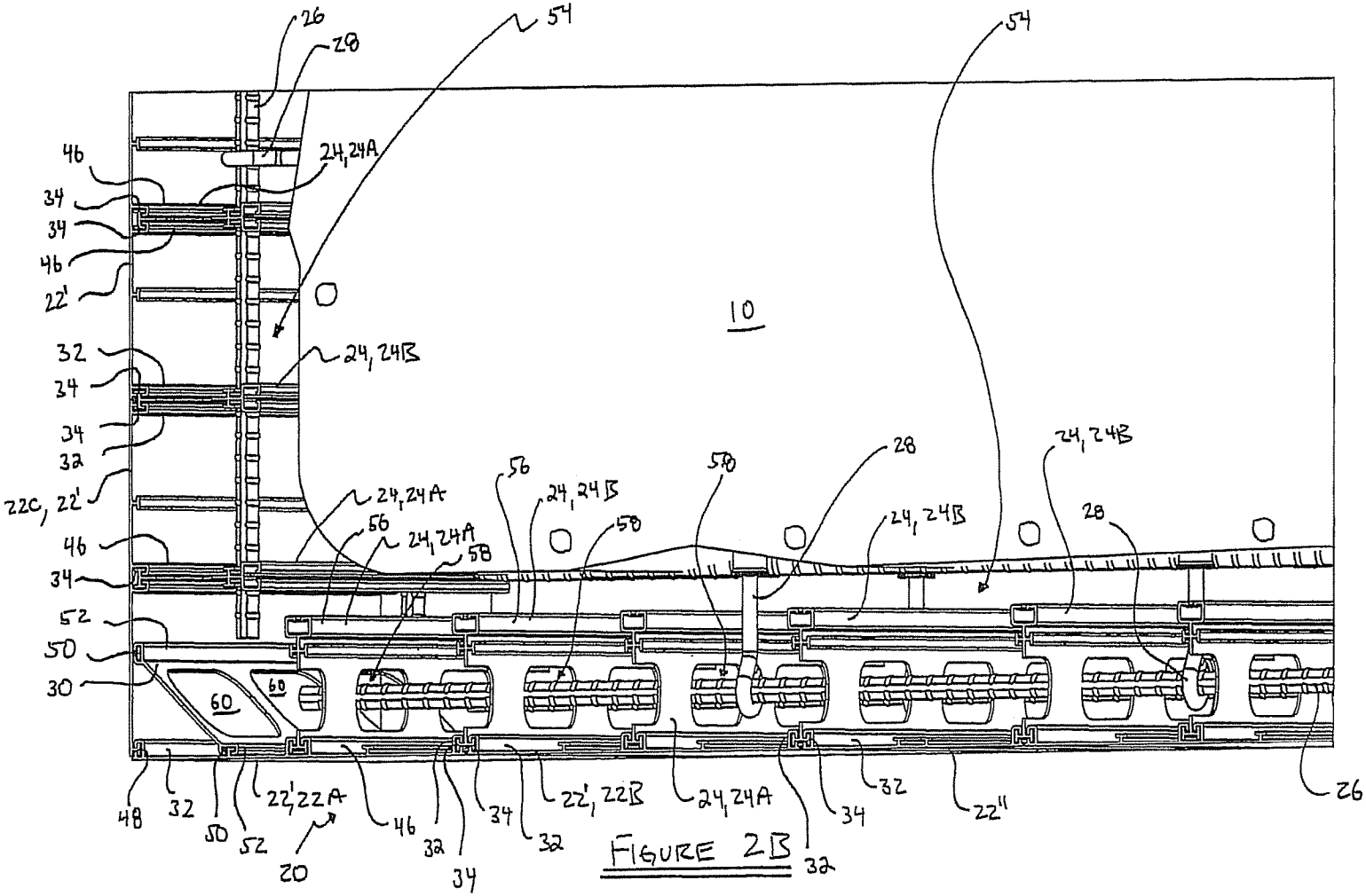
FIGS. 2B and 2C are respectively a partial isometric view and a partial top view of the FIG. 2A apparatus.
Figure 2D:
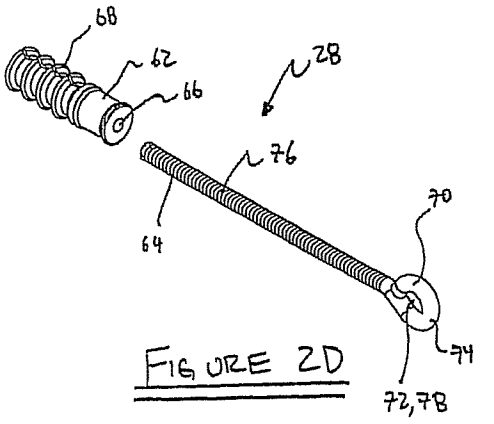
FIGS. 2D and 2E are respectively an isometric view of a rebar retainer as used in the FIG. 2A apparatus and an isometric view of an alternative rebar retainer suitable for use with the FIG. 2A apparatus.
Figure 2E:
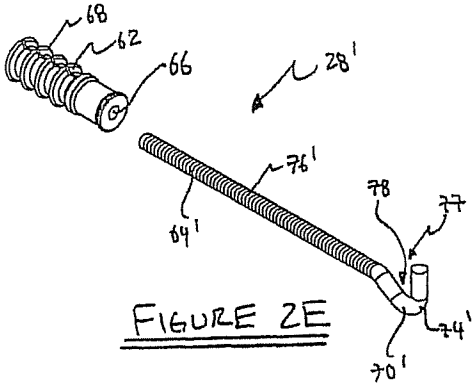
Figure 2C:
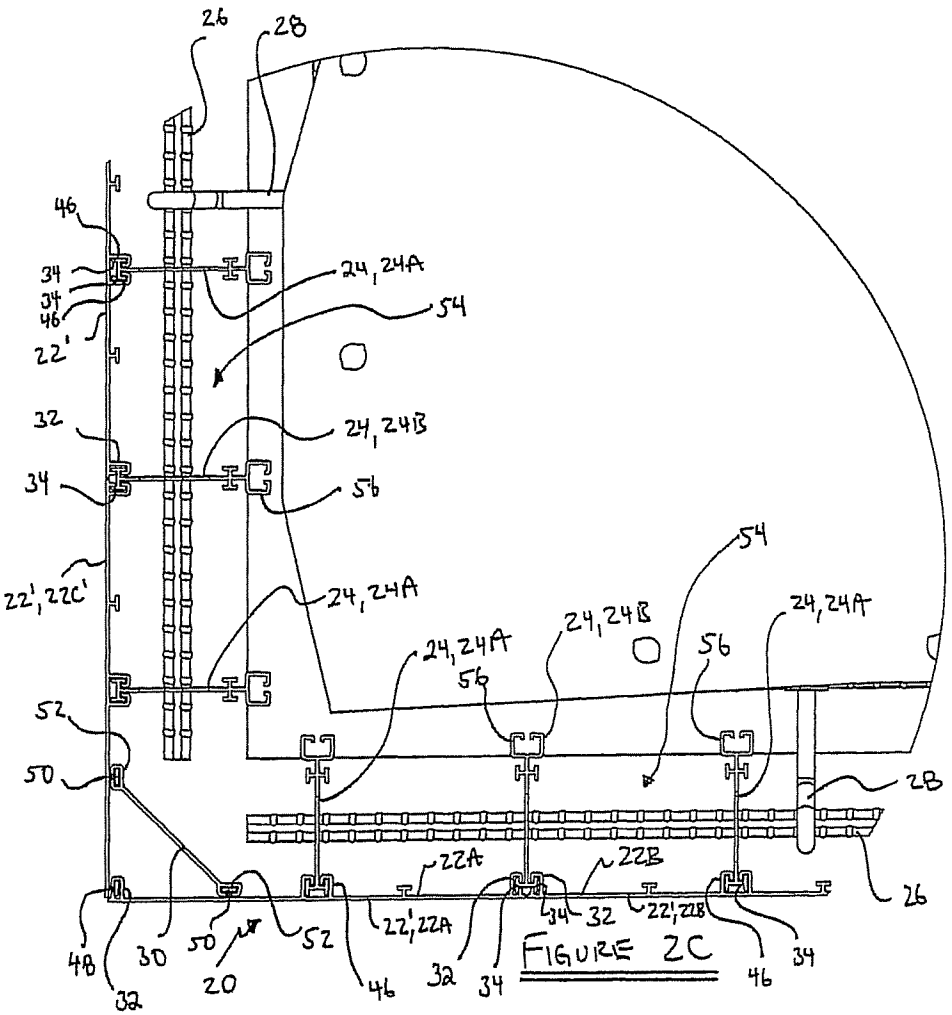

FIG. 2A shows a partially cut-away isometric view of a formwork apparatus 20 which may be used to repair a generally rectangular cross-section structure 10 (FIG. 1) according to a particular embodiment of the invention. FIGS. 2B and 2C respectively show magnified partial isometric and top views of apparatus 20 and FIG. 2D shows a magnified view of a rebar retainer 28 of the type used in the illustrated embodiment of apparatus 20. As shown in FIGS. 2A-2C, apparatus 20 of the illustrated embodiment comprises a plurality of panels 22, standoffs 24, rebar 26, rebar retainers 28, optional braces 30 and edge formwork components 82.

By way of non-limiting example, panels 22 may be similar to similar panels described in any of PCT patent publications No. WO96/35845, WO97/43496, WO01/73240, WO03/06760, WO2005/007985, WO2008/119178, WO2009/059410, U.S. Pat. Nos. 6,435,471, 6,694,692 and/or Canadian patent publications No. 2243905, 2298319. Panels 22 of the exemplary apparatus 20 are generally flattened with longitudinal dimensions 42 and widths 44. Panels 22 may have generally uniform cross-sections in the direction of their longitudinal dimensions 42, although this is not necessary. Panels 22 may be fabricated from various type(s) of plastic (e.g. PVC) or other suitable material(s) (e.g. suitable metals, metal alloys, polymeric materials, fiberglass, carbon fiber material or the like) using extrusion or any other suitable fabrication technique. The longitudinal dimensions 42 of panels 22 may be fabricated to have desired lengths or may be cut to desired lengths. Panels 22 may be fabricated to be have modularly dimensioned widths 44 (e.g. 1, 2, 4, 6, 8, 12 and 16 inches) to fit various existing structures 10 and for use in various applications. As shown best in FIG. 2A, this modularity of panels 22 is exhibited in apparatus 20 which comprises panels 22' having a first width 44 and at least one panel 22" (in the illustrated views) having a second width 44 which is ⅔ the width of panels 22'.

Panels 22 of the illustrated embodiment comprise generally flattened outer surfaces 23 which may be aligned with one another to provide a flattened shape to structure 10 after it is repaired using apparatus 20. Such a flattened outer surface shape is not necessary, however, and panels 22 may comprise outer surfaces having a myriad of suitable shapes to provide structure 10 with any desired shape after repair using apparatus 20. In the illustrated embodiment of FIGS. 2A-2C (where structure 10 is generally vertically oriented and has a generally rectangular cross-section), the longitudinal dimensions 42 of panels 22 may extend in a generally vertical direction 36 and the widths 44 of panels 22 may be oriented in one of horizontal directions 38, 40. This is not necessary, however, and panels 22 may be oriented in other directions to repair other structures.

Panels 22 may comprise connector components 32 at their opposing edges for engaging corresponding connector components 34 of standoffs 24 (see FIGS. 2B and 2C). In the illustrated embodiment, connector components 32 comprise female C-shaped connector components 32 which slidably receive corresponding male T-shaped connector components 34 of standoffs 24.

Standoffs 24 of the illustrated embodiment comprise interior standoffs 24A and edge-connecting standoffs 24B. As shown in FIGS. 2B and 2C, panels 22 may comprise interior connector components 46 at one or more locations spaced apart from their edges for engaging corresponding connector components 34 of interior standoffs 24A. In the illustrated embodiment, connector components 46 comprise female J-shaped connector components 46 which slidably receive corresponding male T-shaped connector components 34 of interior standoff 24A.

In the illustrated embodiment, each of wider panels 22' comprises one pair of interior connector components 46 and is connected to one corresponding interior standoff 24A, but narrower panels 22" do not include interior connector components 46 and are not connected to corresponding interior standoffs 24A. In general, panels 22 of apparatus 20 may be provided with any suitable number of interior connector components 46 for connecting to any suitable number of interior standoffs 24A. The number of sets of interior connector components 46 on a given panel 22 may depend on the width 44 of panel 22. Also, the mere provision of interior connector components 46 on panel 22 does not necessitate connecting to a corresponding interior standoff 24A at that location.

Edge-connecting standoffs 24B may be used to connect edge-adjacent panels 22 to one another by making connections between connector components 34 of edge-connecting standoffs 24B and connector components 32 on the edges of panels 22. An example of such a connection is shown in FIG. 2C, where edge-connecting standoff 24B connects edge-adjacent panels 22A and 22B. In the illustrated embodiment, one of connector components 34 of standoff 24B connects with a corresponding connector component 32 on one edge of panel 22A and the other one of connector components 34 of standoff 24B connects with a corresponding connector component 32 on one edge of panel 22B.

The use of edge-connecting standoffs 24B to connect panels 22 in edge-adjacent relationship is not necessary. Panels 22 may be designed to connect directly to one another. This is the case, for example, with outside corner panel 22C (FIG. 2C) which comprises a connector component 48 at one of its edges that is different from the connector component 32 at its other edge. Connector component 48 is designed to connect directly to connector component 32 at the edge of a panel 22A which may be oriented in different direction than corner panel 22C (e.g. at an orthogonal angle in the illustrated embodiment such that the connection between panels 22A, 22C forms a 90° outside corner). In general, outside corners having different angles or other panel-to-panel connections wherein the panels are oriented in different directions may be provided by suitable modification of the panel-to-panel connection. It is not necessary, however, that panels connected directly to one another be oriented in different directions—i.e. panels generally aligned with one another may be directly connected to one another using suitable connector components as described in more detail below (see, for example, the panel to panel connection of apparatus 120 (FIG. 4)). In the illustrated embodiment, connector component 48 comprises a male, T-shaped connector component which is slidably received in female C-shaped connector component 32 of panel 22A.

As shown best in FIG. 2C, apparatus 20 of the illustrated embodiment makes use of optional braces 30 to reinforce the direct panel-to-panel connections (e.g. between corner panel 22C and adjacent panel 22A). Brace 30 comprises connector components 52 at each of its edges for engaging corresponding connector components 50 on panels 22A, 22C such that braces 30 extend at an angle (e.g. 45°) between panels 22A, 22C to reinforce the outside corner formed by panels 22A, 22C and the connection between connector components 48, 32. In the illustrated embodiment, the interior surfaces of panels 22 are provided with male, T-shaped connector components 50 which are slidably received in female, C-shaped connector components 52 of braces 30. Braces 30 may comprise a plurality of apertures 60 which may be spaced at regular intervals along longitudinal dimension 42. Apertures 60 permit concrete flow therethrough. While not shown in the illustrated embodiment, rebar 26 may also extend though apertures 60.

Standoffs 24 extend in the direction of longitudinal dimension 42 of panels 22 and in directions inwardly from panels 22 toward structure 10. As will be explained in more detail below, standoffs 24 help to maintain a space 54 between structure 10 and panels 22 to permit concrete to flow into space 54 for repairing structure 10. Standoffs 24 may also serve to help retain panels 22 from moving outwardly when space 54 (between the interior surfaces of panels 22 and structure 10) is filled with concrete. Standoffs 24 may be provided with heads 56 at or near their interior edges. Heads 56 may extend transversely from standoffs 24 (e.g. in the directions of widths 44 of panels 22) and in the longitudinal direction 42. Such extension of heads 56 in transverse and longitudinal directions may provide surfaces for engaging structure 10. Standoffs 24 comprise a plurality of apertures 58 (FIG. 2B) which may be spaced at regular intervals along longitudinal dimension 42. Apertures 58 permit concrete flow therethrough to ensure an even distribution of concrete in space 54. In the illustrated embodiment, some apertures 58 also permit the extension of rebar 26 therethrough.

Apparatus 20 comprises rebar retainers 28 which connect to structure 10 and support rebar 26. FIG. 2D shows more detail of a particular example of a rebar retainer 28 used in the illustrated embodiment of apparatus 20. Rebar retainer 28 is a two-piece rebar-retaining component which comprises an anchor nut 62 (which engage structure 10) and an eye bolt 64 (which comprises a threaded shaft 76 for engaging anchor nut 62 at one end and which comprises one or more rebar-retaining features 70 for engaging rebar 26 at its opposing end). In other embodiments, rebar retainer 28 may comprise a single piece component or a multi (i.e. more than two) piece component which connects to existing structure 10 and supports rebar 26.

In the illustrated embodiment, anchor nut 62 comprises one or more concrete-engaging features 68 and a threaded bore 66. Concrete-engaging features 68 may comprise a plurality of radially extending ridges around an exterior circumference of anchor nut 62. When threaded shaft 76 of eye bolt 64 is received in threaded bore 66 of anchor nut 62, concrete-engaging features 68 extend further in generally radial directions. It will be appreciated by those skilled in the art that there are a wide variety of concrete anchors known in the art, and that where existing structure 10 is fabricated from concrete, rebar retainers 28 could make use of any such concrete anchors provided with suitable rebar-retaining features 70. In embodiments used to repair structures fabricated from materials other than concrete, rebar retainers 28 may comprise structure-engaging features suitable for connection of rebar retainers to the structure (e.g. in the place of anchor nut 62 and/or concrete-engaging features 68).

In the illustrated embodiment, rebar-retaining feature 70 comprises a curved bight 74 which defines an aperture 72 through which rebar 26 may extend (see FIG. 2B). It is not necessary that curved bight 74 define a complete aperture 72. FIG. 2E illustrates a rebar retainer 28' comprising a J-bolt 64' in the place of eye-bolt 64. J-bolt 64' comprises a threaded shaft 76' and a rebar-retaining feature 70' having a bight 74' (which may be curved) wherein there is a space 77 between the end of bight 74' and shaft 76', such that bight 74' defines a concavity 78. Although not shown in the illustrated embodiment, space 77 between the end of bight 74' mid shaft 76' may be less than a cross-sectional dimension of rebar 26 or may be less than a cross-sectional dimension of concavity 78. Space 77 may be provided in a location relatively close to structure 10 and bight 74' may be provided on a side opposite structure 10, such that once rebar 26 is located in concavity 78, rebar 26 is prevented from movement out of concavity 78 under application of force to rebar 26 in directions away from structure 10. It will be appreciated by those skilled in the art that eye bolt 64 or J-bolt 64' could be provided with other rebar-retaining features in the place of rebar-retaining features 70, 70'.

In the illustrated embodiment, rebar 26 is made of steel and has a generally round cross-section with generally circumferential or semi-circumferential reinforcement ribs. This type of rebar is in widespread use in North America. In general, however, rebar 26 may be provided with any suitable shape (e.g. any suitable cross-sectional shape), with or without reinforcement features and may be provided from suitably strong materials other than steel. By way of non-limiting example, rebar 26 may be fabricated from suitable fiberglass, carbon fiber, plastics, other polymer materials, composite materials and/or the like.

Apparatus 20 of the illustrated embodiment comprises outside corner edge formwork components 82A and generally straight edge formwork components 82B (collectively, edge formwork components 82) which are shown best in FIG. 2A. Corresponding features of outside corner edge formwork components 82A and straight edge formwork components 82B are respectively denoted with similar reference numerals followed by the letters A (in the case of outside corner edge formwork components 82A) and B (in the case of straight edge formwork components 82B). In the illustrated embodiment, edge formwork components 82 comprise mounting flanges 84A, 84B (collectively, mounting flanges 84), edge components 88A, 88B (collectively, edge components 88) and overlap flanges 90A, 90B (collectively, overlap flanges 90). In the illustrated embodiment, straight edge formwork components 82B also comprise optional brace components 91B which extend between mounting flanges 84B and edge components 88B at spaced apart intervals. Brace components 91B may help edge formwork components 82B retain the pressure caused by liquid concrete in space 54 between panels 22 and structure 10. The presence of and/or spacing between brace components 91B may depend on the strength of edge formwork components 82B relative to the pressure exerted by the liquid concrete. In some embodiments, outside corner edge formwork components 82A may comprise similar brace components.

Mounting flanges 84 abut against structure 10. In the illustrated embodiment, fasteners 86A, 86B (collectively, fasteners 86) penetrate mounting flanges 84 and extend into structure 10, thereby mounting edge formwork components 82 to structure 10. Fasteners 86 may comprise any suitable fasteners which may depend on the nature of existing structure 10. As is known in the art, some fasteners are better suited for, or specifically designed for, use with certain materials. In the illustrated embodiment, where structure 10 is a concrete structure, fasteners 86 may comprise suitable concrete fasteners (e.g. concrete screws or two part concrete fasteners). In some embodiments, mounting flanges 84 may be provided with apertures (not specifically enumerated) through which fasteners 86 may extend. In other embodiments, fasteners 86 may be driven through mounting flanges 84 or mounting flanges may be pre-drilled to accommodate fasteners 86. In some embodiments, it may be desirable to pre-drill into structure 10 prior to inserting fasteners 86. In still other embodiments, suitable adhesives, other connection techniques or the like may be used (in addition to or in the alternative to fasteners 86) to mount edge formwork components 82 to structure 10.

Once mounted in this manner, edge components 88 extend away from structure 10 and toward overlap flanges 90. Overlap flanges 90 will then overlap an edge of panels 22 to provide apparatus 20 with formwork edge(s) as desired. Optional brace components 91B may strengthen the formwork edge(s) provided by edge formwork components 82. In the illustrated embodiment where structure 10 is generally vertically oriented and apparatus 20 is located above the lowermost surface of structure 10, apparatus 20 comprises edge formwork components 82 at its lower edge, where overlap flanges 90 overlap the lower edges of panels 22. In some embodiments, suitable fasteners (not shown), adhesives and/or other connection techniques (e.g. plastic welding) may be used to connect overlap flanges 90 to the edges of panels 22. While not expressly shown in the illustrated views, in some embodiments it may be desirable to provide apparatus 20 with edge formwork components at its opposing (e.g. upper) edge. Such opposing edge formwork components could be substantially similar to edge formwork components 82 shown in the illustrated views and could comprise overlap flanges which overlap the upper edges of panels 22. Such opposing edge formwork components could be mounted to structure 10 after concrete is introduced or before concrete is introduced (if concrete is pumped into apparatus 20 using one or more suitable concrete introduction ports (not shown)). Concrete introduction ports are well understood by those skilled in the art.

In other embodiments, straight edge formwork components 82B could be cut with complementary miter edges at the outside corners, obviating the need for a separate outside corner edge formwork components 82A. The miter joints may be taped or sealed with a suitable material (e.g. silicone) to prevent leakage of liquid concrete. In such embodiments, one or more angled (e.g. L-shaped) braces (not shown) could be provide to extend across the miter joint and could be suitably coupled to edge formwork components 82B on both sides of the miter joint to reinforce the joint. Such angled braces may be mounted to edge component 88, for example.

Figure 2F:
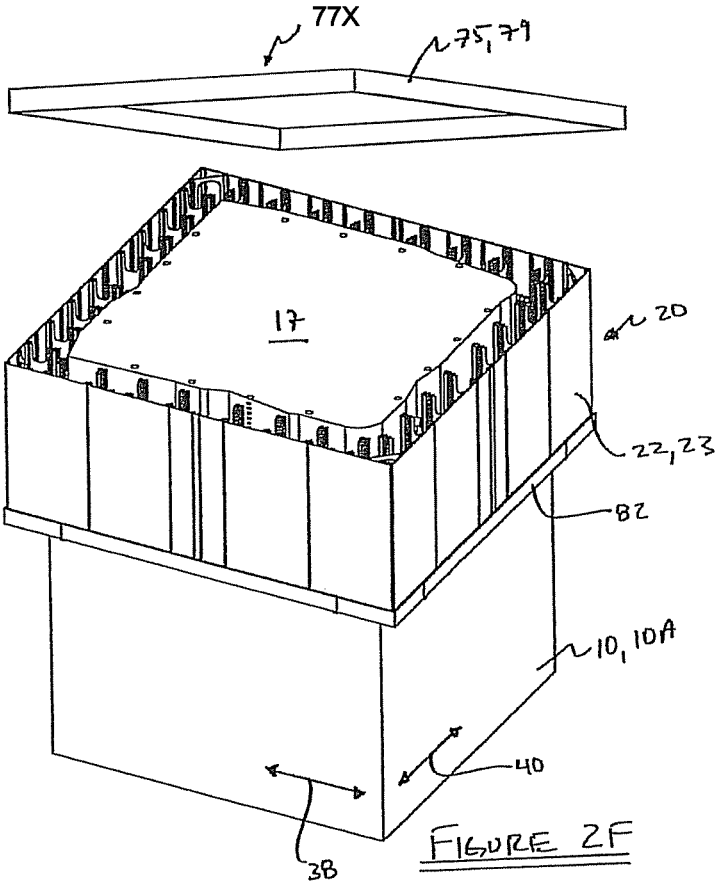
FIG. 2F is an isometric view of an additional or alternative edge formwork components suitable for use with the FIG. 2A apparatus.
Figure 2G:
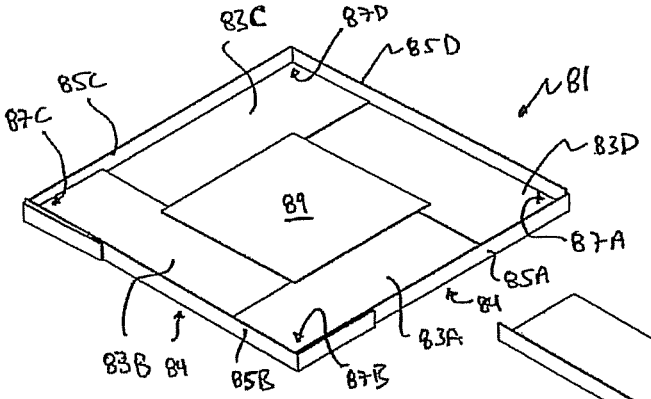
FIG. 2G is isometric view of an additional or alternative edge formwork assembly suitable for use with the FIG. 2A apparatus and FIG. 2H is an isometric view of a corner component of the FIG. 2G edge formwork assembly.
Figure 2H:
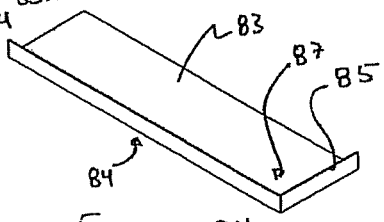
Figure 2I:
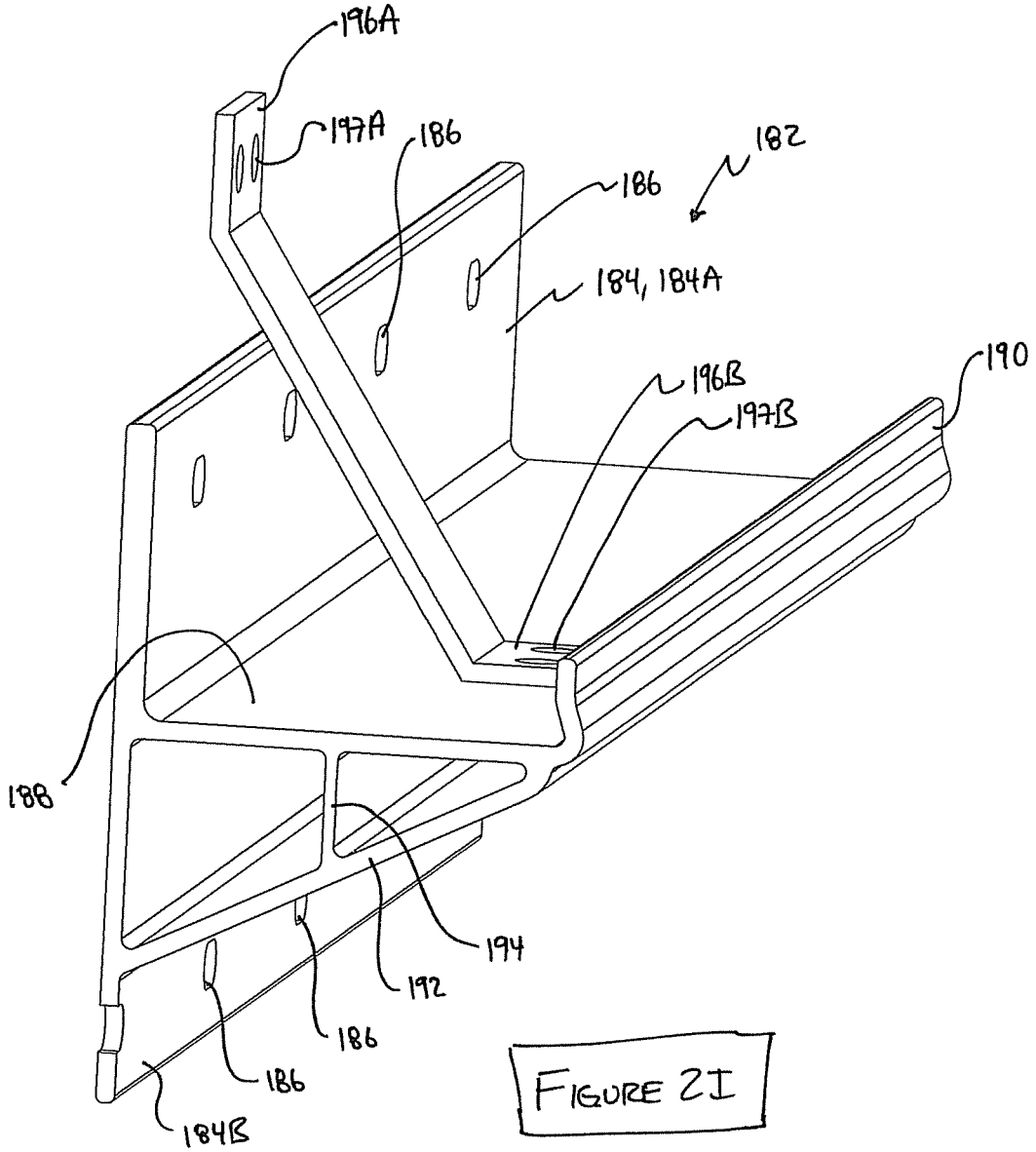
FIG. 2I is an isometric view of a straight edge formwork component and an optional reinforcement bracket according to another embodiment suitable for use with the FIG. 2A apparatus.

FIG. 2I is an isometric view of a straight edge formwork component 182 according to another embodiment suitable for use with apparatus 20 of FIG. 2A. FIG. 2I also shows an optional reinforcement bracket 195 which may be used to provide extra holding strength to edge formwork component 182. Edge formwork component 182 comprises: mounting flange 184 which abuts against structure 10; edge component 188 which extends away from mounting flange 184 and from structure 10; overlap flange 190 which overlaps panels 22; and beveled brace 192 which extends at a non-orthogonal angle between mounting flange 184 and edge component 188. In the illustrated embodiment, mounting flange 184 comprises first (e.g. upper) mounting flange portion 184A which extends away from edge component 188 on a side opposite beveled brace 192 and second (e.g. lower) mounting flange portion 184B which extends away from beveled brace 192 on a side opposite edge component 188. In other embodiments, edge formwork component 182 need not incorporate both first and second mounting flange portions 184A, 184B, but may instead comprise either first mounting flange portion 184A or second mounting flange portion 184B. In the illustrated embodiment, edge formwork component 182 also comprises an optional intermediate brace 194 that extends between edge component 188 and beveled brace 192. Beveled brace 192 and intermediate brace 194 help edge formwork component 182 retain the pressure caused by liquid concrete in space 54 between panels 22 and structure 10. In other embodiments, edge formwork component 182 comprises a plurality of spaced apart intermediate braces 194 that extend between edge component 188 and beveled brace 192. In still other embodiments, intermediate brace 194 is not necessary.

Mounting flange 184 abuts against structure 10. Mounting flange 184 may provide optional apertures 186 as shown in the illustrated embodiment. Suitable fasteners (not shown) may extend through mounting flange 184 (e.g. through apertures 196) and into structure 10 to mount edge formwork component 182 to structure 10. In other embodiments, suitable adhesives, other connection techniques or the like may be used (in addition to or in the alternative to fasteners) to mount edge formwork component 182 to structure 10.

Once edge formwork component 182 is mounted in this manner, edge component 188 extends away from structure 10 toward overlap flange 190. Overlap flange 190 will then overlap an edge of panels 22 on an exterior side thereof. Formwork edge component 182 shown in FIG. 2I is a straight formwork edge component. It will be appreciated that formwork edge component 182 could be modified to provide a corresponding outside corner edge formwork component (e.g. having an outside corner shape similar to outside corner edge formwork component 82A, but having features similar to formwork edge component 182 of FIG. 2I). In this manner, a combination of straight edge formwork components 182 and corresponding outside corner edge formwork components could be used to provide apparatus 20 with formwork edge(s) as desired.

In the illustrated embodiment where structure 10 is generally vertically oriented and apparatus 20 is located above the lowermost surface of structure 10, apparatus 20 may be provided with edge formwork components 182 at its lower edge, where overlap flanges 190 overlap the lower edges of panels 22. In some embodiments, suitable fasteners (not shown), adhesives and/or other connection techniques (e.g. plastic welding) may be used to connect overlap flanges 190 to the edges of panels 22. While not expressly shown in the illustrated views, in some embodiments it may be desirable to provide apparatus 20 with edge formwork components at its opposing (e.g. upper) edge. Such opposing edge formwork components could be substantially similar to edge formwork component 182 (FIG. 2I) and the corresponding outside corner edge formwork components and could comprise overlap flanges which overlap the upper edges of panels 22. Such opposing edge formwork components could be mounted to structure 10 after concrete is introduced or before concrete is introduced (if concrete is pumped into apparatus 20 using one or more suitable concrete introduction ports (not shown)).

The embodiment of FIG. 2I includes an optional reinforcement bracket 195 that can be used to provide edge formwork component 182 with additional strength—e.g. to support a greater mass of liquid concrete in space 54. In the illustrated embodiment, reinforcement bracket 195 comprises a structure-engaging portion 196A at one end, a formwork-engaging portion 196B at the opposing end, and a central portion 196C extending therebetween. Suitable fastener(s), adhesive and/or other connection techniques may be used to couple structure-engaging portion 196A to structure 10 and suitable fasteners, adhesive and/or other connection techniques may be used to couple formwork-engaging portion to edge formwork component 182 (e.g. to edge component 188). Structure-engaging portion 196A and formwork-engaging portion 196B may be provided with apertures 197A, 197B through which suitable fasteners (not shown) may extend to couple reinforcement bracket 195 to structure 10 and to edge formwork component 182 respectively. Formwork engaging portions 196B may be connected to edge components 188 at locations that are relatively close to overlap flange 190 to provide correspondingly greater reinforcement strength (i.e. reinforcement to counter torque caused by the weight of concrete in space 54). In some embodiments, the space between formwork-engaging portions 196B and overlap flanges 190 is less than 20 mm. In some embodiments, this space is less than 10 mm. For clarity, only one reinforcement bracket 195 is shown in FIG. 2I. In general, however, any suitable number of reinforcement brackets 195 may be used to provide additional strength to edge formwork component 182, as required.

Figure 2J:
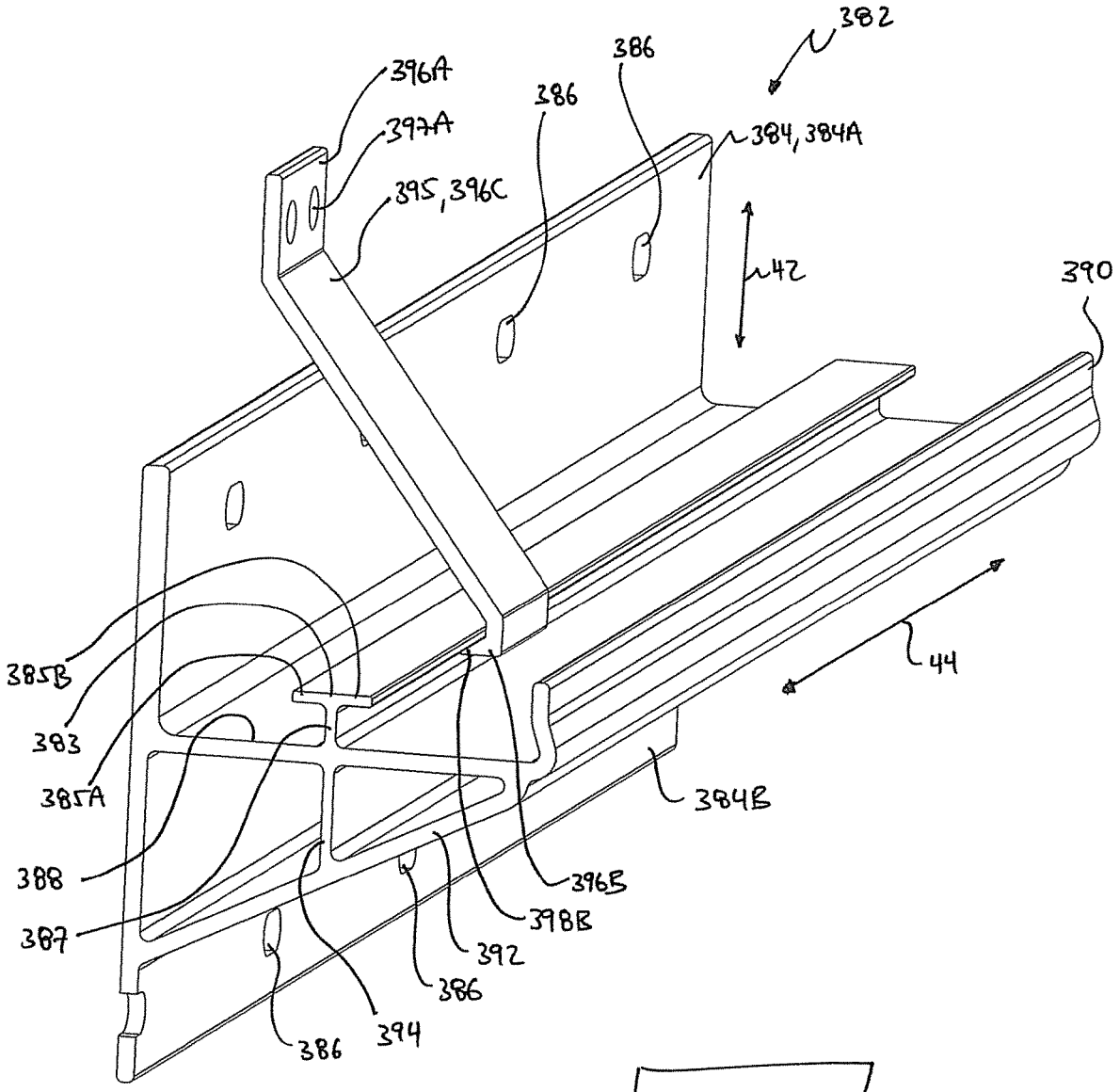
FIG. 2J is an isometric view of a straight edge formwork component and an optional reinforcement bracket according to another embodiment suitable for use with the FIG. 2A apparatus.

FIG. 2J is an isometric view of a different straight edge formwork component 382 according to yet another embodiment suitable for use with apparatus 20 of FIG. 2A. FIG. 2I also shows an optional reinforcement bracket 395 which may be used to provide extra holding strength to edge formwork component 382. Edge formwork component 382 is similar in many respects to edge formwork component 182 (FIG. 2I). Features of edge formwork component 382 which are similar to those of edge formwork component 182 are referred to using similar reference numerals, except that features of edge formwork component 382 are preceded by the numeral "3" whereas features of edge formwork component 182 are preceded by the numeral "1". Features of edge formwork component 382 that are similar to those of edge formwork component 182 include: mounting flange 384 which abuts against structure 10; edge component 388 which extends away from mounting flange 384 and from structure 10; overlap flange 390 which overlaps panels 22; beveled brace 392 which extends at a non-orthogonal angle between mounting flange 384 and edge component 388; and optional intermediate brace 394 that extends between edge component 388 and beveled brace 392.

Edge formwork component 382 differs from edge formwork component 182 in that edge formwork component 382 comprises an anchor component 383 which extends from edge component 388 and into space 54 between structure 10 and panels 22. Anchor component 383 extends along the width direction 44 and comprises transversely extending leaves 385A, 385B (collectively, leaves 385) at locations spaced apart (in longitudinal direction 42) from edge component 388 on stem 387. When space 54 is filled with liquid concrete (as described in more detail below), concrete flows between leaves 385 and edge component 388. When the liquid concrete cures, anchor component 383 is partially encased in concrete and serves to anchor edge formwork component 382 to the resultant repair structure.

It will be appreciated that anchor component 383 shown in FIG. 2J represents one non-limiting example of a shape that will provide this anchoring functionality. Anchor components 383 may be provided with other shapes. In currently preferred embodiments, the shape of anchor components 383 comprises a portion (e.g. leaves 385) at a location spaced apart from edge component 388 with transverse extension that is greater than a corresponding transverse extension at a location adjacent edge component 388 (e.g. stem 387). Non-limiting examples of other suitable cross-sectional shapes for anchor components 383A-383H (collectively, anchor components 383) are shown in FIGS. 17A-17H.

The embodiment of FIG. 2J includes an optional reinforcement bracket 395 that is similar in many respects to optional reinforcement bracket 195 and can be used to provide edge formwork component 382 with additional strength—e.g. to support a greater mass of liquid concrete in space 54. Reinforcement bracket 393 is similar to reinforcement bracket 195 and comprises a structure-engaging portion 396A at one end, a formwork-engaging portion 396B at the opposing end, and a central portion 396C extending therebetween. Suitable fastener(s), adhesive and/or other connection techniques may be used to couple structure-engaging portion 396A to structure 10. Structure-engaging portion 396A may be provided with apertures 397A through which suitable fasteners (not shown) may extend to couple reinforcement bracket 395 to structure 10. In the illustrated embodiment, formwork-engaging portion 396B comprises a hook 398B which engages edge formwork component 382. More specifically, hook 398B of the illustrated embodiment engages leaf 385B of anchor component 383. In other embodiments, hook 398B is not necessary and reinforcement bracket 395 may comprise a formwork-engaging portion 396B that is similar to formwork-engaging portion 196B of reinforcement bracket 195.

Edge formwork components 182, 382 of FIGS. 2I, 2J are straight edge formwork components. As discussed above, edge formwork components 182, 382 may be modified to provide corresponding outside corner edge formwork components (e.g. having an outside corner shape similar to outside corner edge formwork component 82A, but having features similar to formwork edge components 182, 382 of FIGS. 2I, 2J). In this manner, a combination of straight edge formwork components 182, 382 and corresponding outside corner edge formwork components could be used to provide apparatus 20 with formwork edge(s) as desired. In other embodiments, straight edge formwork components 182, 382 could be cut with complementary miter edges at the outside corners, obviating the need for a separate outside corner edge formwork component. The miter joints may be taped or sealed with a suitable material (e.g. silicone) to prevent leakage of liquid concrete. In such embodiments, one or more angled (e.g. L-shaped) braces (not shown) could be provide to extend across the miter joint and could be suitably coupled to edge formwork components 182, 382 on both sides of the miter joint to reinforce the joint. Such angled braces may be mounted to edge component 188, 388 beveled brace 192, 392 and/or intermediate brace 194, 394. Such angled braces may be located between edge component 188, 388 and beveled brace 192, 392 and/or on the opposing side of edge component 188, 388.

Figure 7A:
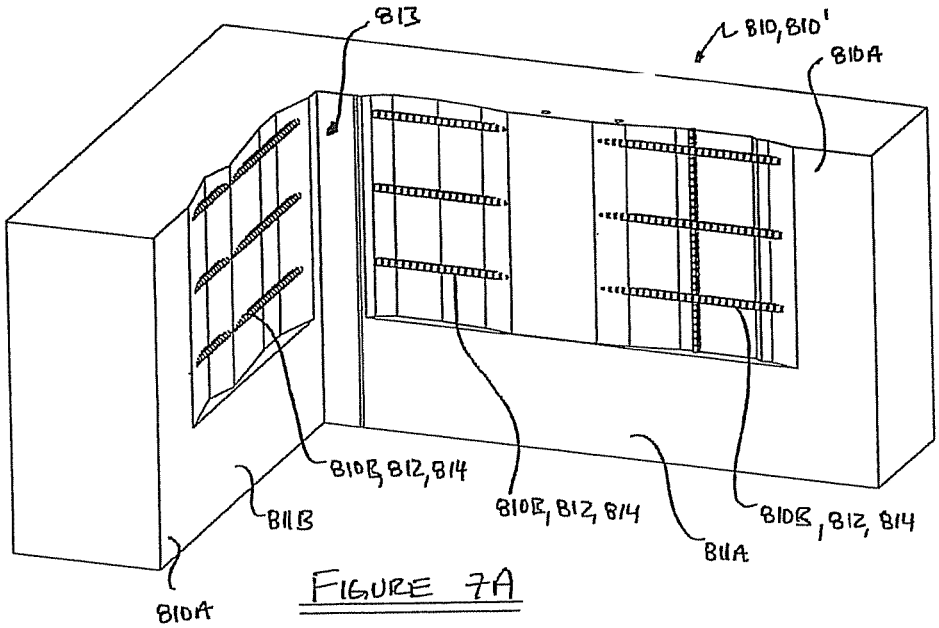
FIG. 7A shows an example of a portion of a structure which includes damaged surfaces and an inside corner.
Figure 7B:
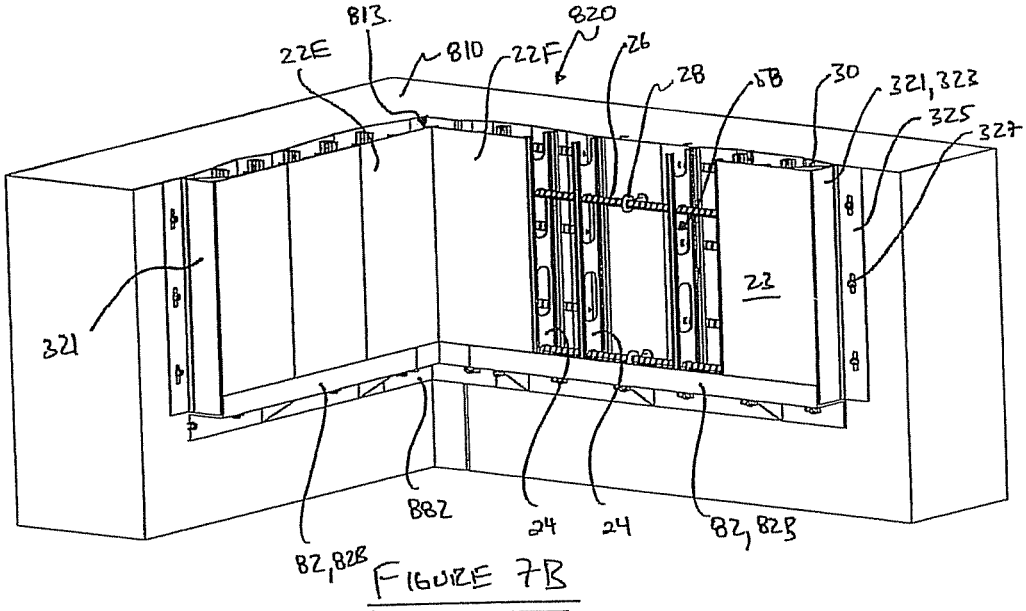
FIG. 7B is a partially cut-away isometric view of an apparatus for repairing the damaged surfaces of the FIG. 7A structure according to a particular embodiment.

In other embodiments described herein, edge formwork components are provided with other shapes, such as, by way of non-limiting example: curved edge formwork components 282 (e.g. FIG. 5B) and inside corner edge formwork components 882 (e.g. FIG. 7B). It will be appreciated that edge formwork components 182, 382 may be modified to provide corresponding curved edge formwork components, inside corner edge formwork components (e.g. having curved and/or insider corner shapes similar to curved edge formwork components 282 and/or inside corner edge formwork component 882, but having features similar to edge formwork components 182, 382 of FIGS. 2I, 2J) and/or suitably mitered straight edge formwork components 182, 382. In this manner, a combination of straight edge formwork components 182, 382, miter-cut straight edge formwork components 182, 382, curved edge formwork components, inside corner edge formwork components and/or outside corner edge formwork components could be used to provide formwork edge(s) for a variety of shapes as desired. Accordingly, in this disclosure, the description and drawings relating to features and use of edge formwork components 82, 282, 382 should be understood to include the possibility that correspondingly shaped versions of edge formwork components 182, 382 may be used together with and/or as alternatives for edge formwork components 82, 282, 382.

In generally, it is not necessary that structure 10 have the vertical orientation shown in the illustrated views. In some embodiments, structure 10 and/or apparatus 20 can be oriented in a direction such that longitudinal dimension 42 of apparatus 20 is non-vertical. In such embodiments, edge formwork components 82 may be provided at edges other than the lower edge and the upper edge of apparatus 20. Such other edges may be vertically oriented or may have other orientations depending on the orientation of structure 10 and longitudinal dimension 42 of apparatus 20. In such embodiments, it may be desirable to mount panels 22 to the uppermost portion of apparatus 20 after concrete is introduced into space 54. This is not necessary, however, as panels 22 may be mounted to the uppermost portion of apparatus 20 and then concrete may be subsequently be introduced to space 54 via suitably formed concrete introduction ports.

In the illustrated embodiment, apparatus 20 extends around structure 10. This may be the case, by way of non-limiting example, where structure 10 is an elongated column, post or beam. In the illustrated embodiment, non-damaged portion 10A of structure 10 extends beyond the lower edge of apparatus 20 defined by edge formwork components 82. In general, this is not always the case. In some applications, edge formwork components 82 may be placed at or near the edges of existing structures 10 and such edges may or may not be damaged. In some embodiments, it may be desirable to provide a repair structure which covers a transversely extending surface of, or completely covers, the existing structure 10. Apparatus 20 may be modified to provide such a repair structure by providing edge formworks which completely cover one or more transversely extending surface(s) of the existing structure. FIG. 2F is an isometric view of an additional or alternative edge formwork component 75 suitable for use with apparatus 20. Edge formwork component 75 may be used in addition to edge formwork 82 in embodiments where it is desired to cover one transversely extending surface of existing structure 10. Such a use of edge formwork component 75 is shown in FIG. 2F, where edge formwork component 75 is used to cover transversely extending surface 17 of structure 10. Edge formwork component 75 comprises a transversely extending surface 77X that is shaped to conform with transversely extending surface 17 of structure 10 and a flange 79 which extends away from surface 77X. In use, edge formwork component 75 may fit over transversely extending surface 17 and the edges of panels 22 such that the edges of panels 22 extend along and abut against flange 79. In some embodiments, suitable adhesive, fasteners and/or other connection techniques (e.g. plastic welding) may be used between flange 79 and the edges of panels 22 to ensure that they are coupled to one another. While FIG. 2F shows transversely extending surface 17 as an upper surface of structure 10, this is not necessary and structure 10 and transversely extending surface 17 may generally have any orientation.

FIG. 2G illustrates an alternative embodiment of an edge formwork assembly 81 suitable for completely covering a transversely extending surface (e.g. surface 17) of existing structure 10 and FIG. 2H illustrates one corner component 83 of the FIG. 2G edge formwork assembly 81. Edge formwork assembly 81 may be used in addition to edge formwork 82 in embodiments where it is desired to cover one transversely extending surface of existing structure 10.

Edge formwork assembly 81 comprises four corner components 83A, 83B, 83C, 83D (collectively, corner components 83) and a center component 89. As shown best in FIG. 2H, each corner component 83 comprise a corresponding cover surface 84 and a corresponding flange 85A, 85B, 85C, 85D (collectively, flanges 85) which includes a corresponding flange corner 87A, 87B, 87C, 87D (collectively, flange corners 87). In use, corner components 83 are fit over transversely extending surface 17 and the edges of panels 22 such that the edges of panels 22 extend along and abut against flanges 85. Cover surfaces 84 of corner components 83 may overlap with portions of adjacent corner components 83 as shown in FIG. 2G. Center component 89 may be placed over (or under) the central space between corner components 83 such that center component 89 overlaps a portion of each of corner component 83 (or such that each corner component 83 overlaps a portion of center component 89). In some embodiments, suitable adhesive, fasteners and other connection techniques (e.g. plastic welding) may be used between flanges 85 and the edges of panels 22 and between overlapping portions of corner components 83 and central component 89 to ensure that they are coupled to one another.

Edge formwork component 75 or edge formwork assembly 81 may also be used as an alternative to edge formwork component 82 in embodiments (not shown) where it is desired to cover opposing transversely extending surface(s) of structure 10. In such embodiments, edge formwork component 75 or edge formwork assembly 81 could be used to cover both transversely extending surface 17 and the opposing transversely surface (not specifically enumerated) of structure 10.

Figure 3B:
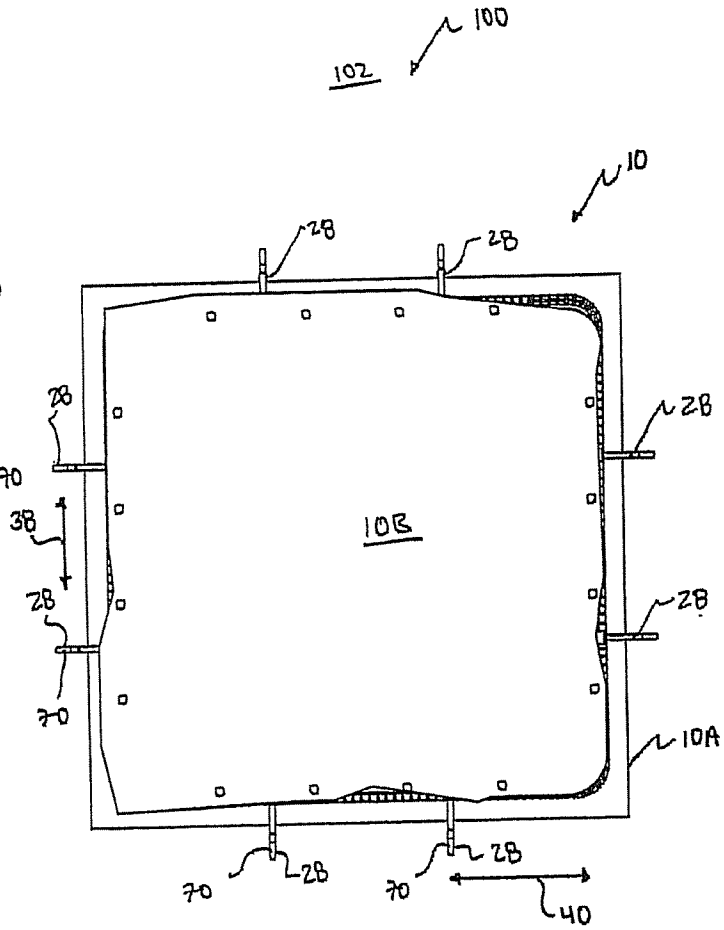
FIGS. 3A-3F show a number of the steps involved in a method for using the FIG. 2A apparatus to repair the FIG. 1 structure.
Figure 3A:
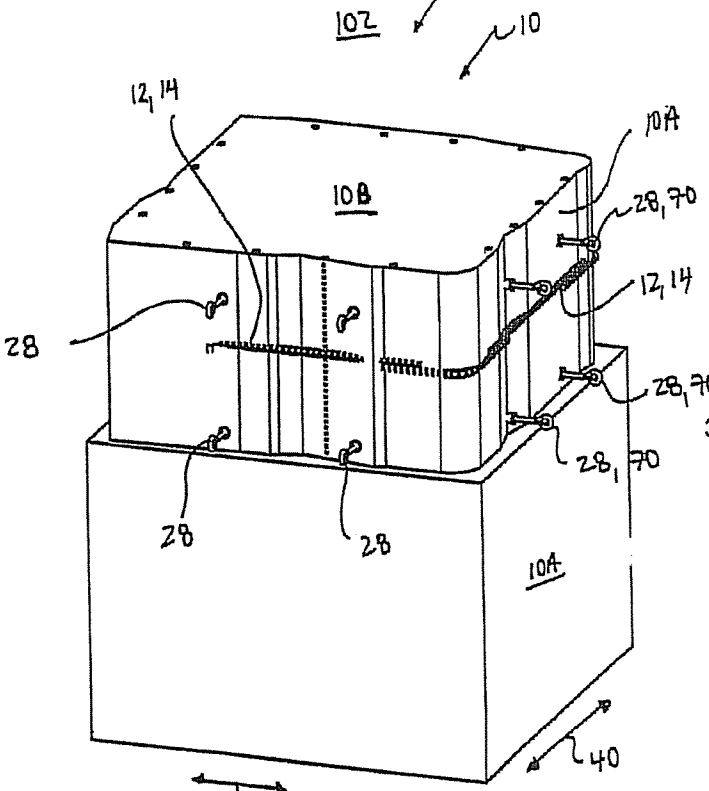

FIGS. 3A-3F show a number of the steps involved in a method 100 for using apparatus 20 to repair structure 10. FIGS. 3A and 3B show a first step 102 in method 100 which involves inserting rebar retainers 28 into, or otherwise coupling rebar retainers 28 to, structure 10. As discussed above, for the particular rebar retainers 28 shown in FIG. 2D, coupling rebar retainers 28 to structure 10 may involve, for each rebar retainer 28, drilling a hole into structure 10, inserting an anchor nut 62 into the bore and threading an eye bolt 64 into anchor nut 62. For other rebar retainers 28, this coupling procedure may be different. In the illustrated embodiment, apparatus 20 is used principally in the damaged region 10B of structure 10, in which case rebar retainers 28 may be coupled to structure 10 at suitable locations within damaged region 10B. In other embodiments, apparatus 20 may extend over a portion of (or all of) undamaged region 10A of structure 10, in which case rebar retainers 28 may also be coupled to undamaged region 10A. Rebar retainers 28 may be coupled to structure 10 such that their rebar-retaining features 70 (FIG. 2D) are aligned with one another. In the illustrated embodiment of FIGS. 3A and 3B, rebar retainers 28 are positioned such that their rebar-retaining features 70 are aligned with one another in generally horizontal directions 38,40, although alignment in other directions is also possible.

Figure 3D:
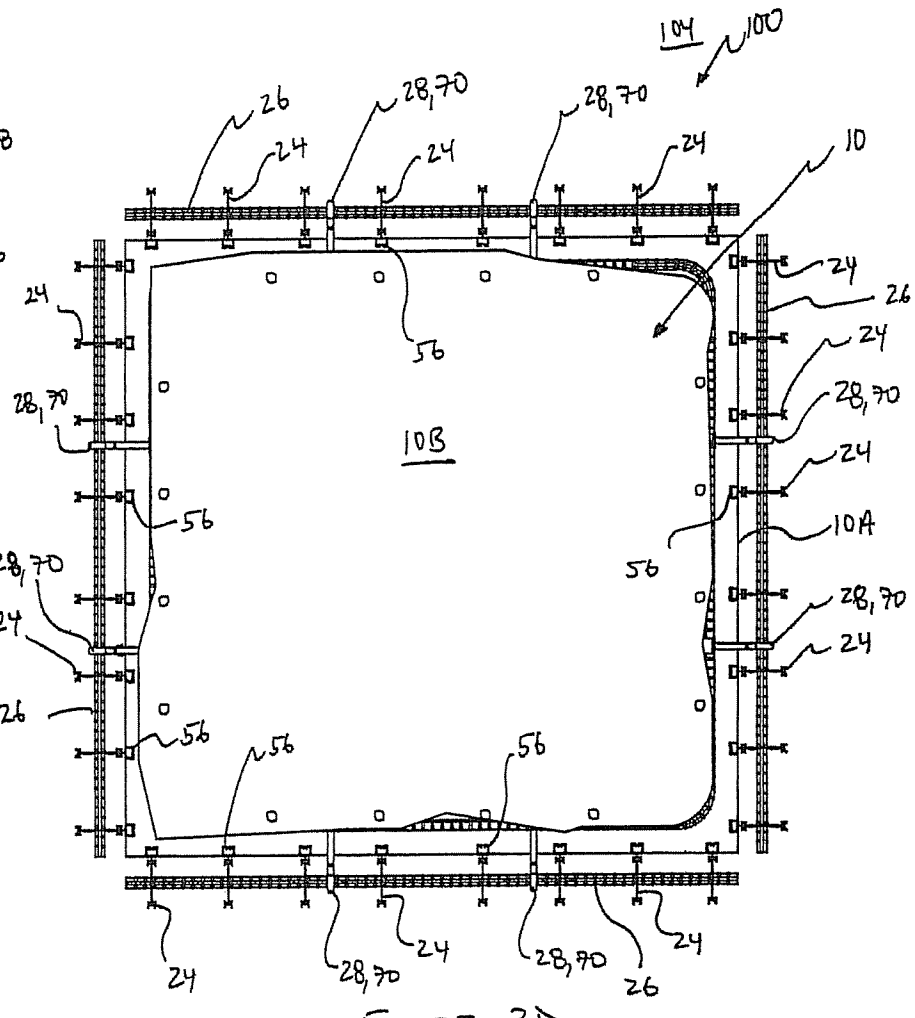
Figure 3C:
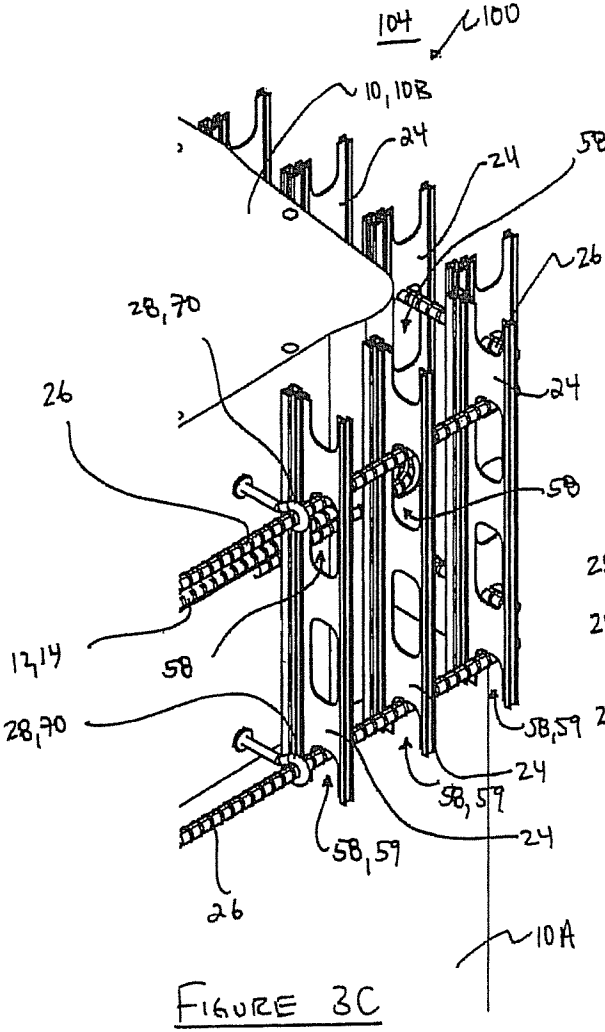

FIGS. 3C and 3D show a next step 104 in method 100 which involves: coupling rebar 26 to rebar-retaining features 70 of rebar retainers 28 and through apertures 58 in standoffs 24. In the illustrated embodiment, where rebar-retaining features 70 comprise apertures 72, coupling rebar 26 to rebar-retaining features 70 may comprise inserting rebar 26 through apertures 72 (see FIG. 2D). In other embodiments (e.g. rebar retainers 28' of FIG. 2E), where rebar-retaining features 70' comprise concavities 78, inserting rebar 26 into rebar-retaining features 70' may comprise inserting rebar 26 into concavities 78 in the same manner in which rebar 26 is inserted into apertures 72 or through spaces 77 between the ends of bights 74' and shafts 76'.

As shown best in FIG. 3C, step 104 also involves extending rebar 26 through apertures 58 in standoffs 24 to couple standoffs 24 to rebar 26. In the illustrated embodiments, apertures 58 are completely closed, so rebar 26 is extended through apertures 58 at the same time that rebar 26 is coupled to rebar-retaining features 70 of rebar retainers 28. In other embodiments, standoffs 24 may be cut, may be formed with, or may otherwise provide passages (not shown) leading to apertures 58. Such passages may permit rebar 26 to be coupled first to rebar-retainers 28 and then to subsequently couple standoffs 24 to rebar 26 via the passages that allow rebar 26 to extend through apertures 58. Such passages may be located at the lower ends of apertures 58 in standoffs 24, such that the force of gravity causes standoffs 24 to "hang" on rebar 26 and rebar 26 will be located at the tops of apertures 58 (i.e. away from the passages).

In the illustrated embodiment, lower apertures 58 of standoffs are cut to provide partial apertures/concavities 59. Step 104 may also involve extending rebar 26 through partial apertures/concavities 59. It will be appreciated that the number of standoffs coupled to rebar 26 and the locations of standoffs relative to rebar retainers 28 may be selected to provide appropriate coupling to panels 22.

The lengths of the shafts of rebar retainers 28, the dimensions of apertures 58 and/or the dimensions of standoffs 24 may be selected such that when standoffs 24 are coupled to rebar 26 as described above and shown in FIGS. 3C and 3D, heads 56 of standoffs 24 are either spaced apart from, or just contact, the outermost surfaces of structure 10 in the locations where apparatus 20 is being deployed. As shown best in FIG. 3D, in the illustrated example, where structure 20 is being deployed principally in damaged region 10B of structure 10, heads 56 of standoffs 24 may be spaced apart from the outermost extent of damaged region 10B of structure 10. In other embodiments, standoffs 24 may be dimensioned such that heads 56 contact damaged region 10B of structure 10 in some locations. Such dimensions may provide apparatus 20 with a generally flat outer surface (FIG. 2A). In embodiments where apparatus 20 overlaps undamaged region 10A of structure 10, standoffs 24 may be dimensioned such that heads 56 of standoffs 24 contact non-damaged region 10A at its outermost locations, but are spaced apart from structure 10 in damaged regions 10B. Again, such dimensions may provide apparatus 20 with a generally flat outer surface (FIG. 2A).

Figure 3E:
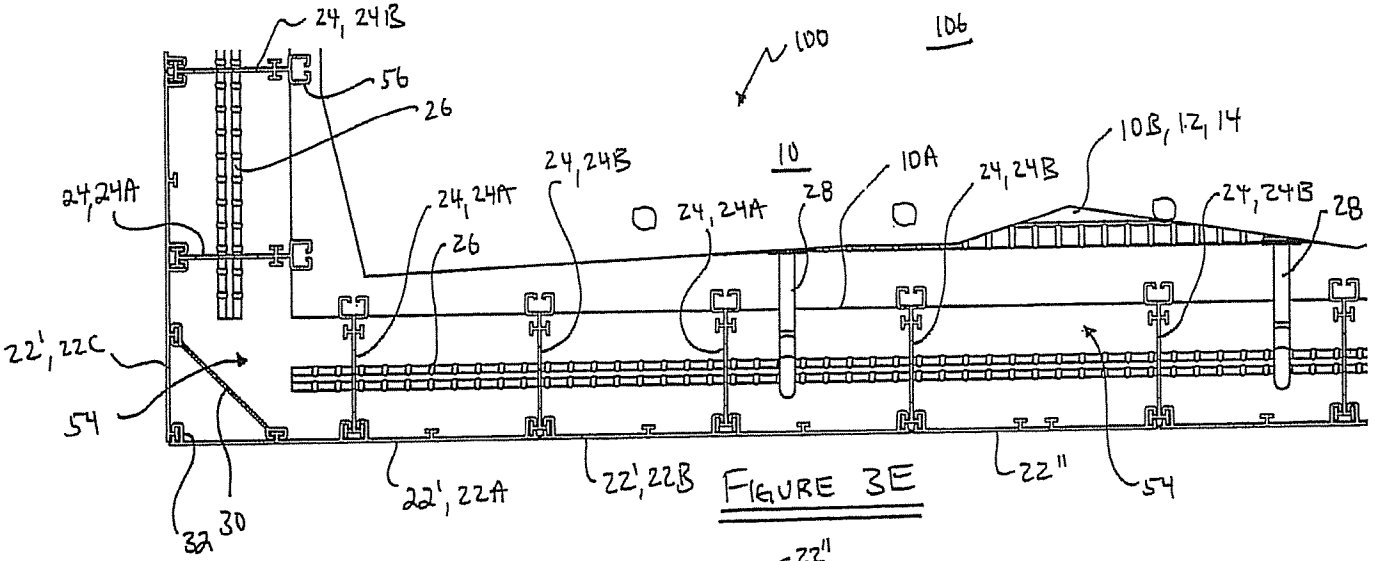

FIG. 3E show a next step 106 in method 100 which involves coupling panels 22 to standoffs 24 and optionally coupling braces 30 to panels 22. As discussed above, in the illustrated embodiment, panels 22 are coupled to standoffs 24 via slidable connector components wherein the coupling is made by effecting relative movement of panels 22 and standoffs 24 in the direction of longitudinal dimension 42 (FIG. 2A). More particularly, in the illustrated embodiment, connector components 32 of edge-adjacent panels 22 are connected to adjacent connector components 34 of edge-connecting standoffs 24B by sliding panels 22 in the direction of longitudinal dimension 42 such that male connector components 34 of edge-connecting standoffs 24B slide within female connector components 32 of panels 22 and connector components 46 of panels 22 are connected to connector components 34 of interior standoffs 24A by sliding panels 22 in the direction of longitudinal dimension 42 such that male connector components 34 of interior standoffs 24A slide within female connector components 46 of panels 22 (see also FIG. 2B).

Figure 3F:
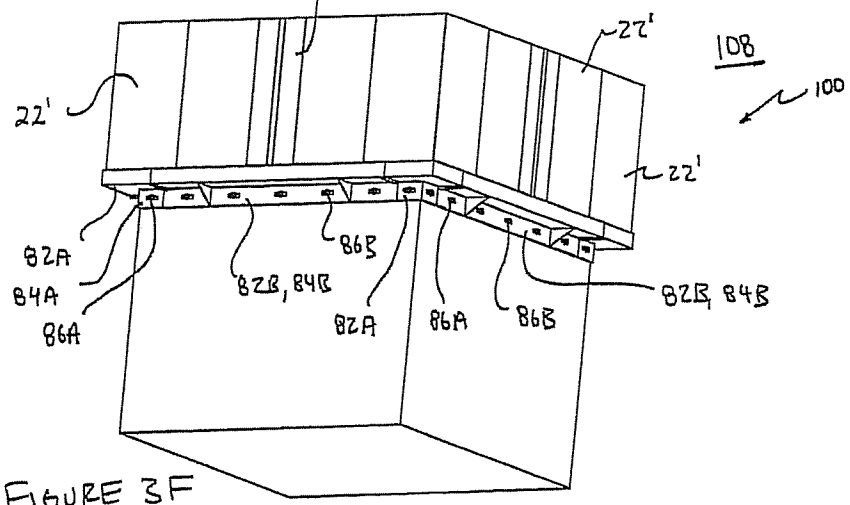

FIG. 3F shows a next step 108 in method 100 which involves mounting edge formwork components 82. As explained in more detail below, edge formwork components 82 are used to retain concrete in apparatus 20 and, more particularly, in space 54 (between the interior surface of panels 22 and structure 10). In the illustrated embodiment, edge formwork components 82 are mounted to structure 10 (e.g. to the undamaged portion 10A of structure 10) by abutting mounting flanges 84 against the surface of structure 10 and projecting fasteners 86 through mounting flanges 84 and into structure 10. In other embodiments, other techniques (e.g. suitable adhesives) may be used to mount edge formwork components 82 to structure 10. Straight edge formwork components 82B may be fabricated to have a desired size or may be cut to length prior to mounting. It is not necessary that edge formwork components be mounted to the existing structure. As explained above, in some embodiments, it may be desirable to completely cover the existing structure with a repair structure, in which case suitable edge formwork components and/or assemblies may be mounted to panels 22 and/or to other components of apparatus 20. As discussed above, in some embodiments, suitable fasteners (not shown) or adhesives may be used to connect overlap flanges 90 of edge formwork components 82 to the edges of panels 22. In some embodiments, it may be desirable to provide additional bracing and/or support to edge formwork components 82 using removable bracing and/or supports (not shown).

Edge formwork components 82 of the illustrated embodiment comprise stay-in-place formwork components which stay in place after structure 10 is repaired. In other embodiments, suitable edge-formworks may be fabricated from removable formwork components using known formwork techniques. Such edge formworks may be fabricated from wood, metal, steel or other suitable material. In some applications, where apparatus 20 extends down to the ground or to another suitable forming feature (e.g. a ledge of structure 10 or the like), then edge formwork components 82 may not be required.

After edge formwork components 82 are mounted (step 108, FIG. 3F), liquid concrete is introduced into space 54 between structure 10 and the interior surfaces of panels 22. The liquid concrete flows to fill space 54 (e.g. through apertures 58 in standoffs 24 and through apertures 60 in braces 30), encasing standoffs 24, rebar 26, rebar retainers 28 and optional braces 30. Edge formwork components 82 may be fabricated to be sufficiently strong (e.g. suitably thick and/or with suitably spaced brace components 91B) to support the pressure associated with concrete in space 54. As discussed above, external removable bracing and/or supports (not shown) may be provided to assist edge formwork components 82 to support the pressure of liquid concrete in space 54. Together, rebar retainers 28, rebar 26 and standoffs 24 provide strength to panels 22, preventing panels 22 from substantial movement away from structure 10 under the pressure of the liquid concrete. More particularly, rebar retainers 28 are anchored to structure 10, rebar 26 is anchored to rebar retainers 28, standoffs 24 are anchored (through apertures 58) to rebar 26 and standoffs 24 are anchored through connector components 32, 34, 46 to panels 22. The connection of these components to one another tends to prevent panels 22 from moving away from structure 10 under the pressure of liquid concrete. Also, as liquid concrete solidifies in space 54, rebar retainers 28, rebar 26 and standoffs 24 (which are encased in the solidified concrete) tend to bond the new concrete layer of the repair structure (i.e. concrete in space 54) to existing structure 10.

Apparatus 20 acts as a stay-in-place formwork which remains attached to structure 10 once the concrete in space 54 solidifies. Accordingly, rather than bare concrete being exposed to the environment, panels 22 coat the exterior of structure 10 such that panels 22 and their exterior surfaces 23 are exposed to the environment in the region of apparatus 20. In some embodiments, portions of structure 10 may also be coated by edge formwork components or assemblies (e.g. edge formwork components/assemblies 82, 75, 81). This may be advantageous for a number of reasons. By way of non-limiting example, surfaces 23 of panels 22 and edge formwork components/assemblies 82, 75, 81 may be more resistant to the environment or substances that contributed to the original degradation of structure 10 (e.g. salt water, salts or other chemicals used to de-ice roads or the like). Panels 22 and edge formwork components/assemblies 82, 75, 81 may be more hygienic or more attractive than bare concrete. Encasing portions of apparatus 20 (e.g. standoffs 24, rebar 26 and rebar retainers 28) in concrete within space 54 may provide additional structural integrity to existing structure 10.

Figure 4:
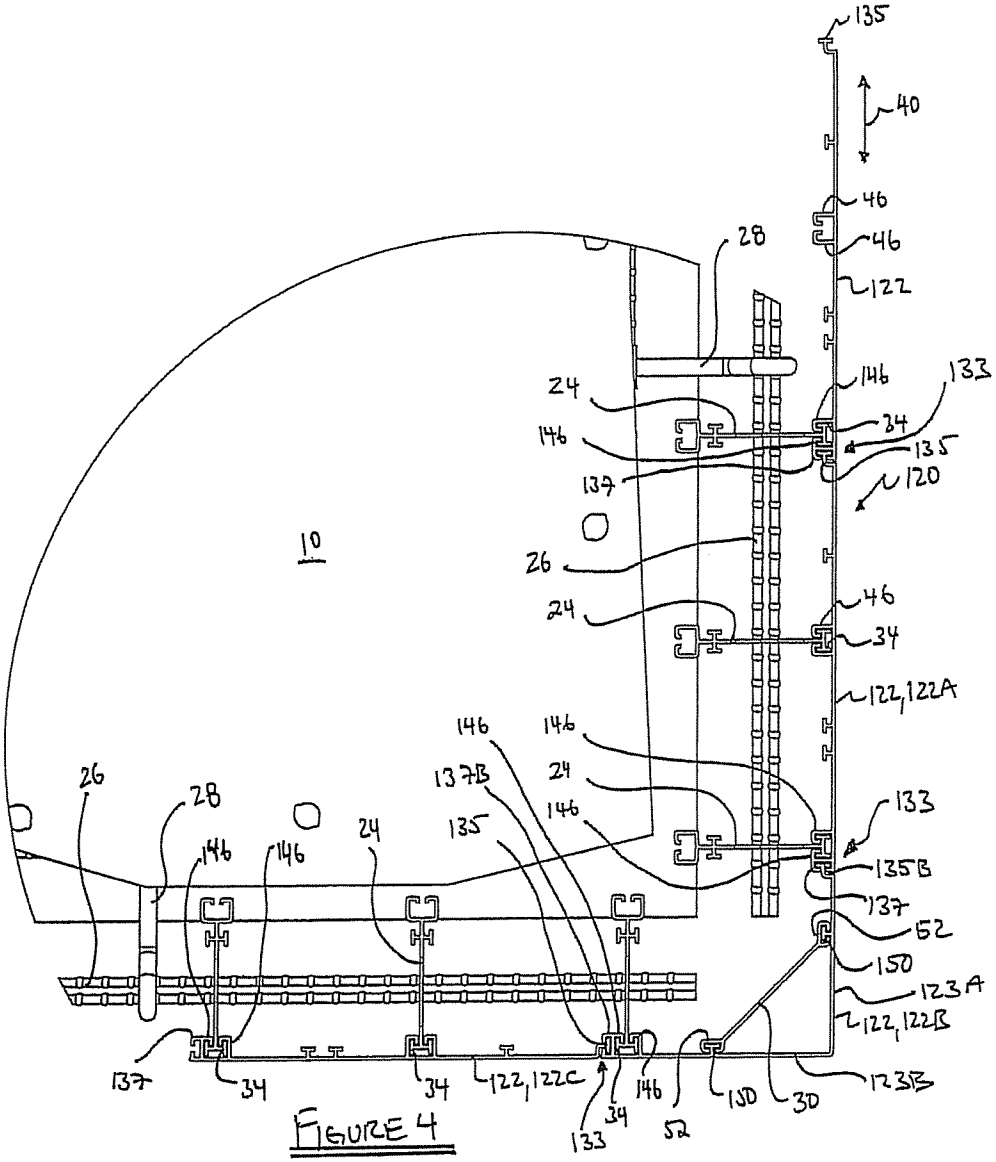
FIG. 4 is a partial top view of an apparatus for repairing the FIG. 1 structure according to another example embodiment.

FIG. 4 is a partial top view of an apparatus 120 for repairing structure 10 (FIG. 1) according to another example embodiment. In many respects, apparatus 120 is similar to apparatus 20 described above. Apparatus 120 comprises standoffs 24, rebar 26, rebar retainers 28, optional braces 30 and edge formwork components 82 (not shown) which are substantially similar to those of apparatus 20 described above. Apparatus 120 differs from apparatus 20 in that panels 122 of apparatus 120 connect directly to one another (rather than being connected to one another by edge-connecting standoffs 24B). More particularly, edge-adjacent panels 122 of apparatus 120 connect directly to one another at connections 133. In the illustrated embodiment, connections 133 are formed by male T-shaped components 135 on an edge of one edge-adjacent panel 122 which are slidably received in female C-shaped connector components 137 on an edge of another edge-adjacent panel 122.

In the illustrated embodiment, panels 122 (with the exception of corner panel 122B) have uniform width in transverse dimensions 38, 40. However, like panels 22, panels 122 may be fabricated to have modular widths (e.g. 1, 2, 4, 6, 8, 12 and 16 inches) in their transverse dimensions 38, 40 to fit various existing structures 10 and for use in various applications. Panels 122 of the illustrated embodiment comprise a pair of interior connector components 46 spaced apart from of their edges for connecting to standoffs 24. Interior connector components 46 of panels 122 may be substantially similar to interior connector components 46 of panels 22. Panels 122 of apparatus 120 also differ from panels 22 in that panels 122 comprise a pair of connector components 146 proximate to one of their edges for connecting to standoffs 24. Other than for their location, edge-proximate connector components 146 of the illustrated embodiment are similar to interior connector components 46 in that they comprise J-shaped female connector components which slidably receive the T-shaped male connector components 34 of standoffs 24. In other embodiments, panels 122 may comprise edge-proximate connector components 146 at both of their edges.

Apparatus 120 of the illustrated embodiment also includes outside corner panels 122B. Corner panel 122B comprises a pair of surfaces 123A, 123B which are oriented at an angle with respect to one another. In the illustrated embodiment, surfaces 123A, 123B are oriented at 90° with respect to one another to conform to the generally rectangular cross-section of structure 10. In other embodiments, however, corner panels similar to corner panel 122B could be provided with surfaces having other relative orientations to form outside (or inside) corners having different angles. In the illustrated embodiment, one edge of corner panel 122B comprises a connector component 135B for connecting to connector component 137 of adjacent panel 122A and the opposing edge of corner panel 122B comprises a connector component 137B for connecting to connector component 135 of adjacent panel 122C. Connector components 135B, 137B may be substantially similar to connector components 135, 137. In the illustrated embodiment, where apparatus 120 comprises optional braces 30, corner panel 122B may comprise connector components 150 for engaging corresponding connector components 52 of optional braces 30. Connector components 150 may be similar to connector components 50 of panels 22 described above.

In other respects, panels 122 may be similar to panels 22 described above and apparatus 120 is similar to apparatus 20 described above.

In operation, apparatus 120 may be used in a manner that is similar in many respects to use of apparatus 20 (method 100) described above. More particularly, coupling of rebar retainers 28 to structure 10 (FIGS. 3A and 3B), coupling rebar 26 to rebar retainers 28 (FIGS. 3C and 3D), coupling standoffs 24 to rebar 26 (FIGS. 3C and 3D) and coupling optional braces 30 to panels 122 (FIG. 3E) may be substantially similar to the above described techniques for apparatus 20. Coupling panels 122 to standoffs 24 may be similar to coupling panels 22 to standoffs 24, except that edge-proximate standoffs 24 are connected to edge-proximate connector components 146 of panels 122 and panels 122 are connected directly to one another rather than via edge-connecting standoffs 24B. The remainder of the steps involved in using apparatus 120 (e.g. mounting edge formwork components 82 (FIG. 3F) and introducing concrete into space 54) may be similar to those of method 100 for apparatus 20.

Figure 5A:
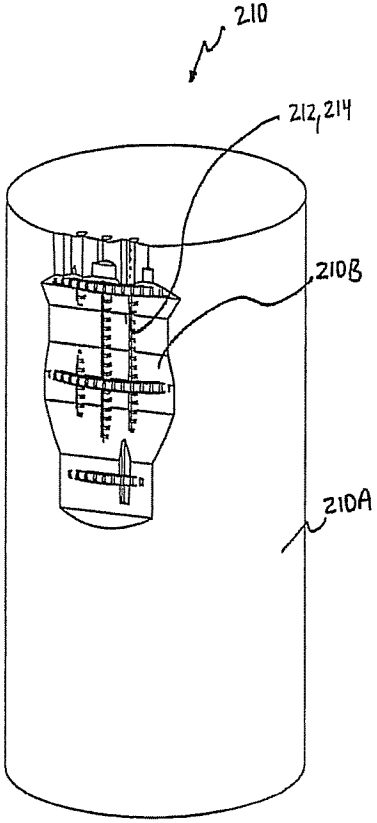
FIG. 5A shows an example of a curved concrete structure which has been damaged.
Figure 5B:
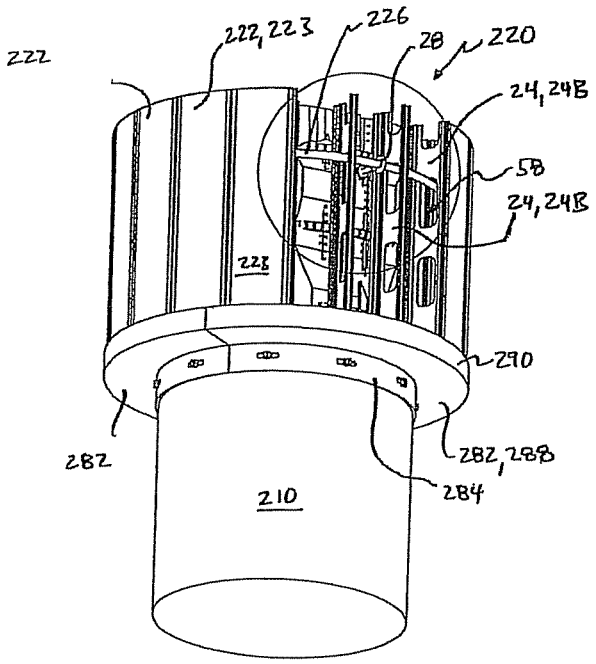
FIG. 5B is a partially cut-away isometric view of an apparatus for repairing the FIG. 5A structure according to a particular embodiment.
Figure 5C:
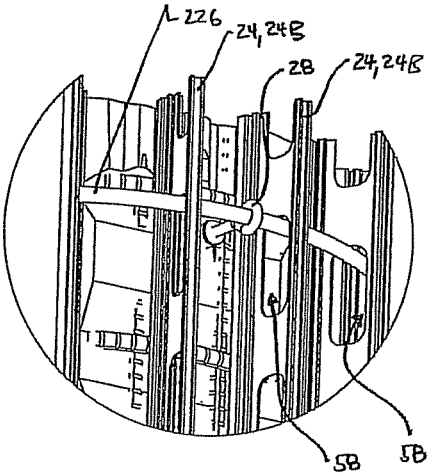
FIGS. 5C, 5D and 5E are respectively a partial isometric view, a top view and a partial top view of the FIG. 5B apparatus.
Figure 5D:
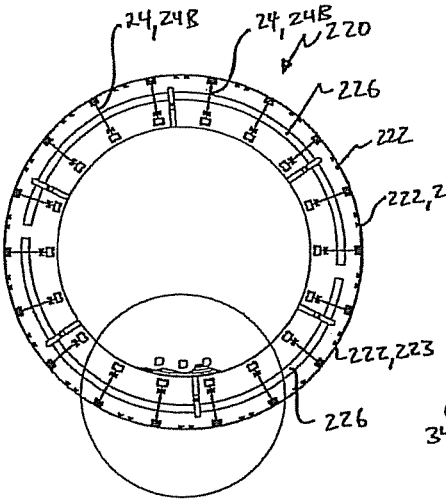
Figure 5E:
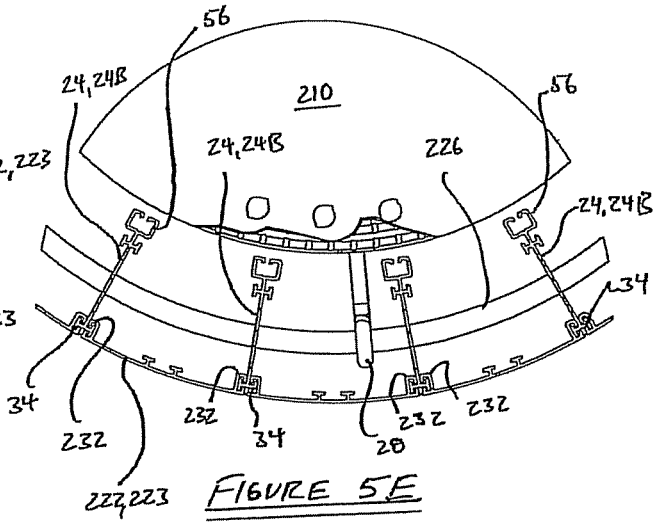

In the above-described embodiments, structure 10 is generally rectangular in cross-section. This is not necessary. FIG. 5A shows a curved structure 210 which includes a damaged section 210B and a undamaged section 210A. Damaged section 210B comprises portions 212 wherein reinforcement rebar 214 is exposed. In the illustrated embodiment, structure 210 is generally round in cross-section, but this is not necessary and structure 210 may have other cross-sectional shapes incorporating curved surface(s).

FIGS. 5B-5E show various views of an apparatus 220 for repairing structure 210 (FIG. 5A) according to a particular example embodiment. In many respects, apparatus 220 is similar to apparatus 20 described above. Apparatus 220 comprises standoffs 24 and rebar retainers 28 which are substantially similar to those of apparatus 20 described above. Apparatus 220 differs from apparatus 120 principally in that rebar 226, panels 222 and edge formwork components 282 of apparatus 220 are curved to accommodate curved structure 210 and to provide curved exterior surfaces 223 to apparatus 220.

Rebar 226 may be fabricated to be curved or may be bent to provide suitable curvature. Panels 222 may be fabricated to provide curved exterior surfaces 223 or panels 222 may be deformed to provide curved exterior surfaces 23 (e.g. during fabrication of apparatus 220, when connecting edge-adjacent panels 222 via edge-connecting standoffs 24B). In the illustrated embodiment, panels 222 also differ from panels 22 in that panels 222 do not include interior connector components 46 for connecting to interior standoffs 24A. Instead, all standoffs 24 in the illustrated embodiment of apparatus 220 are edge-connecting standoffs 24B which connect to connector components 32 at the edges of a pair of edge-adjacent panels 222. In other embodiments, panels 222 could comprise interior connector components for engaging interior standoffs in a manner similar to interior connector components 46 and interior standoffs 24A of apparatus 20. Edge formwork components 282 may be fabricated to provide curved mounting flanges 284, curved edge components 288 and curved overlap flanges 290. The curvature of edge formwork components 282 and their features may be fabricated to match the curvature of structure 10 and or the desired curvature of exterior surfaces of panels 223. Apparatus 220 of the illustrated embodiment comprises a pair of semi-annular edge formwork components 282, but in other embodiments, different numbers of edge formwork components 282 could be used depending on the size and/or curvature of structure 210. While not expressly shown in the illustrated embodiment, it may be desirable to provide curved edge formwork components 282 with optional brace components similar to brace components 91B of edge formwork components 82B which extend between mounting flanges 284 and edge components 288. Such brace components may help curved edge formwork components 282 retain the pressure caused by liquid concrete in space 54 between panels 222 and structure 210. While not expressly shown in the illustrated views, in some embodiments it may be desirable to provide apparatus 220 with edge formwork components at its opposing (e.g. upper) edge. Such opposing edge formwork components could be substantially similar to edge formwork components 282 and could be mounted to structure 210 after concrete is introduced or before concrete is introduced (if concrete is pumped into apparatus 220 using one or more suitable concrete introduction ports (not shown)). In other respects, rebar 226, panels 222 and edge formwork components 282 of apparatus 220 may be similar to rebar 26, panels 22 and edge formwork components 82 of apparatus 20 described above.

In operation, apparatus 220 is used in a manner similar to that of apparatus 20 described above. First, rebar retainers 28 are inserted into, or otherwise coupled to, structure 210. Then, rebar 226 may be coupled to rebar retaining features 70 of rebar retainers 28 and through apertures 58 in standoffs 24. Coupling panels 222 to edge-connecting standoffs 24B is substantially similar to that described above for panels 22 and edge-connecting standoffs 24B and, in the illustrated embodiment, involves slidable connections between connector components 34 on standoffs 24 and connector components 32 on panels 222. The remainder of the steps involved in using apparatus 220 (e.g. mounting edge formwork 282 and introducing concrete into space 54) may be similar to corresponding steps of method 100 for apparatus 20.

Figure 5F:
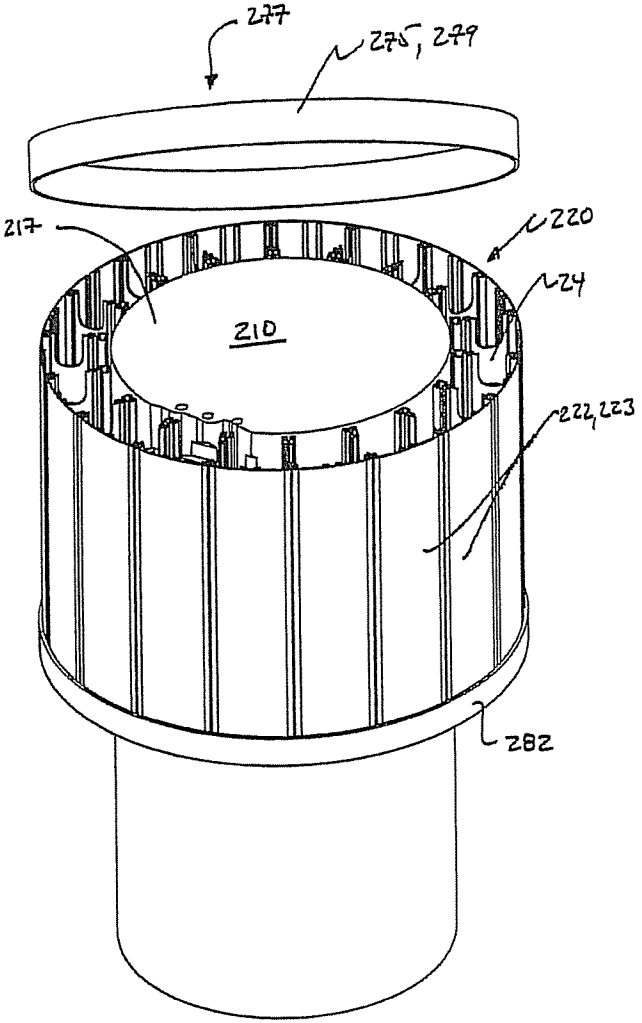
FIG. 5F is an isometric view of an additional or alternative edge formwork component suitable for use with the FIG. 5B apparatus.

In the illustrated embodiment, apparatus 220 extends around existing structure 210 and at least lower edge of apparatus 220 (i.e. edge formwork component 282) is spaced apart from the edges and transversely extending surfaces of existing structure 210. This may be the case, by way of non-limiting example, where structure 210 is an elongated column, post or beam. In general, this is not always the case. In some applications, edge formwork components 282 may be placed at or near the edges of existing structures 10. In some embodiments, it may be desirable to provide a repair structure which covers a transversely extending surface of, or completely covers, the existing structure 210. Apparatus 220 may be modified to provide such a repair structure by providing edge formworks which completely cover one or more transversely extending surface(s) of the existing structure. FIG. 5F is an isometric view of an additional or alternative edge formwork component 275 suitable for use with apparatus 220. Edge formwork component 275 may be used in addition to edge formwork 282 in embodiments where it is desired to cover one transversely extending surface of structure 210. Such a use of edge formwork component 275 is shown in FIG. 5F, where edge formwork component 275 is used to cover transversely extending surface 217 of structure 210. Edge formwork component 275 comprises a transversely extending surface 277 that is shaped to conform with transversely extending surface 217 and a flange 279 which extends away from surface 277. In use, edge formwork component 275 may fit over transversely extending surface 217 and the edges of panels 222 such that the edges of panels 222 extend along and abut against flange 279. In some embodiments, suitable adhesive and/or fasteners may be used between flange 279 and the edges of panels 222 to ensure that they are coupled to one another. While FIG. 5F shows transversely extending surface 217 as an upper surface of structure 210, this is not necessary and structure 210 and transversely extending surface 217 may generally have any orientation.

Edge formwork component 275 may also be used as an alternative to edge formwork component 282 in embodiments (not shown) where it is desired to cover opposing transversely extending surface(s) of structure 210. In such embodiments, edge formwork component 275 could be used to cover both transversely extending surface 217 and the opposing transversely extending surface (not specifically enumerated) of structure 210.

Figure 6A:
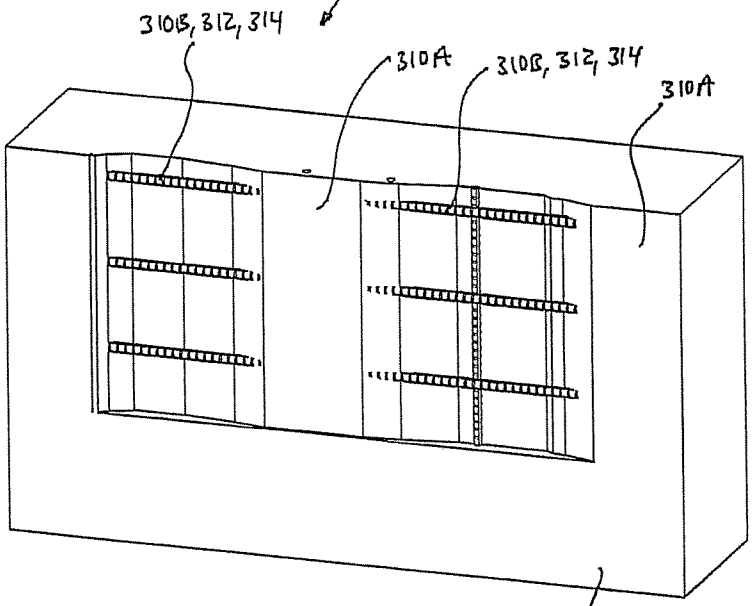
FIG. 6A shows an example of a portion of a structure which includes a damaged surface.

FIG. 6A shows a portion 310' of a structure 310 comprising a generally flat surface 311. Generally flat surface 311 of structure 310 includes several damaged sections 310B and undamaged sections 310A. Damaged sections 310B of structure 310 comprise portions 312 wherein reinforcement rebar 314 is exposed.

Figure 6B:
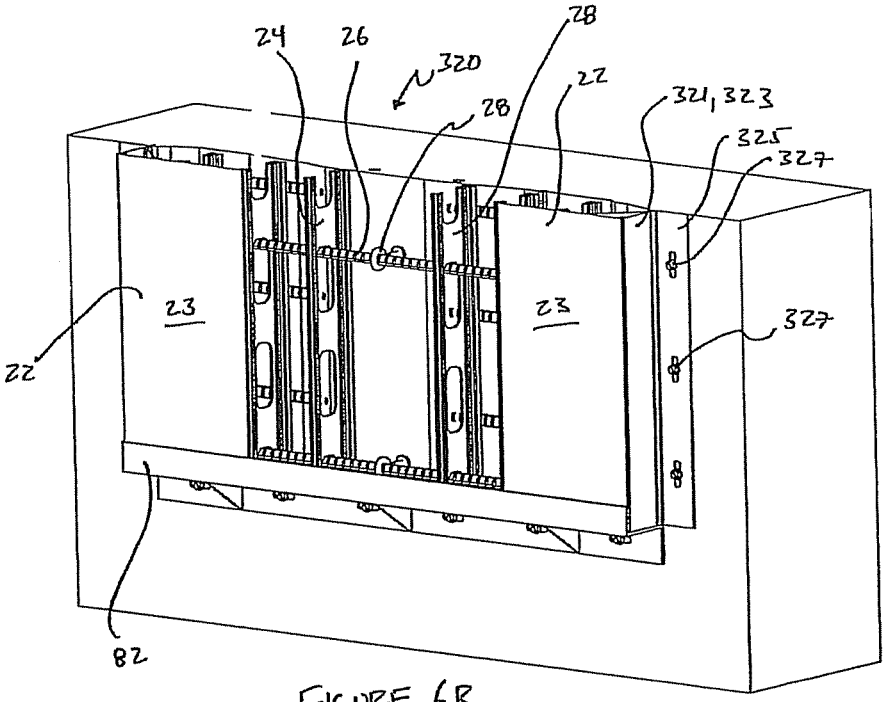
FIG. 6B is a partially cut-away isometric view of an apparatus for repairing the damaged surface of the FIG. 6A structure according to a particular embodiment.
Figure 6C:
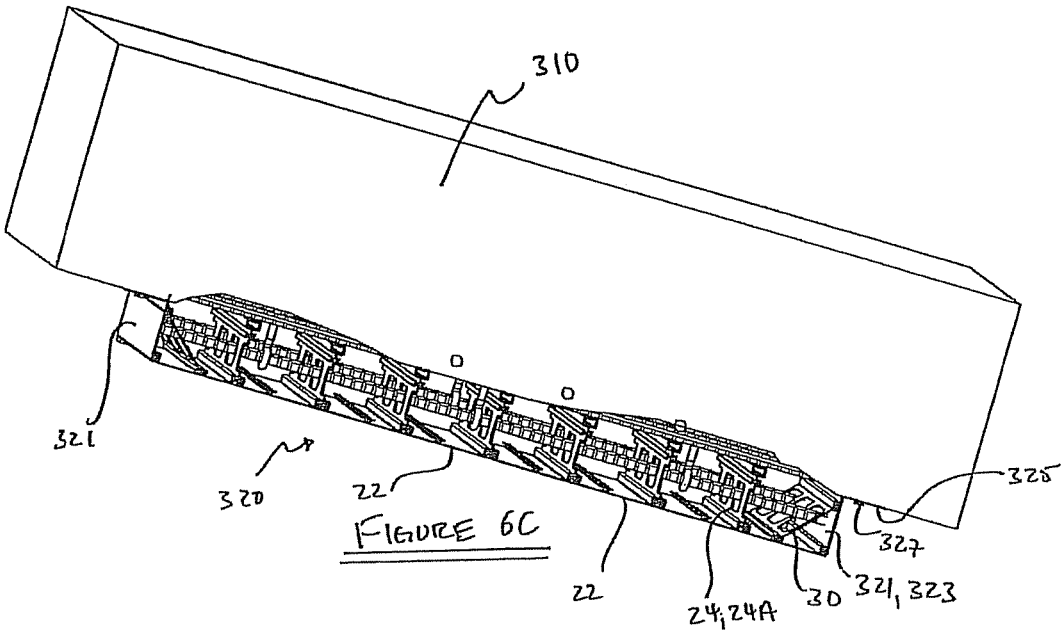
FIGS. 6C and 6D are respectively a different isometric view and a different partial isometric view of the FIG. 6B apparatus.
Figure 6D:
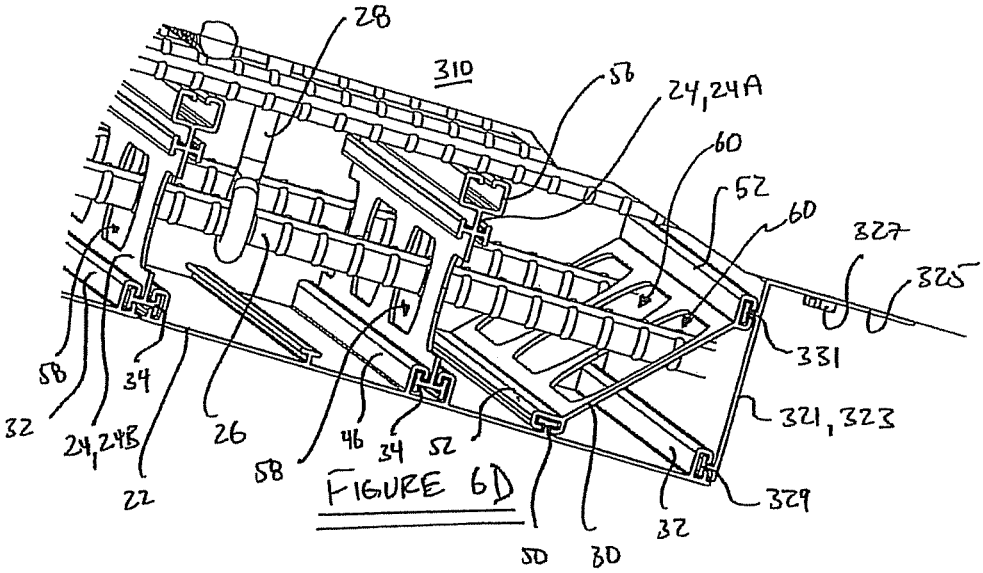

FIGS. 6B-6D show various views of an apparatus 320 for repairing particular surfaces of structures (e.g. surface 311 of portion 310' of structure 310) according to another example embodiment. In many respects, apparatus 320 is similar to apparatus 20 described above. Apparatus 320 comprises panels 22, standoffs 24, rebar 26, rebar retainers 28 and edge formwork components 82 which are substantially similar to those of apparatus 20 described above. While not expressly shown in the illustrated views, in some embodiments it may be desirable to provide apparatus 320 with edge formwork components similar to edge formwork components 82 at its opposing (e.g. upper) edge. Apparatus 320 differs from apparatus 20 in that apparatus 320 does not extend all of the way around structure 310. Consequently, apparatus 320 comprises transverse edge formwork components 321 to provide transverse stay-in-place edges to the formwork provided by apparatus 320. In the illustrated embodiment, apparatus 320 also comprises optional braces 30 which are substantially similar to braces 30 described above, but which are used to help couple panels 22 to transverse edge formwork components 321, as described in more detail below.

In the illustrated embodiment, transverse edge formwork components 321 comprise a mounting flange 325 which abuts against structure 310. Fasteners 327 penetrate mounting flange 325 and extend into structure 10, thereby mounting transverse edge formwork component 321 to structure 310. Fasteners 327 may comprise any suitable fasteners which may depend on the nature of existing structure 310. As is known in the art, some fasteners are better suited for, or specifically designed for, use with certain materials. In the illustrated embodiment, where structure 310 is a concrete structure, fasteners 327 may comprise suitable concrete fasteners (e.g. concrete screws or two part concrete fasteners). In some embodiments, mounting flange 325 may be provided with apertures (not specifically enumerated) through which fasteners 327 may extend. In other embodiments, fasteners 327 may be driven through mounting flanges 325 or mounting flanges 325 may be pre-drilled to accommodate fasteners 327. In some embodiments, it may be desirable to pre-drill into structure 310 prior to inserting fasteners 327. In still other embodiments, suitable adhesives, other connection techniques and/or the like may be used (in addition to or in the alternative to fasteners 327) to mount transverse edge formwork components 321 to structure 310.

Transverse edge formwork components 321 also comprise an edge portion 323 which connects to a panel 22 at a transverse edge of apparatus 320 to provide a formwork edge to apparatus 320. In the illustrated embodiment, edge portion 323 comprises a connector component 329 which is complementary to connector component 32 on the edge of panels 22 and an optional connector component 331 which is complementary to connector component 52 on optional brace 30. In the illustrated embodiment, these connector components 329, 331 are T-shaped male connector components which may slidably engage with corresponding female C-shaped connector components 32 on panel 22 and 52 on optional brace 30.

In operation, apparatus 320 is used in a manner similar to that of apparatus 20 described above. Rebar retainers 28 are inserted into, or otherwise coupled to, structure 310. Then, rebar 26 may be coupled to rebar retaining features 70 of rebar retainers 28 and through apertures 58 in standoffs 24. If desired, rebar 26 may be extended through apertures 60 in optional braces 30 at this stage. Panels 22 may then be coupled to standoffs 24 (and optionally to braces 30) in a manner similar to coupling panels 22 to standoffs 24 of apparatus 20. Transverse edge formwork components 321 may then be coupled to edge panels 22 by making slidable connections between connector components 32 and 329 and, optionally, to braces 30 by making slidable connections between connector components 52 and 331. Transverse edge formwork components 321 may then be mounted to structure 310 using suitable fasteners 327.

Transverse edge formwork components 321 represent one non-limiting embodiment of a component suitable for providing transverse edges to apparatus 320. In other embodiments, any of the other straight edge formwork components described herein (e.g. straight edge formwork components 82, 182, 382) could be used in apparatus 320 in the place of one or more of edge formwork components 321.

The remainder of the steps involved in using apparatus 320 (e.g. mounting edge formwork components 82 and introducing concrete into space 54) may be similar to those of method 100 for apparatus 20.

FIG. 7A shows a portion 810' of a structure 810 comprising a pair of generally flat surfaces 811A, 811B on either side of an inside corner 813. Generally flat surfaces 811A, 811B of structure 810 include several damaged sections 810B and undamaged sections 810A. Damaged sections 810B of structure 810 comprise portions 812 wherein reinforcement rebar 814 is exposed.

Figure 7C:
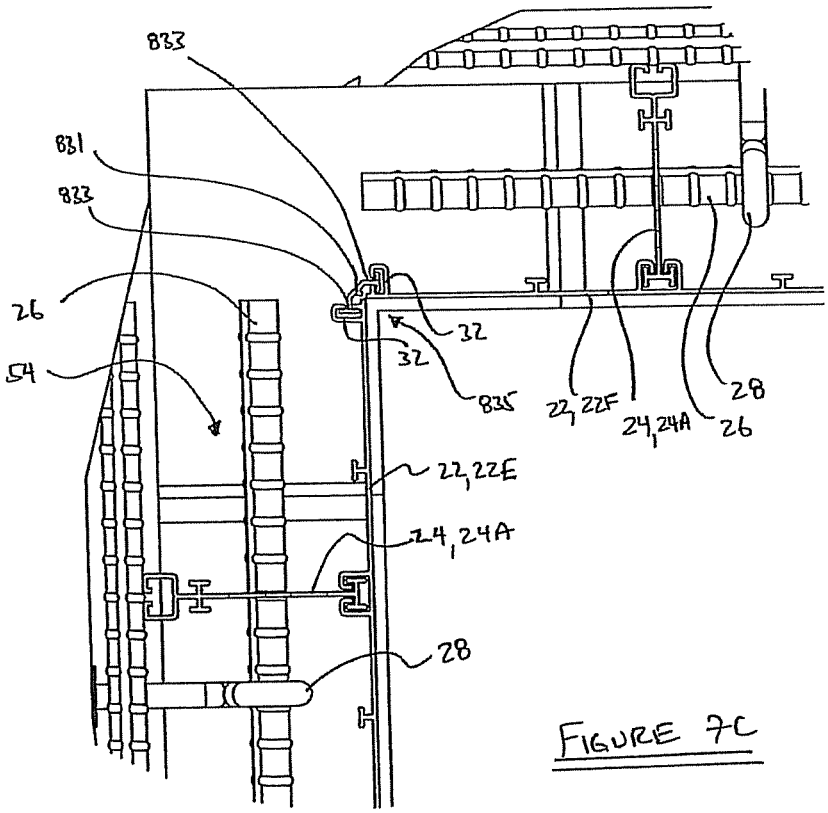
FIG. 7C is a partial top view of the inside corner portion of the FIG. 7B apparatus.

FIGS. 7B and 7C show various views of an apparatus 820 for repairing particular surfaces of structures incorporating an inside corner (e.g. surfaces 811A, 811B and inside corner 813 of structure 810) according to another example embodiment. In many respects, apparatus 820 is similar to apparatus 20 and 320 described above. Apparatus 820 comprises panels 22, standoffs 24, rebar 26, rebar retainers 28, straight edge formwork components 82B which are substantially similar to those of apparatus 20 and transverse edge formwork components 321 and optional braces 30 which are substantially similar to those of apparatus 320 described above. While not expressly shown in the illustrated views, in some embodiments it may be desirable to provide apparatus 820 with edge formwork components similar to edge formwork components 82 at its opposing (e.g. upper) edge. Apparatus 820 differs from apparatus 20, 320 in that apparatus 820 comprises an inside corner connector component 831 for connecting panels 22E and 22F to provide inside corner 835 of apparatus 820. Apparatus 820 also comprises an inside corner edge formwork component 882.

Inside corner connector component 831 may be elongated in the direction associated with the longitudinal dimension 42 of panels 22 and may have uniform cross-section in this dimension. In the illustrated embodiment, inside corner connector component 831 comprises a pair of connector components 833 which are complementary to connector components 32 on the edges of panels 22. In the illustrated embodiment, connector components 833 are T-shaped male connector components which may slidably engage corresponding C-shaped female connector components 32 on the edges of panels 22. As shown best in FIG. 7C, inside corner connector component 831 may be used to provide apparatus 820 with an insider corner 835 by engaging connector components 833 with corresponding connector components 32 of panels 22E and 22F (i.e. the panels adjacent inside corner 813 of structure 810). In the particular illustrated embodiment, inside corner connector component 831 is shaped to provide a 90° inside corner between panels 22E, 22F, but inside corner connector component 831 could be shaped to provide other inside corner angles.

Apparatus 820 also comprises an inside corner edge formwork component 882. Other than being shaped to conform with inside corner 813 of structure 810 and to help provide inside corner 835 of apparatus 820, inside corner edge formwork component 882 may be substantially similar to edge formwork components 82 described above. Inside corner edge formwork component 882 may comprise a mounting flange, an edge component and an overlap flange (not specifically enumerated) similar to mounting flange 84, edge component 88 and overlap flange 90 of edge formwork component 82. While not expressly shown in the illustrated views, in some embodiments it may be desirable to provide apparatus 820 with an inside corner edge formwork component similar to inside corner edge formwork component 882 at its opposing (e.g. upper) edge.

In operation, apparatus 820 is used in a manner similar to that of apparatus 20 and 320 described above. Rebar retainers 28 are inserted into, or otherwise coupled to, structure 810. Then, rebar 26 may be coupled to rebar retaining features 70 of rebar retainers 28 and through apertures 58 in standoffs 24. If desired, rebar 26 may be extended through apertures 60 in optional braces 30 at this stage. Panels 22 may then be coupled to standoffs 24 (and optionally to braces 30) in a manner similar to coupling panels 22 to standoffs 24 of apparatus 20. Transverse edge formwork components 321 may then be coupled to edge panels 22, optionally coupled to braces 30 and mounted to structure 810 in a manner similar to that described above for apparatus 320. Inside corner connector component 831 may then be coupled to inside corner panels 22E, 22F by engaging connector components 833 to corresponding connector components 32 of panels 22E, 22F. Straight edge formwork components 82 and inside edge formwork components 882 may then be mounted to structure 810 and optionally coupled to panels 22. The remainder of the steps involved in using apparatus 820 (e.g. introducing concrete into space 54) may be similar to those of method 100 for apparatus 20.

Apparatus 20, 120, 220, 320, 820 of FIGS. 2A-2C, 4, 5B-5E, 6B-6D, 7B-7C have now been described for repairing generally flat surfaces (e.g. surface 311 of structure 310), surfaces of structures comprising outside corners (e.g. the surfaces of structure 10), surfaces structures comprising inside corners (e.g. surfaces 811A, 811B of structure 810) and curved surfaces (e.g. the surface of structure 210). It will be appreciated that it is not possible to describe every possible structure, every possible surface or every possible combination of surfaces within the confines of this description. However, since many structures and surfaces comprise various combinations of the structures and surfaces described above, it will be appreciated by those skilled in the art that with various modifications, apparatus similar to the apparatus described herein may be used to repair structures having virtually any shape and/or surface profile.

In the embodiments described above, apparatus 20, 120, 220, 320, 820 of FIGS. 2A-2C, 4, 5B-5E, 6B-6D, 7B-7C comprise anchor standoff retainers which comprise rebar retainers which are mounted to existing structures and rebar which is coupled to the rebar retainers and to the standoffs. More particularly, in the illustrated embodiments described above, apparatus 20, 120, 220, 320, 820 of FIGS. 2A-2C, 4, 5B-5E, 6B-6D, 7B-7C are anchored to structures 10, 210, 310, 810 by: coupling rebar retainers 28 to structures 10, 210, 310, 810; retention of rebar 26, 226 in rebar retaining features 70 of rebar retainers 28; and extension of rebar 26 through apertures 58 in standoffs 24. This anchoring technique is not necessary. In some embodiments, rebar retainers 28 are not required and repair apparatus may be held in place (relative to structures) using removable bracing, strapping, walers or the like which may be located exterior to the panels of the apparatus and removed once the concrete solidifies in the space between the panels and the structures.

Figure 8A:
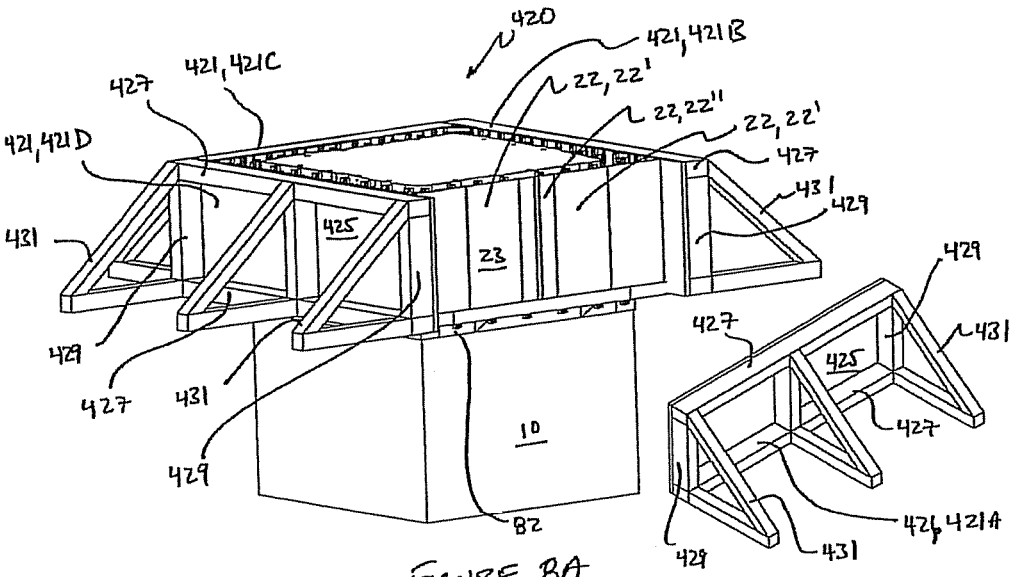
FIG. 8A is a partially exploded isometric view of an apparatus for repairing the FIG. 1 structure according to another particular embodiment.
Figure 8B:
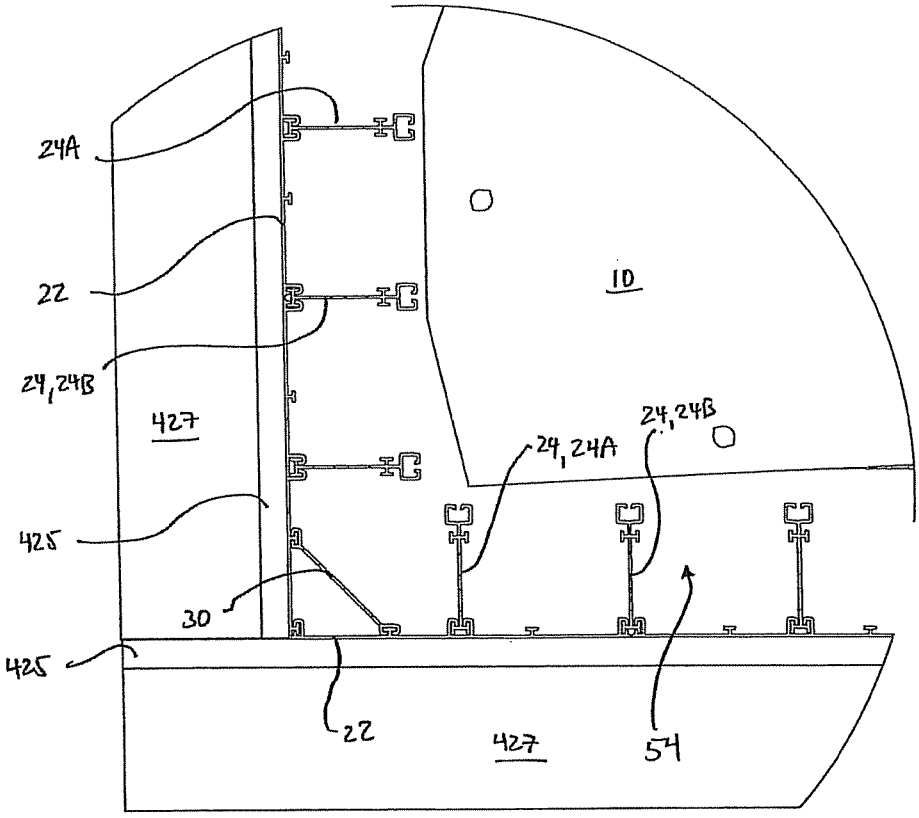
FIG. 8B is a partial top view of the FIG. 8A apparatus.

FIGS. 8A and 8B show various views of an apparatus 420 for repairing structure 10 (FIG. 1) according to another embodiment of the invention. In many respects, apparatus 420 is similar to apparatus 20 described above. Apparatus 420 comprises standoffs 24, panels 22, edge formwork components 82 and may comprise optional braces 30 which are substantially similar to those of apparatus 20 described above. Standoffs 24 of apparatus 420 may function as anchoring components to anchor apparatus 420 in the newly formed concrete of the repair structure. While not expressly shown in the illustrated views, in some embodiments it may be desirable to provide apparatus 420 with edge formwork components similar to edge formwork components 82 at its opposing (e.g. upper) edge. Apparatus 420 differs from apparatus 20 in that rather than using rebar retainers 28, apparatus 420 makes use of removable bracing components 421 on an exterior of panels 22 to retain panels 22 in place until concrete solidifies in space 54 between panels 22 and structure 10. In the illustrated embodiment, apparatus 420 is shown without rebar 26; however, in other embodiments, apparatus 420 may incorporate rebar 26 which may be similar to rebar 26 of apparatus 20.

In the illustrated embodiment, where structure 10 is generally rectangular in cross section, bracing components 421 may comprise four bracing components 421A, 421B, 421C, 421D—i.e. one bracing component 421 for each side of structure 10 and apparatus 420. Bracing components 421 may be fabricated from wood, metals, metal alloys or other suitable materials. In the illustrated embodiment, bracing components 421 are fabricated from wood, which may be advantageous because wood is relatively easy and inexpensive to build in various shapes and sizes. In the illustrated embodiment, bracing components 421 comprise sheets 425, horizontal reinforcement components 427, vertical reinforcement components 429 and strut braces 431. Sheets 425 extend generally along the exterior surfaces 23 provided by panels 22. In the illustrated embodiment, sheets 425 extend in vertical direction 36 and in one of the horizontal directions 38, 40. Horizontal reinforcement components 427 extend in one of the horizontal directions 38, 40 and vertical reinforcement components 429 extend in vertical direction 36. Strut braces 431 may extend and an angle from vertical reinforcement components 429. To the extent that strut braces 431 are spaced apart from the ground or from another suitable support surface, strut braces 431 may be supported by stilts, frames, scaffolding or the like (not shown). In particular embodiments, sheets 425 may comprise plywood sheets and reinforcement components 427, 429 and strut braces 431 may comprise two by four studs. It will be appreciated by those skilled in the art that there are a wide variety of bracing configurations and components known in the art of concrete forming that could be used to provide alternative configurations and/or designs for bracing components 421.

In use, apparatus 420 is assembled by coupling panels 22 into edge-adjacent relationship using edge-connecting standoffs 24B. Optional braces 30 may also be connected to panels 22 if desired. These couplings may be effected in a manner similar to that described above for apparatus 20. Edge formwork components 82 may be coupled to structure 10 and may optionally be coupled to panels 22 as described above. Rebar (not shown in the illustrated embodiment) may be introduced into apparatus 420 by extending rebar through apertures 58 in standoffs 24. Bracing components 421 may also connected to one another around the exterior of structure 10 and panels 22 (e.g. by nails, screws or other suitable fasteners). For example, in the illustrated embodiment, bracing component 421A may be connected at each of its ends to bracing components 421B, 421D, bracing component 421B may be connected at each of its ends to bracing components 421A, 421C, bracing component 421C may be connected at each of its ends to bracing components 421B, 421D and bracing component 421D may be connected at each of its ends to bracing components 421C, 421A.

In some embodiments, edge formwork components 82 may be mounted to structure 10 prior to assembly of panels 22 and standoffs 24. Panels 22 and standoffs 24 may then be supported by edge formwork components 82 as they are assembled. In other embodiments, panels 22 may be temporarily coupled to bracing components 421 and then apparatus 420 may be assembled around structure 10 as bracing components 421 are connected to one another. Such temporary coupling between panels 22 and bracing components 421 may be provided by a suitable adhesive or other suitable fasteners.

Liquid concrete is introduced to space 54 between structure 10 and panels 22. The liquid concrete flows to fill space 54 (e.g. through apertures 58 in standoffs 24 and through apertures 60 in optional braces 30), encasing standoffs 24, optional braces 30 and rebar (where present). Bracing components 421 provide strength to panels 22, preventing panels 22 from substantial movement away from structure 10 under the pressure of liquid concrete until the concrete solidifies in space 54. As concrete solidifies in space 54, it may bond to structure 10 to help support the solidified concrete and apparatus 420. Preferably, therefore, apparatus 420 is used to repair structures (e.g. structure 10) to which concrete bonds as it solidifies. Additionally or alternatively apparatus 420 may be used in circumstances where it is supported on the ground or on other suitable supports. Additionally or alternatively, mechanical supports (not shown) may be added or chemical or mechanical techniques may be used to help the new concrete bond to existing structure 10. Once the concrete solidifies in space 54, bracing components 421 are removed to expose surfaces 23 of panels 22.

Figure 8C:
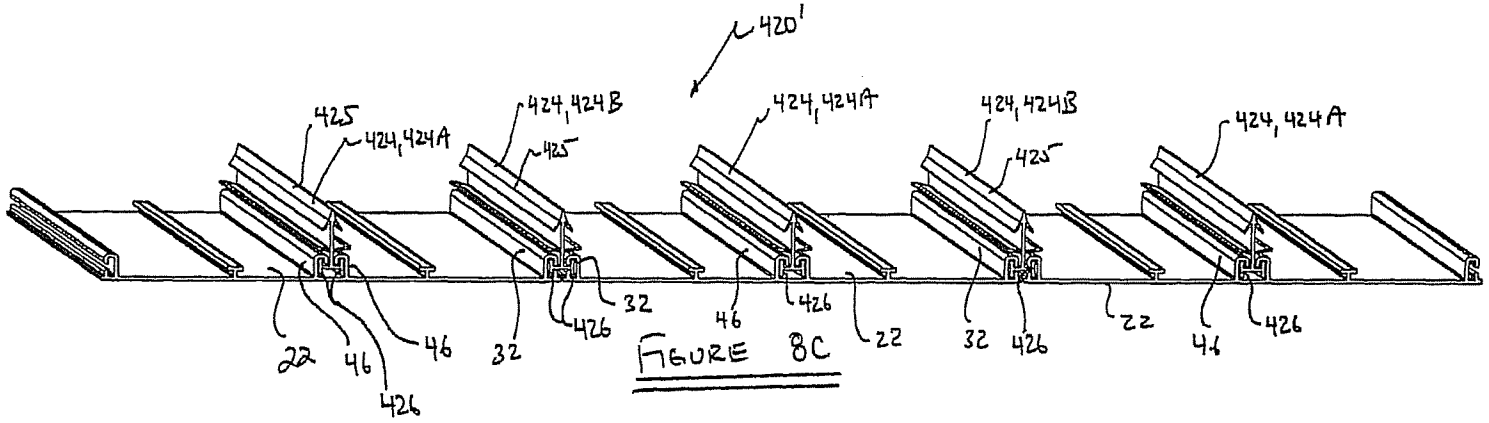
FIG. 8C shows a plurality of panels having anchoring components which may be used in addition to or as an alternative to standoffs in a modified embodiment of the FIG. 8A apparatus.

FIG. 8C shows a plurality of panels 22 having anchoring components 424 which may be used in addition to or as an alternative to standoffs 24 in a modified version 420' of apparatus 420. In the illustrated embodiment, anchoring components 424 comprise anchoring features 425, which are shaped in the form of barbed arrowheads. In other embodiments, anchoring features 425 may have other shapes. Anchoring components 424 and their anchoring features 425 may be similar to any of the anchoring components/anchoring features described in PCT application No. PCT/CA2008/000608, filed 2 Apr. 2008, and published as WO2008/119178, which is hereby incorporated herein by reference. Anchoring features 425 are encased in concrete when liquid concrete is introduced to space 54 between panels 22 and structure 10 and help to anchor panels 22 to the newly solidified concrete in space 54.

In the illustrated embodiment, anchoring components 424 comprise interior anchoring components 424 and edge-connecting anchoring components 424B. Anchoring components 424 comprise a pair of connector components 426. Connector components 426 may be complimentary to connector components 32 on the edges of panels 22, such that anchoring components 424 provide edge-connecting anchoring components 424B for connecting edge-adjacent panels 22 to one another. Connector components 426 may additionally or alternatively be complementary to interior connector components 46 of panels 22, such that anchoring components 424 provide interior anchoring components 424A. In the illustrated embodiment of FIG. 8C, connector components 426 of anchoring components 424 comprise T-shaped male connector components which are slidably engaged in corresponding female C- or J-shaped connector components 22, 46 of panels 22.

In operation, use of apparatus 420' may be similar to use of apparatus 420 described above, except that anchoring components 424 may be substituted for standoffs 24.

It will be appreciated by those skilled in the art that interior anchoring components 424A are optional. Interior anchoring components 424A may be connected to some panels 22 and not to others. In some embodiments, where panels 22 comprise multiple pairs of interior connector components 46, such panels 22 may be connected to multiple interior anchoring components 424A. However, the mere provision of interior connector components 46 does not mean that interior anchoring components 424A must be connected thereto. In other embodiments, anchoring components 424 may replace one or more standoffs 24 in apparatus 420 or standoffs 24 may replace one or more anchoring components 424 in apparatus 420'.

Figure 8D:
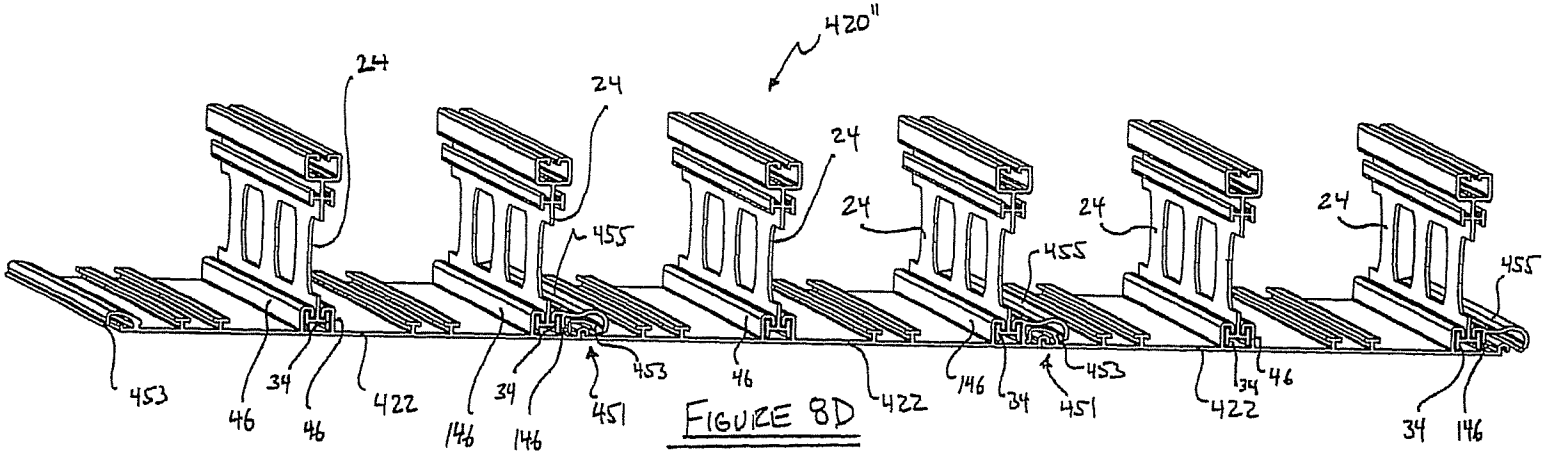
FIG. 8D shows a plurality of panels having panel to panel connections which may be used in another modified embodiment of the FIG. 8A apparatus.

FIG. 8D shows a plurality of panels 422 which may be used as an alternative to panels 22 and edge-connecting standoffs 24B to repair structure 10 according to another modified version 420" of apparatus 420. Modified apparatus 420" differs from apparatus 420 in that panels 422 provide direct panel-to-panel connections 451 between edge-adjacent panels 422 (i.e. rather than panels 22 being connected to one another via edge-connecting standoffs 24B). In this sense, panels 422 of apparatus 420" are similar to panels 122 of apparatus 120 (FIG. 4) which provide direct panel-to-panel connections 133 between edge-adjacent panels. However, panels 422 differ from panels 122 in that edge-adjacent panels 422 connect directly to one another at connections 451 between pivotally actuatable curved connector components 453, 455, whereas edge-adjacent panels 122 connect directly to one another at connections 133 between slidable connector components 135, 137.

Connections 451 and complementary curved connector components 453, 455 may be substantially similar to any of the connections and complementary curved connector components disclosed in PCT application No. PCT/CA2008/001951 filed 7 Nov. 2008, which is hereby incorporated herein by reference. As discussed in PCT/CA2008/001951, curved connector components 453, 455 may be connected to one another (and adjacent panels 422 may thereby be connected) by: forming a loose-fit connection between connector components 453, 455 (e.g. by sliding adjacent panels 422 relative to one another in longitudinal direction 42) such that connector components 453, 455 are partially engaged (e.g. connector component 453 projects partially into connector component 455); and pivoting panels 422 and/or connector components 453, 455 relative to one another (or otherwise exerting pivotal force between connector components 453, 455) to deform one or more portions of connector components 453, 455 such that, upon further relative pivotal motion between panels 422 and/or connector components 453, 455, resilient restorative forces tend to provide a "snap-together" fitting of connector components 453, 455 to one another.

In other respects, panels 422 of apparatus 420" may be similar to panels 122 of apparatus 120 described above. In particular and without limitation, panels 422 of the illustrated embodiment of apparatus 420" comprise a set of interior connector components 46 and a set of edge-proximate connector components 146 for engaging corresponding interior and edge-proximate standoffs 24. Like apparatus 420, standoffs 24 of apparatus 420" may perform the function of anchoring components to anchor apparatus 420 in the newly formed concrete of the repair structure. In some embodiments, interior and/or edge-proximate anchoring components 424 could be provided in addition to or in the alternative to interior and edge-proximate standoffs 24.

In operation, apparatus 420" may be used in a manner that is similar in many respects to the use of apparatus 420 described above. Assembly of apparatus 420" may differ from assembly of apparatus 420 in that edge-adjacent panels 422 are coupled directly to one another by faulting connections 451 between connector components 453, 455, as described above and in more detail in PCT/CA2008/001951. Standoffs 24 may be coupled to panels 422 after panels 422 are connected to one another. The remainder of the steps involved in using apparatus 420" may be similar to those associated with using apparatus 420.

Figure 9A:
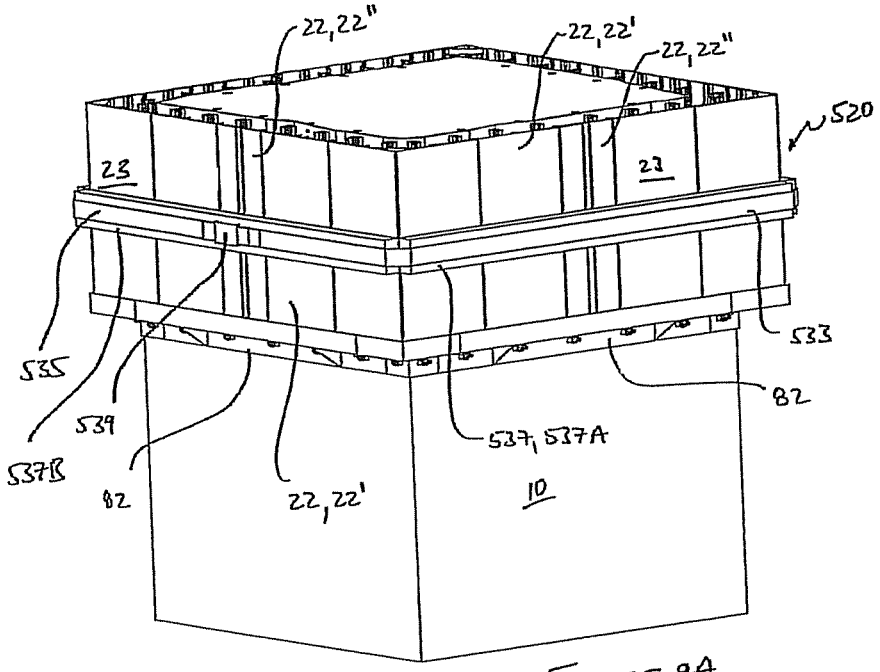
FIG. 9A is an isometric view of an apparatus for repairing the FIG. 1 structure according to another particular embodiment.
Figure 9B:
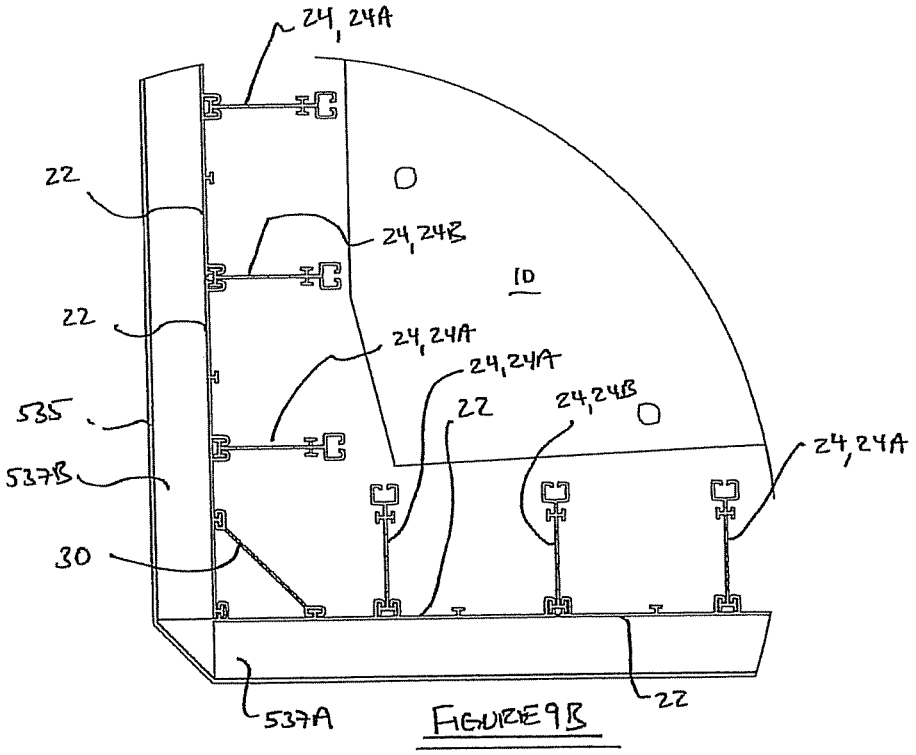
FIG. 9B is a partial top view of the FIG. 9A apparatus.

FIGS. 9A and 9B show various views of an apparatus 520 for repairing structure 10 according to another embodiment of the invention. In many respects, apparatus 520 is similar to apparatus 20 described above. Apparatus 520 comprises standoffs 24, panels 22 (e.g. panels 22', 22"), edge formwork components 82 and may comprise optional braces 30 which are substantially similar to those of apparatus 20. In apparatus 520, standoffs 24 may perform the role of anchoring components to anchor apparatus 520 in the newly formed concrete of the repair structure. While not expressly shown in the illustrated views, in some embodiments it may be desirable to provide apparatus 520 with edge formwork components similar to edge formwork components 82 at its opposing (e.g. upper) edge. Apparatus 520 differs from apparatus 20 in that rather than using rebar retainers 28, apparatus 520 makes use of a removable strapping system 533 on an exterior of panels 22 to retain panels 22 in place until concrete solidifies in the space 54 between panels 22 and structure 10. In the illustrated embodiment, apparatus 520 is shown without rebar 26; however, in other embodiments, apparatus 520 may incorporate rebar 26 which may be similar to rebar 26 of apparatus 20.

Strapping system 533 comprises one or more elongated straps 535 which extend around a perimeter of apparatus 520 on the exterior of panel surfaces 23. In the illustrated embodiment, apparatus 520 comprises a single strap 535, but other embodiments may comprise different numbers of straps 535 which may depend on the size of structure 10 and/or apparatus 520. Strap 535 may be fabricated from a number of suitable materials including, by way of non-limiting example, metal, plastics, suitable polymeric materials, composite materials or the like. Strap 535 includes a closure mechanism 539, which permits strap 535 to be tightened and locked at a desired tension. A variety of suitable closure mechanisms are known to those skilled in the art. In one particular embodiment, closure mechanism 539 comprises a ratcheting mechanism which permits strap 535 to be simultaneously tightened and locked. In the illustrated embodiment, strapping system 533 comprises optional protective components 537 disposed between strap 535 and the exterior surfaces 23 of panels 23. Protective components 537 may protect panels 22 from being scratched or otherwise damaged when tension is applied to strap 535 or when pressure is applied against strap 535 by concrete in space 54 between panels 22 and structure 10. In the illustrated embodiment, where structure 10 is generally rectangular in cross section, strapping system 533 may comprise four protective components 537A, 537B, 537C, 537D—i.e. one protective component 537 for each side of structure 10 and apparatus 520. Protective components 537 may be fabricated from wood, plastics, metals, metal alloys or other suitable materials. In the illustrated embodiment, protective components 537 comprise two by four wood studs which may be advantageous because wood is relatively easy and inexpensive to build in various shapes and sizes.

In use, apparatus 520 may be assembled by mounting edge formwork components 82 to structure 10, coupling panels 22 into edge-adjacent relationship using edge-connecting standoffs 24B and coupling interior standoffs 24A to panels 22. Optional braces 30 may also be connected to panels 22 if desired. These couplings may be provided in a manner similar to that described above for apparatus 20. Rebar 26 (not shown in the illustrated embodiment) may optionally be added by extending rebar 26 through apertures 58 in standoffs 24. Strapping system 533 may then be assembled around the exterior of structure 10 and panels 22. Once strapping system 533 is assembled, liquid concrete is introduced into space 54 between structure 10 and panels 22. The liquid concrete flows to fill space 54 (e.g. through apertures 58 in standoffs 24 and through apertures 60 in optional braces 30), encasing standoffs 24, optional braces 30 and rebar (where present). Strapping system 533 provides strength to panels 22, preventing panels 22 from substantial movement away from structure 10 under the pressure of liquid concrete until the concrete solidifies in space 54. As concrete solidifies in space 54, it may bond to structure 10 to help support the solidified concrete and apparatus 520.

Preferably, therefore, apparatus 520 is used to repair structures (e.g. structure 10) to which concrete bonds as it solidifies. Additionally or alternatively apparatus 520 may be used in circumstances where it is supported on the ground or on other suitable supports. Additionally or alternatively, mechanical supports (not shown) may be added or chemical or mechanical techniques may be used to help the new concrete bond to existing structure 10. Once the concrete solidifies in space 54, strapping system 533 is removed to expose surfaces 23 of panels 22.

Apparatus 420, 420', 420" and 520 (of FIGS. 8A-8B, 8C, 8D and 9A-9B) provide cladded repair structures which are externally braced during formation thereof (e.g. by bracing components 421 or strapping system 533). The particular illustrated embodiments of apparatus 420, 402', 420" and 520 are shown in use with structures having generally rectangular cross-sections similar to structure 10 of FIG. 1. This is not necessary. In general, the particular apparatus described herein may be provided with straight panels, curved (or flexible) panels, inside and/or outside corner panels, inside corner connector components, straight edge formwork components, curved edge formwork components, inside and/or outside corner edge formwork components, transverse edge formwork components and/or suitably modified or additional components, such that with suitable modifications the apparatus described herein may be used to repair structures similar to structure 10 (FIG. 1), 210 (FIG. 5A), structure 310 (FIG. 6A) and structure 810 (FIG. 7A). As discussed above, since many structures and surfaces comprise various combinations of these structures and surfaces, it will be appreciated by those skilled in the art that with various modifications, apparatus similar to the apparatus described herein may be used to repair structures having virtually any shape and/or surface profile.

Figure 10B:
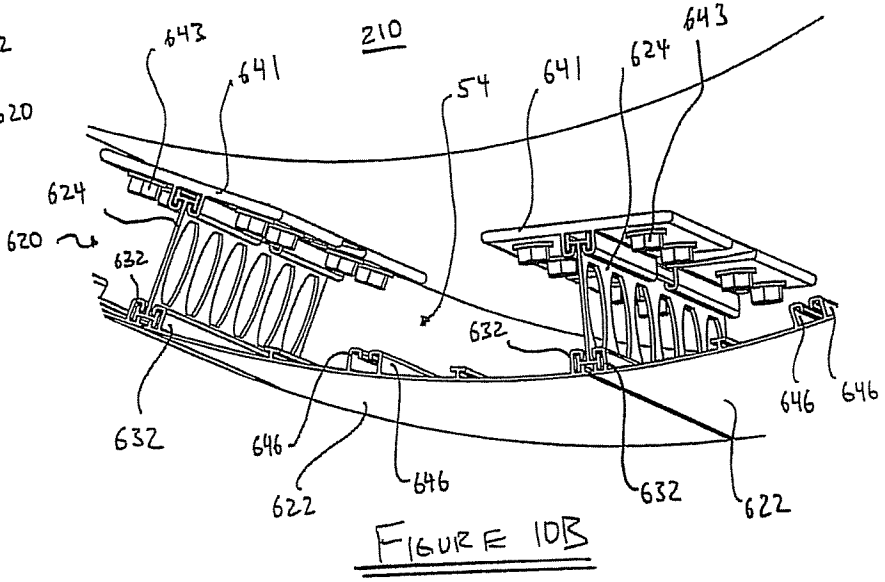
FIG. 10B is a partial isometric view of the FIG. 10A apparatus.
Figure 10A:
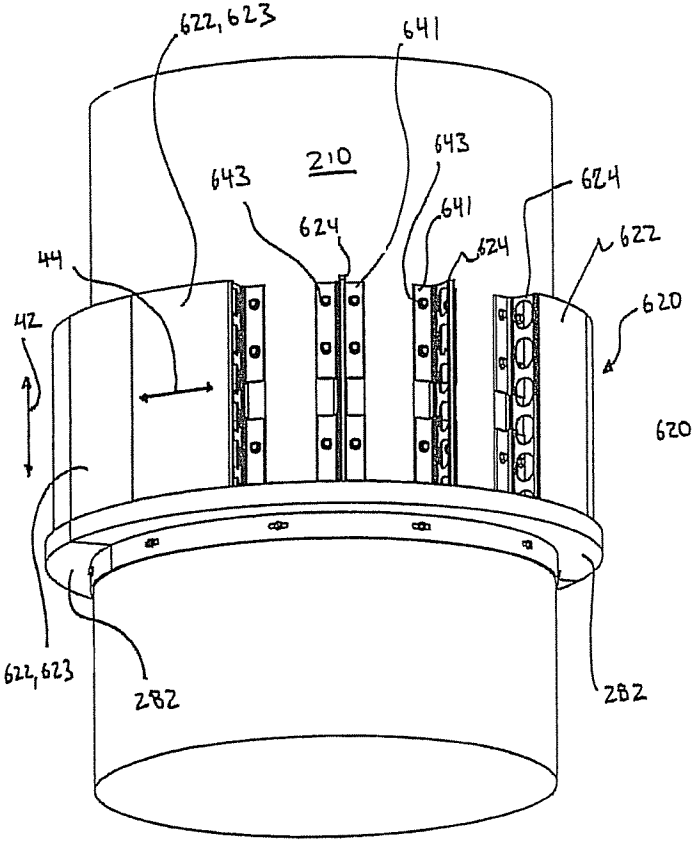
FIG. 10A is a partially cut-away isometric view of an apparatus for repairing the FIG. 5A structure according to a particular embodiment.
Figure 10C:
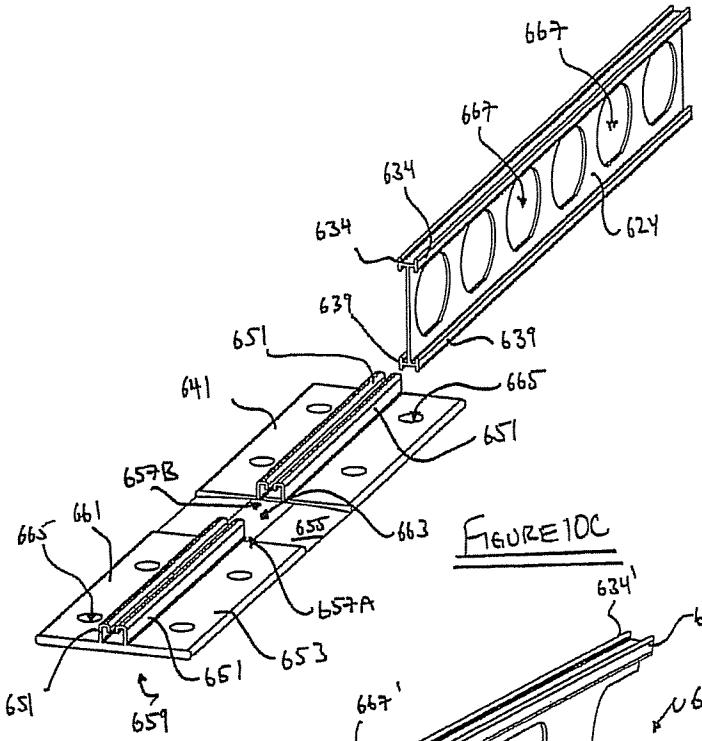
FIG. 10C is an exploded isometric view of a standoff retainer and a standoff of the FIG. 10A apparatus.

FIGS. 10A and 10B show various views of an apparatus 620 for repairing a curved structure 210 (FIG. 5A) according to another embodiment of the invention. For clarity, the damaged portions of structure 210 are not expressly shown in FIG. 10A or 10B. However, in FIG. 10A, structure 210 is expressly shown to extend in longitudinal directions 42 beyond the edges of apparatus 720. In some respects, apparatus 620 is similar to apparatus 220 described above. More particularly, apparatus 620 comprises curved edge formwork components 282 which are substantially similar to those of apparatus 220 described above. While not expressly shown in the illustrated views, in some embodiments it may be desirable to provide apparatus 620 with edge formwork components similar to edge formwork components 282 at its opposing (e.g. upper) edge. Apparatus 620 also comprises curved panels 622 which comprise curved surfaces 623. Curved panels 622 are similar to curved panels 222 of apparatus 220, except that panels 622 are wider than panels 222 and panels 622 incorporate interior connector components 646 which are similar to connector components 46 of panels 22 of apparatus 20. While interior connector components 646 are not used in the illustrated embodiment, interior connector components 646 could be used to connect to corresponding connector components of standoffs in a manner similar to the connection between panels 22 and interior standoffs 24A of apparatus 20. In other embodiments, panels 22 could incorporate different numbers of interior connector components 646. Apparatus 620 differs from apparatus 220 in that apparatus 620 comprises standoff retainers 641 and different standoffs 624 and which are used in the place of rebar retainers 28 and standoffs 24 of apparatus 220. FIG. 10C shows an isometric view of a standoff retainer 641 and a standoff 624 used in the illustrated embodiment of apparatus 620.

Standoffs 624 of apparatus 620 are similar to, and perform functions similar to those of, standoffs 24 of apparatus 220. In particular, standoffs 624 help to maintain space 54 between structure 210 and panels 622 and help to retain panels 622 from outward movement when space 54 is filled with liquid concrete. Like standoffs 24 of apparatus 220, standoffs 624 of apparatus 620 are all edge-connecting standoffs 624 which comprise connector components 634 for engaging corresponding connector components 632 on edge-adjacent panels 622 to connect panels 622 in edge-to-edge relationship. In the illustrated embodiment, connector components 634 of standoffs 624 are T-shaped male connector components which are slidably received in C-shaped female connector components 632 of edge-adjacent panels 622. In other embodiments, apparatus 620 could comprise interior standoffs (which could be similar to standoffs 624 or to standoffs 24) which connect to interior connector components 646 of panels 622.

Standoffs 624 comprise another pair of connector components 639 at their interior edges which engage a corresponding pair of connector components 651 on corresponding standoff retainers 641 to couple the interior edges of standoffs 624 to standoff retainers 641. In the illustrated embodiment, connector components 639 of standoffs 624 comprise male T-shaped connector components which are slidably received in female J-shaped connector components 651 of standoff retainers 641. As explained in more detail below, the coupling of standoffs 624 to panels 622 and to standoff retainers 641 tends to prevent panels 622 from moving outwardly (i.e. away from structure 210) under the weight of liquid concrete introduced into space 54 between panels 622 and structure 210.

Standoffs 624 also comprise one or more apertures 667. Apertures 667 permit liquid concrete to flow therethrough when liquid concrete is introduced into space 54. While not shown in the illustrated embodiment, apertures 667 may also support rebar 226 in a manner similar to apertures 58 of standoffs 24 of apparatus 220.

Standoff retainers 641 are coupled to structure 210 and to standoffs 624. As shown best in FIGS. 10B and 10C, standoff retainers 641 comprise a mounting flange 653. Mounting flange 653 comprises a generally flat interior surface 659 and an exterior surface 661 which provides connector components 651. In the illustrated embodiment, interior surface 659 of mounting flange 653 extends generally in longitudinal direction 42 and in the orthogonal (e.g. circumferential) direction 44 to abut (at least partially) against structure 210. Exterior surface 661 of mounting flange 653 may optionally comprise a notch 655 (i.e. region where flange 653 is relatively thin) extending across mounting flange 653. In the illustrated embodiment, connector components 651 are also discontinuous (i.e. not present) in the region of notch 655. As shown in FIG. 10C, connector components 651 may optionally extend over notch 655 by a relatively small amount at overhangs 657A, 657B. In other embodiments, connector components 651 may extend over notch 655. As explained in more detail below, notch 655 provides a small gap 663 between connector components 639 of standoff 624 and exterior surface 661 of standoff retainer 641 through which a strap may extend.

Standoff retainers 641 may optionally comprise one or more apertures 665 which penetrate flange 653. As shown in FIG. 10A, apertures 665 may receive fasteners 643 which may project through apertures 665 and into structure 210 to mount standoff retainers 641 to structure 210. In other embodiments, apertures 665 are not necessary as fasteners 643 may be driven through flange 653 and into structure 210 or flange 653 may be pre-drilled. The type of fasteners 643 may depend on the material from which structure 210 is fabricated. As is known in the art, some fasteners are better suited for, or specifically designed for, use with certain materials. By way of non-limiting example, suitable concrete fasteners 643 (e.g. concrete screws or two part concrete fasteners) may be used where structure 210 is fabricated from concrete or suitable metal/steel fasteners (e.g. metal screws) may be used where structure 210 is fabricated from metal, steel or the like. In some embodiments, it may be desirable to pre-drill into structure 210 prior to inserting fasteners 643. In still other embodiments, suitable adhesives or the like may be used (in addition to or in the alternative to fasteners 643) to mount standoff retainers 641 to structure 210.

In operation, standoff retainers 641 are mounted to structure 210 at desired locations. In the illustrated embodiment, where standoffs 624 are all edge-connecting standoffs, such locations may be generally centered at the planned locations of the edges of panels 622. In the illustrated embodiment, standoff retainers 641 are mounted to structure 210 using fasteners 643 which project through apertures 665. Edge formwork components 282 may also be mounted to structure 210 in a manner similar to that described above.

Next, standoffs 624 may be coupled to standoff retainers 641. As discussed above, in the illustrated embodiment, coupling standoffs 624 to standoff retainers 641 comprises engaging connector components 639 of standoffs 624 with connector components 651 of standoff retainers 641. While not shown in the illustrated embodiment, once standoffs 624 are connected to standoff retainers 641, rebar may be inserted through apertures 667 in standoffs 624, if extra strength is required. Next, panels 622 are coupled to standoffs 624 by engaging connector components 32 of panels 622 to connector components 634 of standoffs 624.

Liquid concrete may then be introduced into space 54 between structure 210 and the interior surfaces of panels 622. The liquid concrete flows to fill space 54 through apertures 667 in standoffs 624, encasing standoffs 624, rebar (if present) and standoff retainers 641. Together, standoff retainers 641 and standoffs 624 provide strength to panels 622, preventing panels 622 from substantial movement away from structure 210 under the pressure of liquid concrete. More particularly, standoff retainers 641 are anchored to structure 210 (e.g. by fasteners 643 and/or suitable adhesive), standoffs 624 are anchored to standoff retainers 641 through connector components 639, 651 and standoffs 624 are anchored to panels 622 through connector components 32, 634. The connection of these components to one another tends to prevent panels 622 from moving away from structure 210 under the pressure of liquid concrete. Also, as the liquid concrete in space 54 solidifies, standoff retainers 641 and standoffs 624 (which are encased in the solidified concrete) tend to bond the new concrete layer (i.e. concrete in space 54) to previously existing structure 210.

Figure 10D:
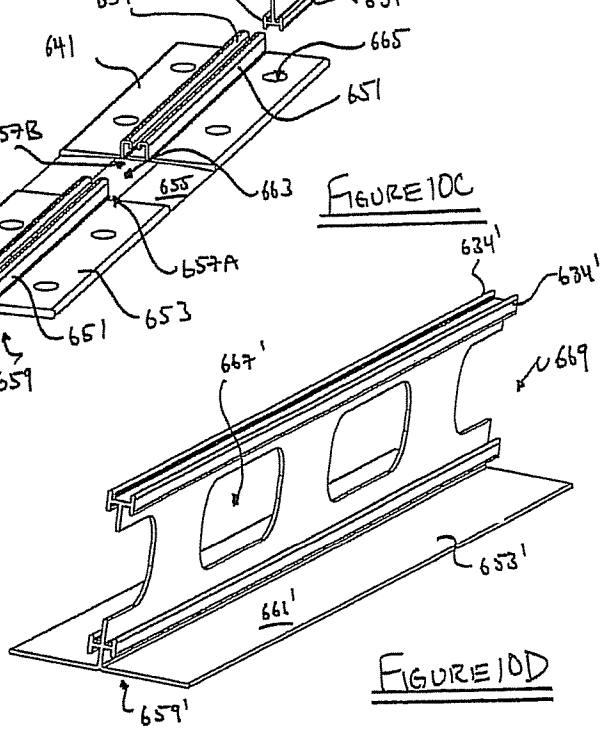
FIG. 10D is an isometric view of a modified standoff suitable for use with a modified version of the FIG. 10A apparatus.

In the illustrated embodiment of FIGS. 10A-10C, standoffs 624 and standoff retainers 641 are separate components which are coupled to one another by engaging connector components 639 of standoffs 624 to connector components 651 of standoff retainers 641. FIG. 10D shows a modified standoff 669 which is suitable for use in addition to or in the alternative to the combination of standoffs 624 and standoff retainers 641 in a modified version (not specifically enumerated) of apparatus 620. Modified standoffs 669 could also be used in conjunction with any of the apparatus described herein which make use of standoffs and standoff retainers similar to standoffs 624 and standoff retainers 641.

Modified standoff 669 combines some of the features of standoff 624 and some of the features of standoff retainer 641 into a single integral component. More particularly, standoff 669 comprises connector components 634' and apertures 667' (similar to connector components 634 and apertures 667 of standoff 624) and flange 653' with interior surface 659' and exterior surface 661' (similar to flange 653, interior surface 659 and exterior surface 661 of standoff retainer 641). Connector components 634' may be used to engage corresponding connector components 32 on edge-adjacent panels 622 and to thereby connect edge-adjacent panels 622 to one another and to provide edge-connecting standoffs. In some embodiments, connector components 634' may be used to engage interior connector components 646 to provide interior standoffs. Apertures 667' may allow concrete to flow therethrough and may be used to support rebar. Interior surface 659' of flange 653' may abut against structure 210 to permit standoff 669 to be mounted to structure 210.

Standoff 669 may be used in a modified version of apparatus 620 in addition to or in the alternative to the combination of standoffs 624 and standoff retainers 641. In the illustrated embodiment of FIG. 10D, standoff 669 does not include apertures through flange 653'. As such, fasteners 643 may be driven through flange 653' before being inserted into structure 210, flange 653' may be pre-drilled to provide apertures and/or suitable adhesive may be used to mount standoff 669 to structure 210. In other embodiments, flange 653' may be provided with apertures through which fasteners may extend. In the illustrated embodiment, standoff 669 does not include a notch similar to notch 655 or a gap similar to gap 663. In other embodiments, however, standoff 669 may be modified to provide such a notch and/or such a gap.

Figure 11A:
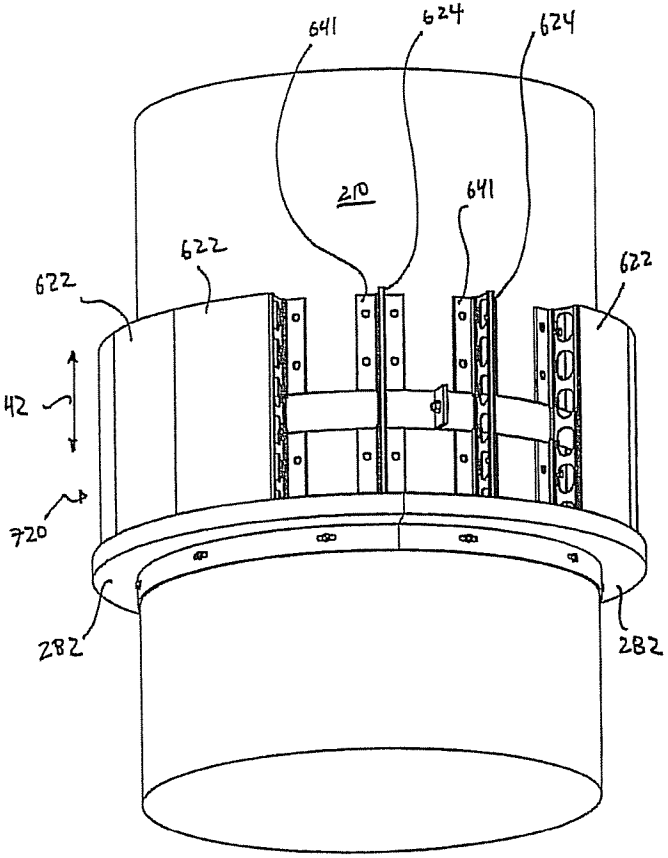
FIG. 11A is a partially cut-away isometric view of an apparatus for repairing the FIG. 5A structure according to another embodiment.
Figure 11B:
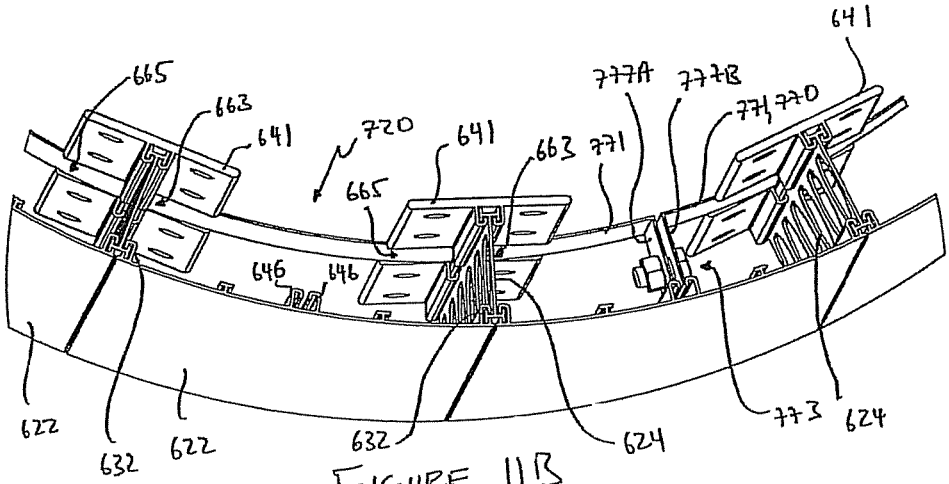
FIG. 11B is a partial isometric view of the FIG. 11A apparatus.

FIGS. 11A and 11B show various views of an apparatus 720 for repairing a curved structure 210 (FIG. 5A) according to another embodiment of the invention. For clarity, the damaged portions of structure 210 are not expressly shown in FIGS. 11A and 11B. However, in FIG. 11A, structure 210 is expressly shown to extend in longitudinal directions 42 beyond the edges of apparatus 720. In many respects, apparatus 720 is similar to apparatus 620 described above. More particularly, apparatus 720 comprises curved panels 622, curved edge formwork components 282, standoffs 624 and standoff retainers 641 which are substantially similar to those of apparatus 620 described above. While not expressly shown in the illustrated views, in some embodiments it may be desirable to provide apparatus 720 with edge formwork components similar to edge formwork components 282 at its opposing (e.g. upper) edge. Apparatus 720 differs from apparatus 620 in that apparatus 720 comprises a strapping system 770 which may be used in addition to or as an alternative to fasteners 643—i.e. to help retain standoff retainers 641 against structure 210. In the illustrated embodiment, strapping system 770 is used as an alternative to fasteners 643. Apparatus 720 of the illustrated embodiment is shown without rebar; however, in other embodiments, apparatus 720 may incorporate rebar in a similar fashion to apparatus 620.

A particular example of a suitable strapping system 770 is shown in FIGS. 11A and 11B, although it will be appreciated by those skilled in the art that a variety of strapping systems capable of performing the functions described herein may be used in the place of strapping system 770. In the illustrated embodiment, strapping system 770 comprises one or more strap components 771 which extend around structure 210 and which have ends connected to one another at one or more closure mechanisms 773. In the illustrated views, only one closure mechanism 773 is visible, although the number of closure mechanisms in any particular implementation will depend on the number of strap components 771. In the illustrated embodiment, strap components 771 comprise material (e.g. metal, metal alloy, suitable polymer or suitable composite material) which can withstand the application of tensile forces. In the illustrated embodiment, each strap component 771 comprises a pair of closure flanges 777A, 777B (collectively, closure flanges 777).

Closure mechanism(s) 773 permit strapping system 770 to be tightened and locked at a desired tension by applying tension between adjacent strap components 771. In the illustrated embodiment, closure mechanisms 773 comprise a combination of a nut and bolt (not explicitly enumerated). A variety of suitable closure mechanisms are known to those skilled in the art and any such closure mechanism could be used to provide closure mechanisms 773. Non-limiting examples of closure mechanisms include ratchet-type closure mechanisms and buckle-type closure mechanisms.

In use, strapping system 770 is used to help mount standoff retainers 641 against structure 210. Strap components 771 may extend across notches 655 in standoff retainers 641 and through gaps 663 between connector components 639 of standoffs 624 and exterior surfaces 661 of standoff retainers 641 (see FIG. 10C). When closure mechanism(s) 773 are tightened, strapping system 770 exerts force on standoff retainers 641, thereby helping to retain standoff retainers 641 against structure 210. While not shown in the illustrated embodiment which uses only strapping system 770 to mount standoff retainers 641, standoff retainers 641 may additionally be mounted to structure 210 using suitable fasteners similar to fasteners 643 described above and/or using suitable adhesive. The remaining procedures associated with using apparatus 720 (e.g. mounting edge formwork components 282 to structure 210, coupling standoffs 624 to standoff retainers 641 and coupling panels 222 to standoffs 624) may be substantially similar to those associated with using apparatus 620 described above.

Figure 12A:
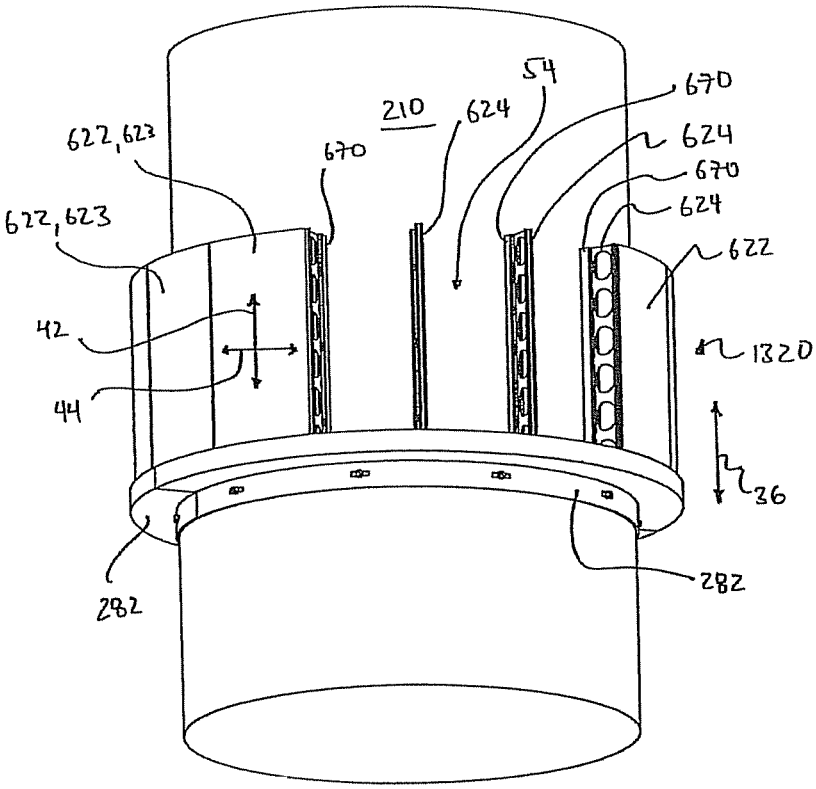
FIG. 12A is a partially cut-away isometric view of an apparatus for repairing the FIG. 5A structure according to another embodiment.

FIG. 12A is a partially cut-away isometric view of an apparatus 1320 for repairing a curved structure 210 (FIG. 5A) according to another embodiment of the invention. For clarity, the damaged portions of structure 210 are not expressly shown in FIG. 12A. However, in FIG. 12A, structure 210 is expressly shown to extend in longitudinal directions 42 beyond the edges of apparatus 720. Apparatus 1320 is similar in many respects to apparatus 620 described above (FIGS. 10A-10C), except that apparatus 1320 comprises standoff retainers 670 which are different than standoff retainers 641.

Various views of standoff retainers 670 used in apparatus 1320 are shown in FIGS. 12B-12E. In many respects, standoff retainer 670 is similar to standoff retainer 641 of apparatus 620 described above. Standoff retainer 670 extends generally in longitudinal direction 42 and has a relatively narrow width (in direction 44) in comparison to standoff retainer 641. In the illustrated embodiment, standoff retainer 670 comprises an interior wall 674, an optional intermediate wall 676, sidewalls 678A, 678B and connector component wall(s) 673. Interior wall 674 is penetrated at longitudinally spaced apart intervals by apertures 680, intermediate wall 676 is penetrated at longitudinally spaced apart intervals by apertures 682 and connector component walls 673 are penetrated at longitudinally spaced apart intervals by apertures 684. Interior wall apertures 680, intermediate wall apertures 682 and connector component wall apertures 684 are generally aligned with one another and may have coaxial centers. As shown best in FIG. 12D, interior wall apertures 680 may have a smaller cross-section than intermediate wall apertures 682 and/or connector component wall apertures 684.

Connector component walls 673 provide a pair of connector components 672 which are similar to connector components 651 of standoff retainers 641 and which may engage corresponding connector components 639 of standoffs 624 to couple the interior edges of standoffs 624 to standoff retainers 670. In the illustrated embodiment, connector components 639 of standoffs 624 comprise male T-shaped connector components (see FIG. 10C) which are slidably received in female J-shaped connector components 672 of standoff retainers 670. Like apparatus 620, the coupling of standoffs 624 to panels 622 and to standoff retainers 670 tends to prevent panels 622 of apparatus 1320 from moving outwardly (i.e. away from structure 210) under the weight of liquid concrete introduced into space 54 between panels 622 and structure 210.

Use of standoff retainers 670 in apparatus 1320 is similar to use of standoff retainers 641 in apparatus 620 described above. As shown best in FIG. 12A, standoff retainers 670 are mounted to structure 210. In the illustrated embodiment, the longitudinal dimension 42 of standoff retainers 670 extends in a generally vertical direction 36 so that an interior surface of interior wall 674 abuts (at least partially) against structure 210. Fasteners (not shown) may then be projected through apertures 684, 682, partially through apertures 680 and into structure 210 to thereby mount standoff retainers 670 to structure 210. In particular embodiments, intermediate apertures 682 and connector component wall apertures 684 are larger (in cross-section) than interior apertures 680 to permit the extension of fasteners and corresponding tools through apertures 682, 684, but to permit fasteners to extend only partially through interior apertures 680. The fasteners used to mount standoff retainers 670 to structure 210 may have features similar to fasteners 643 described above. The type of fasteners used to mount standoff retainers 670 to structure 210 may depend on the type of material used to fabricate structure 210 as described above (e.g. for fasteners 643). In other embodiments, suitable adhesives or the like may be used in addition to or as an alternative to fasteners to mount standoff retainers 670 to structure 210.

Edge formwork components 282 may also be mounted to structure 210 in a manner similar to that discussed above. Once standoff retainers 670 and edge formwork components 282 are mounted to structure 210, standoffs 624 are coupled to standoff retainers 670 (e.g. by engaging connector components 639 of standoffs 624 with connector components 672 of standoff retainers 670). Once standoffs 624 are coupled to standoff retainers 670, the remaining assembly of apparatus 1320 is similar to that described above for apparatus 620. Apparatus 1320 incorporating standoff retainers 670 may otherwise be similar to apparatus 620 described above. It will be appreciated that standoff retainers 670 may be used in addition to or in the alternative to standoff retainers 641 in a modified version of apparatus 720, wherein strapping system 770 may extend through the apertures 667 in standoffs 624.

Apparatus 620, 720 and 1320 (of FIGS. 10A-10B, 11A-11B and 12A) incorporate standoff retainers which are secured to the existing structure and corresponding standoffs which are coupleable to both the standoff retainers and to panels to retain the panels from moving outwardly under the pressure of liquid concrete. The particular illustrated embodiments are shown in use with curved structures similar to structure 210 of FIG. 5. This is not necessary. In general, the particular apparatus described herein may be provided with straight panels, curved (or flexible) panels, inside and/or outside corner panels, inside corner connector components, straight edge formwork components, curved edge formwork components, inside and/or outside corner edge formwork components, transverse edge formwork components and/or suitably modified or additional components, such that with suitable modifications the apparatus described herein may be used to repair structures similar to structure 10 (FIG. 1), 210 (FIG. 5A), structure 310 (FIG. 6A) and structure 810 (FIG. 7A). As discussed above, since many structures and surfaces comprise various combinations of these structures and surfaces, it will be appreciated by those skilled in the art that with various modifications, apparatus similar to the apparatus described herein may be used to repair structures having virtually any shape and/or surface profile.

Figures 12B, 12C, 12D, 12E, 13A:
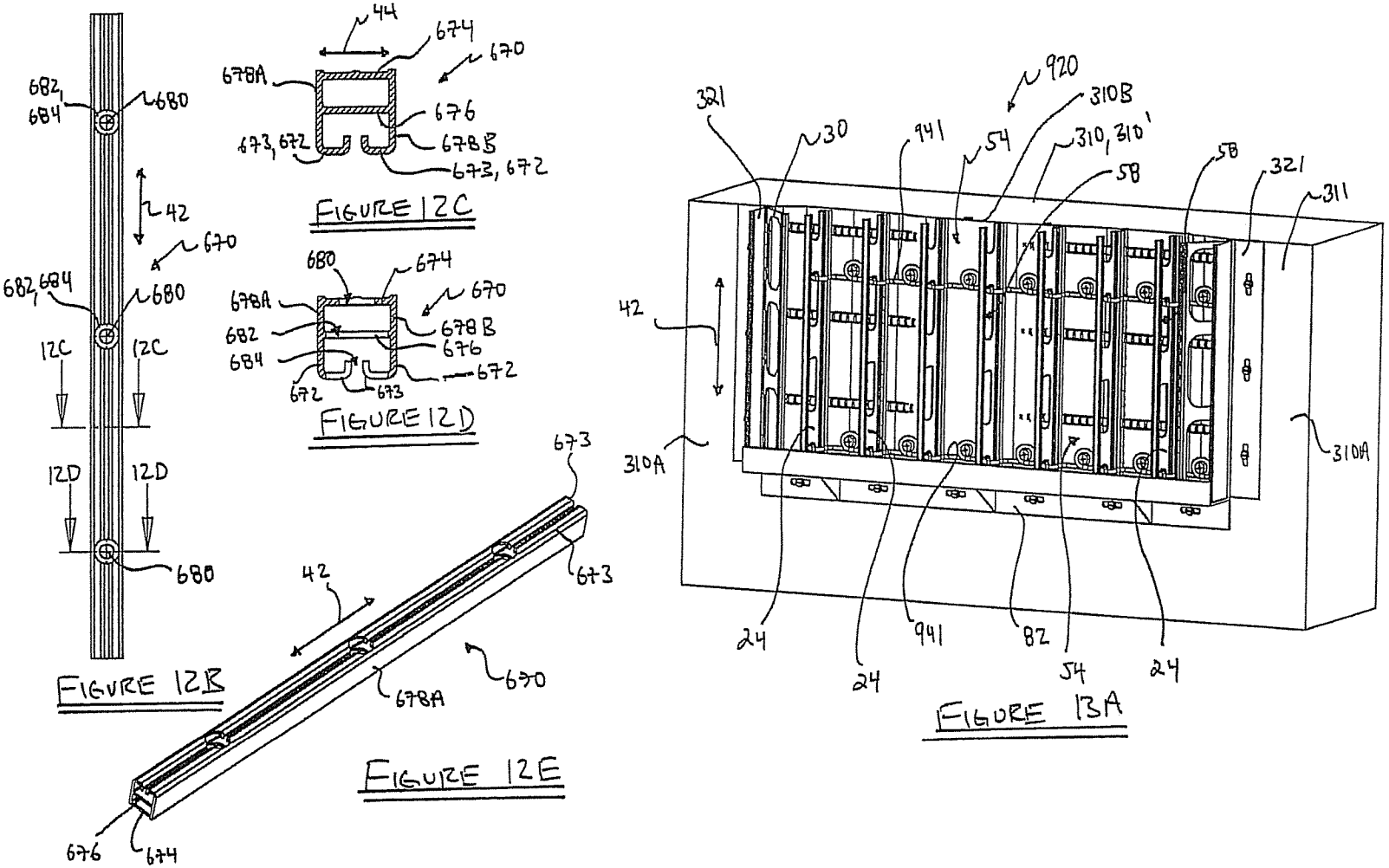
FIGS. 12B-12E show various views of a standoff retainer used in the FIG. 12A apparatus.
FIG. 13A is a partial isometric view of an apparatus for repairing the damaged surface of the FIG. 6A structure according to another embodiment with the panels removed for clarity.
Figure 13B:
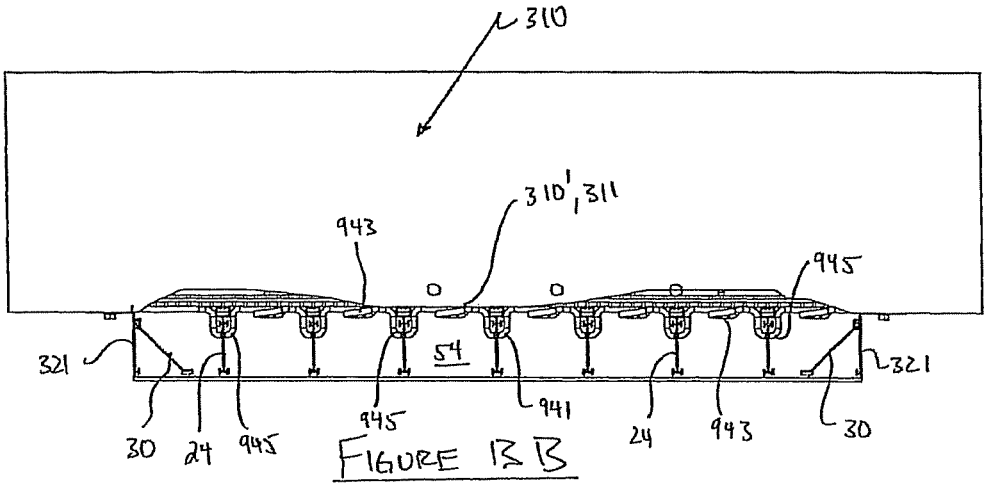
FIGS. 13B and 13C are respectively a partial top view and a partial isometric view of the FIG. 13A apparatus with the panels removed for clarity.
Figure 13C:
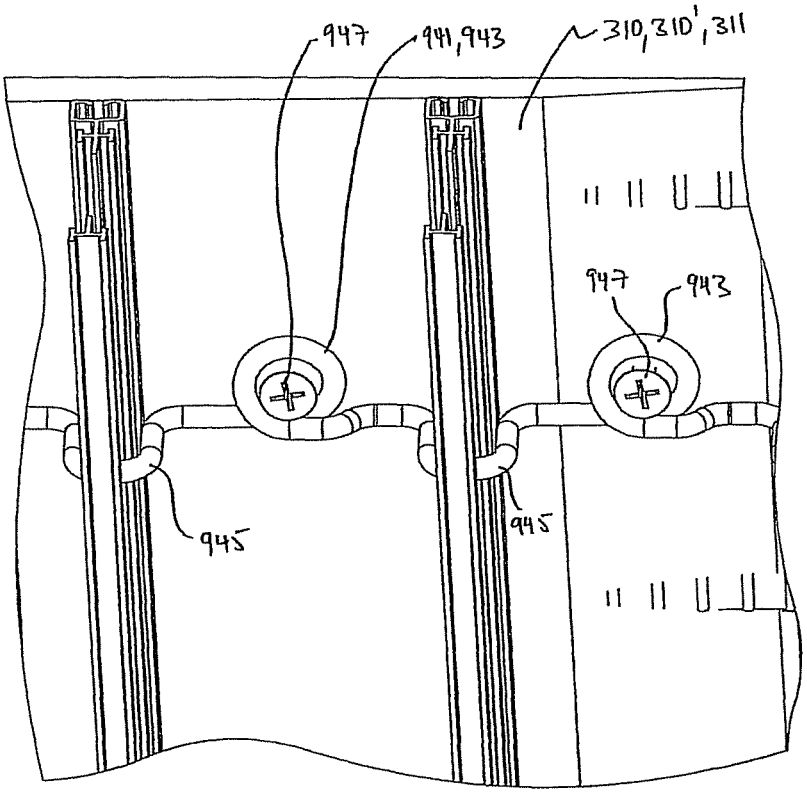

FIGS. 13A-13C show various partial views of an apparatus 920 for repairing the damaged portion 310' (e.g. generally flat surface 311) of structure 310 (FIG. 6A) according to another embodiment. In some respects, apparatus 920 is similar to apparatus 320 described above. More particularly, apparatus 920 comprises panels 22, standoffs 24, optional braces 30, edge formwork components 82 and transverse edge formwork components 321 which are substantially similar to those of apparatus 320 described above. For clarity, panels 22 of apparatus 920 are not shown in the illustrated views of FIGS. 13A-13C. While not expressly shown in the illustrated views, in some embodiments it may be desirable to provide apparatus 920 with edge formwork components similar to edge formwork components 82 at its opposing (e.g. upper) edge. Standoffs 24 may comprise interior standoffs 24A and/or edge-connecting standoffs 24B and function in a manner similar to those of apparatus 320 (FIGS. 6B-6D) to maintain space 54 (for concrete flow) between structure 310 and panels 22 and to retain panels 22 from moving outwardly when space 54 is filled with concrete. Apparatus 920 differs from apparatus 320 in that apparatus 920 comprises standoff retainers 941 which are used in place of rebar 26 and rebar retainers 28 to retain standoffs 24 and to thereby couple apparatus 920 to structure 310.

Standoff retainers 941 are coupled to structure 310 and to standoffs 24. A standoff retainer 941 is shown in more detail in FIGS. 13C and 13D. Standoff retainers 941 of the illustrated embodiment comprises an elongated curved rod fabricated from suitable material(s) (e.g. suitably strong plastic, fiberglass, metallic alloys, polymeric materials, carbon fiber materials or the like). Standoff retainer 941 comprises one or more fastener-receiving features 943 and one or more standoff-engaging features 945. In the illustrated embodiment, standoff retainers 941 are bent or otherwise fabricated such that fastener-receiving features 943 comprise fastener-receiving curves 943 and standoff-engaging features 945 comprise standoff-engaging curves 945. In other embodiments, fastener-receiving features 943 and standoff-engaging features 945 may be provided by other constructions. For example, fastener-receiving features 943 and/or standoff-engaging features 945 could comprise separate components that are coupled to a main standoff retainer rod in locations where it is desirable to locate a fastener 947 or a standoff 24. In such other embodiments, the main standoff retainer rods need not be curved or bent.

In operation, standoff retainers 941 extend through apertures 58 in standoffs 24. In the illustrated embodiment, one standoff 24 is provided for each standoff-engaging curve 945. This is not necessary. In general, the ratio of standoff-engaging curves 945 to standoffs 24 may be greater than unity. In the illustrated embodiment of FIG. 13A, one standoff retainer 941 extends through every second aperture 58 of standoffs 24 (i.e. in vertical direction 36). This is not necessary. In some embodiments, standoff retainers 941 may extend through every aperture 58 of standoffs 24. In other embodiments, standoff retainers 941 may extend through further spaced apart (i.e. fewer) apertures 58 in each standoff 24. In some embodiments, it is desirable to extend standoff retainers 941 through at least two apertures 58 which are spaced apart from one another along the longitudinal dimension 42 of standoffs 24. In still other embodiments, standoff retainers 941 may engage standoffs 24 without extending through apertures 58.

Once standoff retainers 941 are extended through apertures 58 (or otherwise engage standoffs 24), standoff retainers 941 are placed against structure 310 such that at least some of aperture-receiving curves 943 abut against structure 310. Standoff retainers 941 (and standoffs 24 to which they are engaged) are then mounted to structure 310 at desired locations using fasteners 947 which may project through aperture-receiving curves 943 and into structure 310. Fasteners 947 used to mount standoff retainers 941 to structure 310 may have features similar to fasteners 643 described above. The type of fasteners 947 used to fasten standoff retainers 941 to structure 310 may depend on the type of material used to fabricate structure 310 as described above (e.g. for fasteners 643).

Once standoff retainers 941 and standoffs 24 are mounted to structure 310 at desired locations, the remaining assembly is similar to that described above for apparatus 320. Apparatus 920 may otherwise be similar to apparatus 320 described above.

Figure 13D:
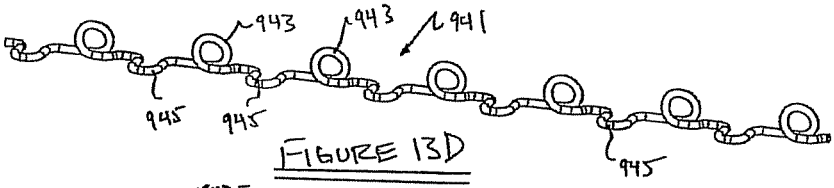
FIGS. 13D-13G are isometric views of standoff retainers suitable for use with the FIG. 13A apparatus.
Figure 13E:
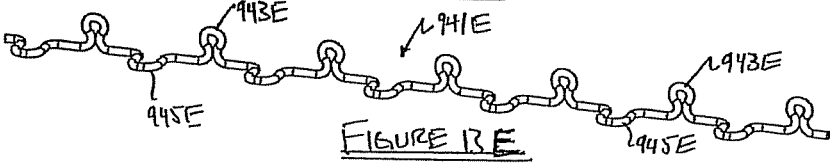
Figure 13F:
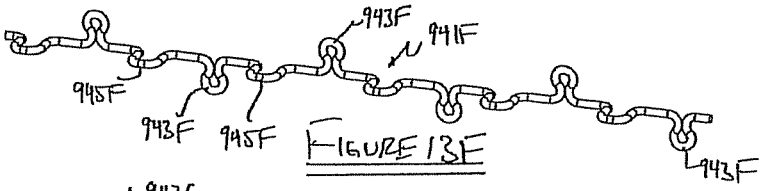
Figure 13G:
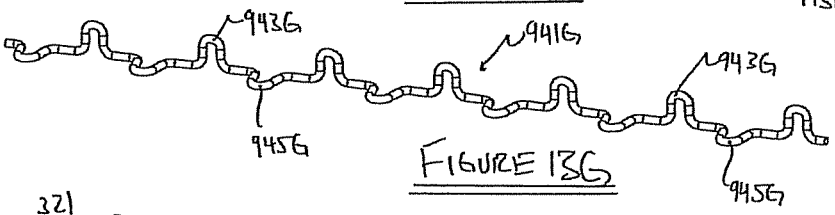

FIG. 13D illustrates a particular standoff retainer 941 of the type used in apparatus 920 of FIGS. 13A-13C. Standoff retainer 941 comprises a plurality of fastener-receiving features (e.g. curves) 943 and a plurality of standoff-engaging features (e.g. curves) 945. Standoff retainers similar to standoff retainer 941 may be provided with other shapes and/or configurations. FIGS. 13E-13G show other non-limiting examples of suitable standoff retainers 941E-941G having other shapes and/or configurations. Standoff retainers 941E-941G comprise fastener-receiving curves 943E-943G and standoff-engaging curves 945E-945G. Fastener-receiving curves 943E, 943F have a pinched shape and fastener-receiving curves 943G have a U-shape—i.e. rather than the looping shape of fastener-receiving curve 943 (FIG. 13D). Fastener receiving curves 943F extend alternatingly upwardly and downwardly from the main shaft of curved rod 941F.

Figure 13H:
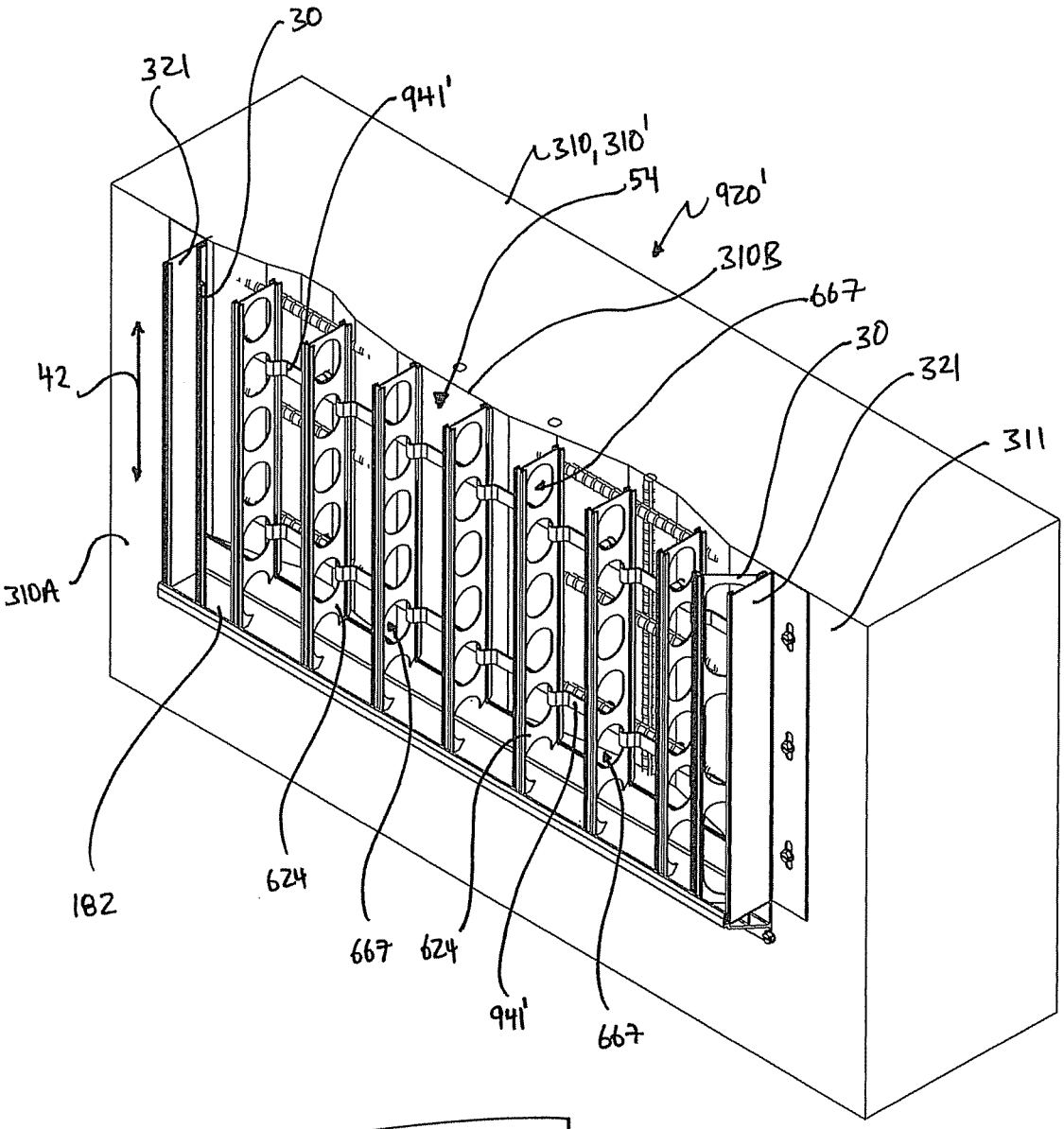
FIG. 13H is a partial isometric view of an apparatus for repairing the damaged surface of the FIG. 6A structure according to another embodiment with the panels removed for clarity.

FIG. 13H shows a partial isometric view of an apparatus 920' for repairing the damaged portion 310' (e.g. generally flat surface 311) of structure 310 (FIG. 6A) according to another embodiment. Apparatus 920' is similar in many respects to apparatus 920 of FIGS. 13A-13C. More particularly, apparatus 920' comprises panels 22, optional braces 30 and transverse edge formwork components 321 which are substantially similar to those of apparatus 920 described above. For clarity, panels 22 of apparatus 920' are not shown in the illustrated view of FIG. 13H. Apparatus 920' differs from apparatus 920 in that apparatus 920' comprises edge formwork component 182 (rather than edge formwork component 82), but edge formwork component 182 functions in a manner similar to edge formwork component 82 to retain concrete in space 54. While not expressly shown in the illustrated views, in some embodiments it may be desirable to provide apparatus 920' with edge formwork components similar to edge formwork components 82, 182 at its opposing (e.g. upper) edge. Apparatus 920' differs from apparatus 920 in that apparatus 920' comprises standoffs 624 (rather than standoffs 24), but standoffs 624 function in a manner similar to standoffs 24 of apparatus 920 to maintain space 54 (for concrete flow) between structure 310 and panels 22 and to retain panels 22 from moving outwardly when space 54 is filled with concrete. Standoffs 624 may comprise interior and/or edge-connecting standoffs. In other embodiments, standoffs 24 could be used in the place of standoffs 624.

Apparatus 920' also differs from apparatus 920 in that apparatus 920' comprises standoff retainers 941' which are formed from elongated bent strips (rather than elongated curved rods) to retain standoffs 624 and to thereby couple apparatus 920' to structure 310. The bent strips used to fabricate standoff retainers 941' have one dimension (schematically shown as 951' which is generally parallel to longitudinal dimension 42 of apparatus 920') that is significantly greater than its transverse thickness dimension (schematically shown as 953'). In some embodiments, a ratio of dimension 951' to dimension 953' is greater than 3:1. In some embodiments, this ratio is greater than 5:1.

Figure 13I:
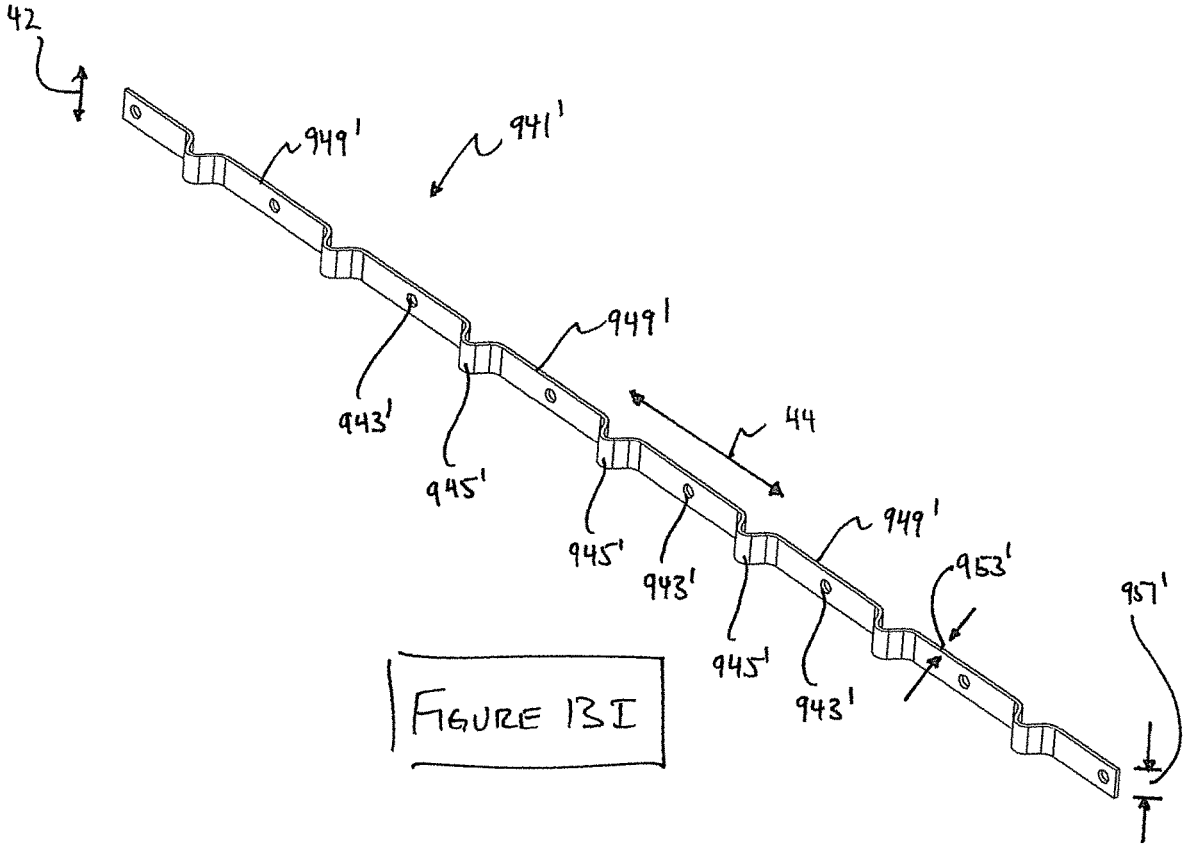
FIG. 13I is an isometric view of the standoff retainer of the FIG. 13H apparatus.

Despite being formed from elongated bent strips (rather than curved rods), standoff retainers 941' are similar in many respects to standoff retainers 941. A standoff retainer 941' is shown in more detail in FIG. 13I. Standoff retainers 941' may be fabricated from any suitable material(s) (e.g. suitably strong plastic, fiberglass, steel, other metallic alloys, polymeric materials, carbon fiber materials or the like). Standoff retainer 941' comprises one or more standoff-engaging features 945'. In the illustrated embodiment, standoff retainers 941' are bent or otherwise fabricated such that standoff-engaging features 945' comprise standoff-engaging bends 945'. In other embodiments, standoff-engaging features 945' may be provided by other constructions similar to those described above for standoff-engaging features 945.

The operation of standoff retainers 941' is similar to that of standoff retainers 941 described above. More particularly, standoff retainers 941' extend through apertures 667 in standoffs 624 such that standoffs 624 are located in the general vicinity of standoff-engaging bends 945'. The relative numbers of standoff-engaging curves 945', standoffs 624, apertures 667 and standoff retainers 941' may be similar to those for standoff retainers 941 and standoffs 24 described above for apparatus 920. In other embodiments, standoff retainers 941' may engage standoffs 624 without extending through apertures 667.

Once standoff retainers 941' are extended through apertures 667 (or otherwise engage standoffs 624), standoff retainers 941' are placed against structure 310 such that flat portions 949' of standoff retainers 941' abut against structure 310. Standoff retainers 941' (and standoffs 624 to which they are engaged) are then mounted to structure 310 at desired locations. In particular embodiments, suitable fasteners (not shown) project through flat portions 949' of standoff retainers 941' and into structure 310. In some embodiments, standoff retainers 941' comprise apertures 943' through which fasteners may project to mount standoff retainers 941' to structure 310. The fasteners used to mount standoff retainers 941' to structure 310 may be similar to fasteners 947 described above.

Once standoff retainers 941' and standoffs 624 are mounted to structure 310 at desired locations, the remaining assembly of apparatus 920' is similar to that described above for apparatus 920. Apparatus 920' may otherwise be similar to apparatus 920 described above.

In the illustrated embodiments of FIGS. 13A-13G, standoff retainers 941 comprise a plurality of fastener-receiving features (e.g. curves) 943 and a plurality of standoff-engaging features (e.g. curves) 945. In the illustrated embodiment of FIGS. 13H-13I, standoff retainers 941' comprise a plurality of standoff-engaging features (e.g. bends) 945' and a plurality of flat portions 949'. This is not necessary. In some embodiments, standoff retainers similar to standoff retainers 941 may be provided with as few as a single fastener-receiving feature 943 and/or as few as a single standoff-engaging feature 945. In one particular embodiment, standoff retainers similar to standoff retainers 941 are provided with a pair of fastener-receiving features 943 on either side of a single standoff-engaging feature 945. Such a standoff retainer could extend through an aperture 58 of a single standoff 24 such that the standoff 24 is retained in the single standoff-retaining feature 945 and could be fastened to the structure on either side of standoff 24 by fasteners which project through the pair of fastener-receiving features 943. In some embodiments, standoff retainers similar to standoff retainers 941' may be provided with as few as a single standoff-engaging feature 945' and as few as a single flat portion 949'. In one particular embodiment, standoff retainers similar to standoff retainers 941' are provided with a pair of flat portions 949' on either side of a single standoff-engaging feature 945'. Such a standoff retainer could extend through an aperture 667 of a single standoff 624 such that the standoff 624 is retained in the single standoff-retaining feature 945' and could be fastened to the structure on either side of standoff 624 by fasteners which project through the pair of flat portions 949'.

Figure 19A:
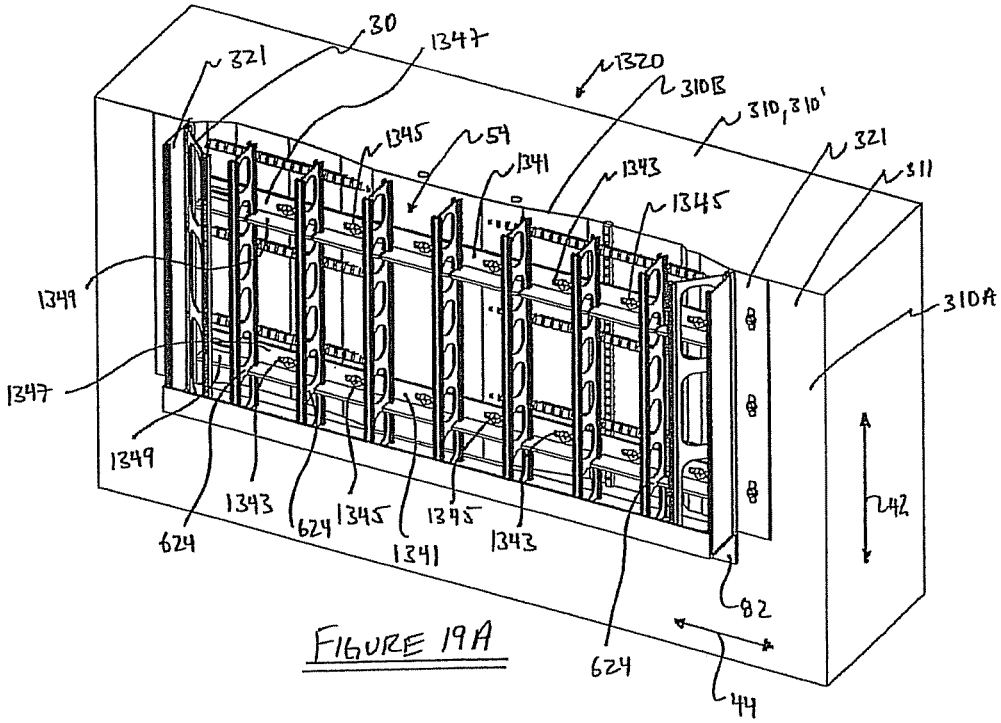
FIG. 19A is a partial isometric view of an apparatus for repairing the damaged surface of the FIG. 6A structure according to another embodiment with the panels removed for clarity.
Figure 19C:
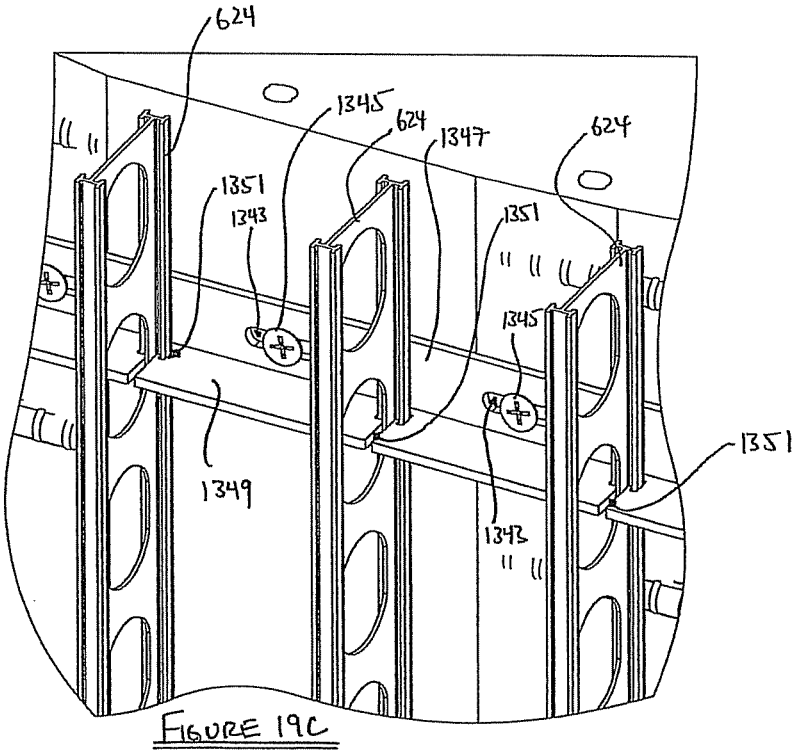
FIGS. 19B and 19C are respectively a partial top view and a partial isometric view of the FIG. 19A apparatus with the panels removed for clarity.
Figure 19B:
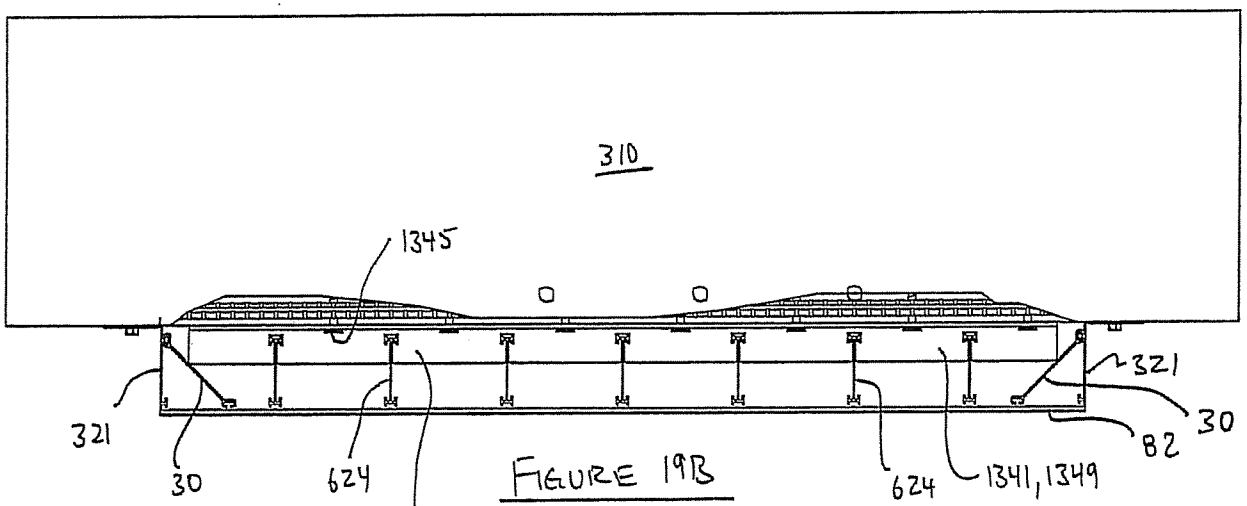

FIGS. 19A-19C show various partial views of an apparatus 1320 for repairing the damaged portion 310' (e.g. generally flat surface 311) of structure 310 (FIG. 6A) according to another embodiment. Apparatus 1320 is similar in many respect to apparatus 920 described above. More particularly, apparatus 1320 comprises panels 22, optional braces 30, edge formwork components 82 and transverse edge formwork components 321 which are substantially similar to those of apparatus 920 described above. For clarity, panels 22 of apparatus 1320 are not shown in the illustrated views of FIGS. 19A-19C. While not expressly shown in the illustrated views, in some embodiments it may be desirable to provide apparatus 1320 with edge formwork components similar to edge formwork components 82 at its opposing (e.g. upper) edge. Apparatus 1320 differs from apparatus 920 in that apparatus 1320 comprises standoffs 624 (rather than standoffs 24), but standoffs 624 of apparatus 1320 function in a similar manner to standoffs 24 of apparatus 920 to maintain space 54 (for concrete flow) between structure 310 and panels 22 and to retain panels 22 from moving outwardly when space 54 is filled with concrete. Standoffs 624 may comprise interior and/or edge-connecting standoffs. In other embodiments, standoffs 24 could be used in the place of standoffs 624.

Apparatus 1320 also differs from apparatus 920 in that apparatus 1320 comprises different standoff retainers 1341 (used in place of curved rod standoff retainers 941) to retain standoffs 624 and to thereby couple apparatus 1320 to structure 310.

Figure 19D:
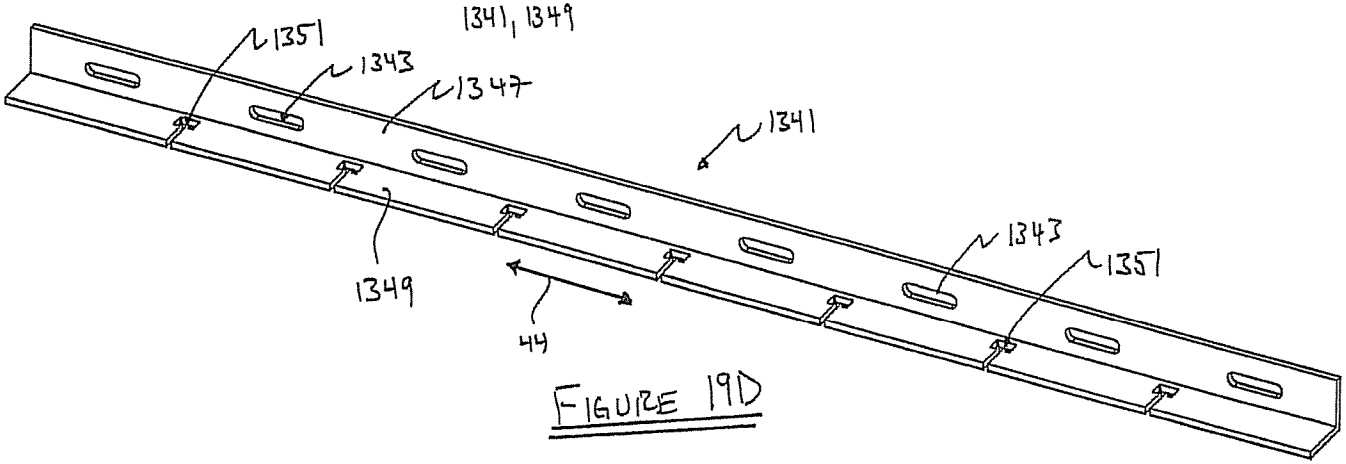
FIG. 19D is an isometric view of a standoff retainer suitable for use with the FIG. 19A apparatus.

Standoff retainers 1341 are coupled to structure 310 and to standoffs 624. Standoff retainer 1341 of the illustrated embodiment is shown in more detail in FIGS. 19C and 19D. Standoff retainers 1341 of the illustrated embodiment are elongated in width dimension 44 and may be fabricated from suitably strong material(s) (e.g. suitably strong plastic, fiberglass, steel, other metallic alloys, polymeric materials, carbon fiber materials or the like). Standoff retainers 1341 comprise a mounting flange 1347 for mounting standoff retainer 1341 to structure 310 and an engagement flange 1349 which projects away from mounting flange 1347 and structure 310. In some embodiments, standoff retainer 1341 may be fabricated from flat stock by bending to provide mounting flange 1347 and engagement flange 1349. In the illustrated embodiment, mounting flange 1347 abuts against structure 310 and is provided with apertures 1343 through which suitable fasteners 1345 may extend for mounting standoff retainer 1341 to structure 310. Fasteners 1345 may have features similar to fasteners 643 described above. The type of fasteners 1345 used to mount standoff retainer 1341 to structure 310 may depend on the type of material used to fabricate structure 310 as described above (e.g. for fasteners 643). Engagement flange 1349 comprises engagement features 1351 at suitably spaced apart intervals for engaging standoffs 624. In the illustrated embodiment, engagement features 1351 comprise cut-outs, punch-outs or the like (shown best in FIG. 19D) which are shaped to conform with the shape of the interior ends of standoffs 624 so that engagement features 1351 are capable of slidably receiving and engaging the interior ends of standoffs 624. It will be appreciated that engagement features 1351 (e.g. the cut-outs or the like) may have other shapes if the heads of the standoffs in a particular embodiment have other shapes. Also, in the illustrated embodiment, engagement features 1351 comprise the female connector components and standoffs 624 comprise the male connector components which slide into the engagement features. However, in other embodiments, the engagement features of engagement flange 1349 could provide the male connector components which slide into corresponding female components in the standoffs. In apparatus 1320, the connector components 634 or 639 of standoffs 624 (see FIG. 10C) provide a head similar to heads 56 of standoffs 24 (see FIG. 2C). In other embodiments, standoffs similar to standoffs 624 could be provided with heads shaped like any of the heads 56 described herein and such heads would function to engage engagement features 1351. The spacing between engagement features 1351 may depend on the spacing of corresponding connectors on panels 22.

In operation, one or more standoff retainers 1341 are mounted to existing structure 310 to extend in width direction 44 at locations spaced apart in longitudinal direction 42 (see FIG. 19A). The spacing between standoff retainers 1341 in longitudinal direction may depend on the strength required for the repair structure being fabricated. In the illustrated embodiment, standoff retainers may be mounted by abutting mounting flange 1347 to structure 310 and then extending fasteners 1345 through apertures 1343. Apertures 1343 are not necessary. In other embodiments, fasteners 1345 may be driven through mounting flange 1347, mounting flange 1347 may be pre-drilled or mounting flange 1347 may be mounted to structure 310 using suitable adhesives. Once standoff retainers 1341 are mounted to structure 310, standoffs 624 may be coupled to engagement flanges 1349 by sliding standoffs into engagement features 1351.

Once standoff retainers 1341 and standoffs 624 are mounted to structure 310 at desired locations, the remaining assembly is similar to that described above for apparatus 920, except that standoffs 624 are used in the place of standoffs 24. Apparatus 1320 may otherwise be similar to apparatus 920 described above.

In the illustrated embodiments of FIGS. 19A-19D, standoff retainers 1341 comprise a plurality of standoff-engaging features 1351. This is not necessary. In some embodiments, standoff retainers similar to standoff retainers 1341 may be provided with as few as a single standoff-engaging feature 1351.

Figure 19E:
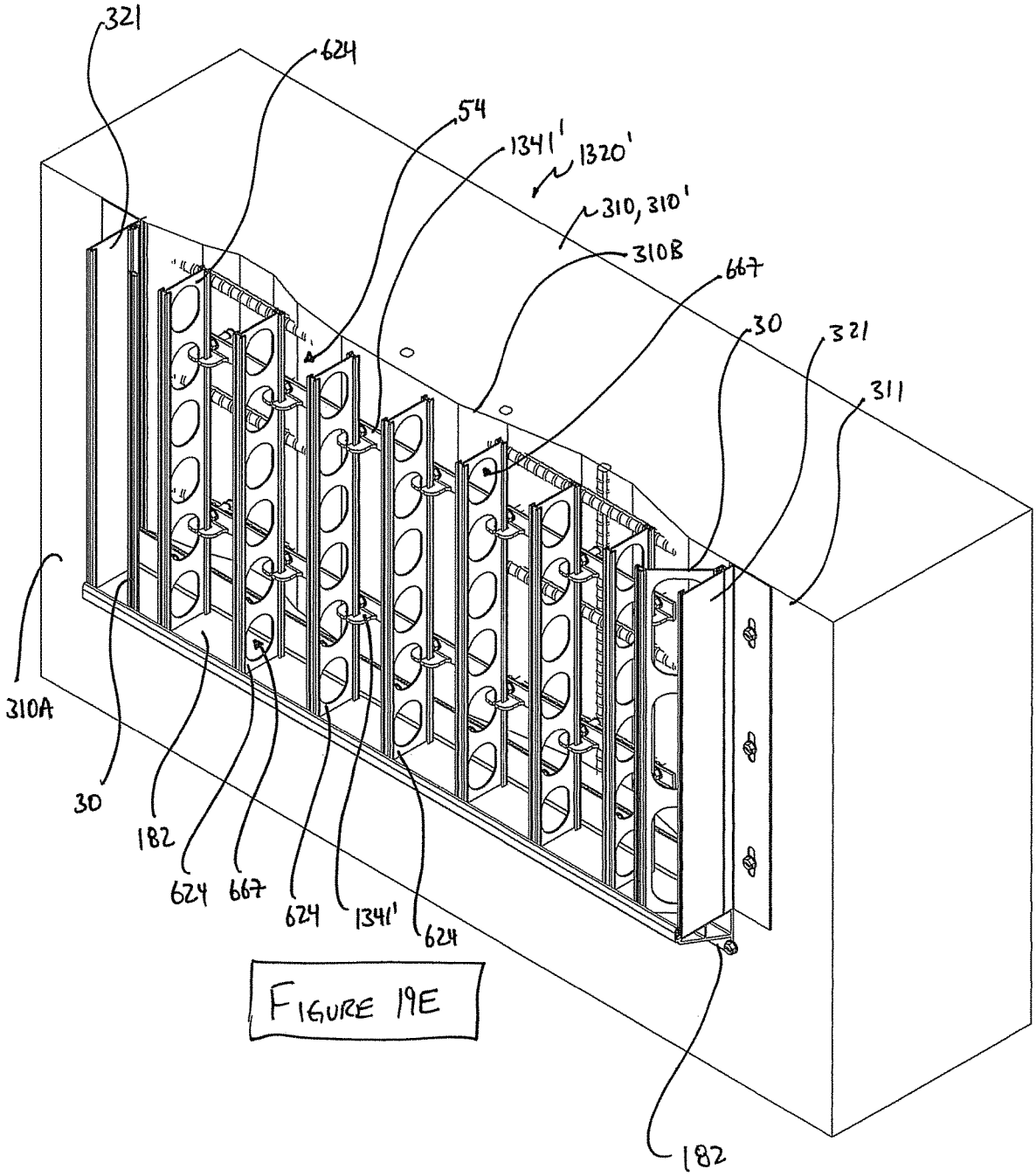
FIG. 19E is a partial isometric view of an apparatus for repairing the damaged surface of the FIG. 6A structure according to another embodiment with the panels removed for clarity.

FIG. 19E shows a partial isometric view of an apparatus 1320' for repairing the damaged portion 310' (e.g. generally flat surface 311) of structure 310 (FIG. 6A) according to another embodiment. Apparatus 1320' is similar in many respects to apparatus 1320 of FIGS. 19A-19C. More particularly, apparatus 1320' comprises panels 22, standoffs 624, optional braces 30 and transverse edge formwork components 321 which are substantially similar to those of apparatus 1320 described above. For clarity, panels 22 of apparatus 1320' are not shown in the illustrated view of FIG. 19E. Apparatus 1320' differs from apparatus 1320 in that apparatus 1320' comprises edge formwork component 182 (rather than edge formwork component 82), but edge formwork component 182 functions in a manner similar to edge formwork component 82 to retain concrete in space 54. While not expressly shown in the illustrated views, in some embodiments it may be desirable to provide apparatus 1320' with edge formwork components similar to edge formwork components 82, 182 at its opposing (e.g. upper) edge.

Apparatus 1320' also differs from apparatus 1320 in that apparatus 1320' comprises standoff retainers 1341' (in the place of standoff retainers 1341). A standoff retainer 1341' of the type used in apparatus 1320' is shown in more detail in FIG. 19F. Standoff retainers 1341' are similar in many respects to standoff retainers 1341 and function to couple standoffs 624 to structure 310. Standoff retainers 1341' may be fabricated from any suitable material(s) (e.g. suitably strong plastic, fiberglass, steel, other metallic alloys, polymeric materials, carbon fiber materials or the like). Like standoff retainers 1341, standoff retainers 1341' comprise a mounting flange 1347' for mounting standoff retainer 1341' to structure 310. The use of mounting flange 1347' for mounting standoff retainer 1341' to structure 310 is similar to the use of mounting flange 1347 to mount standoff retainer 1341. More particularly, mounting flange 1347' may abut against structure 310 and suitable fasteners may project through mounting flange 1347' and into structure 310. Mounting flange 1347' may optionally be provided with apertures 1343' through which such fasteners may project. Suitable adhesive and/or other suitable connection techniques may additionally or alternatively be used to connect mounting flange 1347' to structure 310.

Standoff retainer 1341' differs from standoff retainer 1341 in that standoff retainer 1341' does not have an engagement flange 1349. Instead, standoff retainer 1341' of the illustrated embodiment comprises a plurality of projections 1355' which extend transversely away from mounting flange 1347' at locations that are spaced apart from one another in width direction 44. In some embodiments, standoff retainer 1341' may be fabricated from flat stock by suitable bending to provide mounting flange 1347' and projections 1355'. In the illustrated embodiment, each projection 1355' comprises a corresponding engagement feature 1351', although this is not necessary and in other embodiments, each projection 1355' may comprise a different number of engagement features 1351'. Engagement features 1351' of standoff retainers 1341' may be substantially similar to engagement features 1351 of standoff retainer 1341 and function to couple standoff retainers 1341' to the heads of standoffs 624.

The spacing of projections 1355' and the location of engagement features 1351' within projections 1355' may be selected to provide desired spacing for standoffs 624. In the spaces 1353' between adjacent engagement features, mounting flange 1347' may have a substantially flat profile. Spaces 1353' between projections 1355' may save material costs and permit standoff retainer 1341' to be bent to accommodate a curved structure (not shown) without unduly opening engagement features 1351'. In some embodiments, spaces 1353' between adjacent projections 1355' have widths (in directions 44) that are greater than those of projections 1355'—i.e. a ratio of the widths of spaces 1353' to the widths of projections 1355' is greater than 1. In some embodiments, this ratio is greater than 1.5. The spaces 1353' between adjacent projections 1355' may vary for curved surfaces depending on the different radii of curvature of the original structure and the panels for the repair structure.

The operation, standoff retainers 1341' are similar to standoff retainers 1341 and involve: abutting mounting flange 1347' against structure 310, mounting standoff retainers 1341' to structure 310 and coupling standoffs 624 to engagement features 1351'. Once standoff retainers 1341' and standoffs 624 are mounted to structure 310 at desired locations, the remaining assembly of apparatus 1320' is similar to that described above for apparatus 920, except that standoffs 624 are used in the place of standoffs 24. Apparatus 1320' may otherwise be similar to apparatus 1320 described above.

Figure 19F:
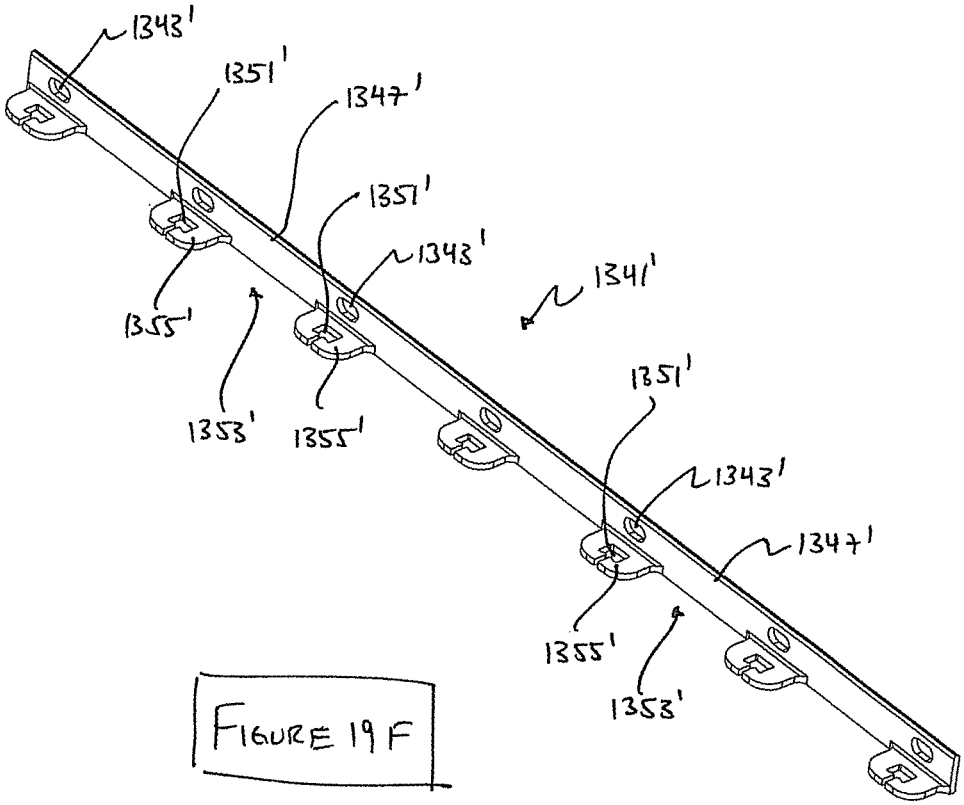
FIG. 19F is an isometric view of the standoff retainer of the FIG. 19E apparatus.

In the illustrated embodiments of FIGS. 19E-19F, standoff retainers 1341' comprise a plurality of projections 1355' and a corresponding plurality of standoff-engaging features 1351'. This is not necessary. In some embodiments, standoff retainers similar to standoff retainers 1341' may be provided with as few as a single projection 1355' and a single corresponding standoff-engaging feature 1351'.

In the illustrated embodiment of apparatus 920, 920', 1320 and 1320' (FIGS. 13A-13C, 13H, 19A-19C and 19E), standoff retainers 941, 941', 1341 and 1341' are generally elongated in one dimension (e.g. for use to repair generally flat surface 311 of the illustrated structure 310). This is not necessary, standoff retainers similar to standoff retainers 941, 941', 1341 and/or 1341' can be shaped (e.g. bent or fabricated) to accommodate the shape of the structures with which they are used and may be curved (e.g. for application to structures having curved surfaces) or may have inside or outside corners (e.g. for application to structures having corresponding corners). In general, the particular apparatus described herein may be provided with straight panels, curved (or flexible) panels, inside and/or outside corner panels, inside corner connector components, straight edge formwork components, curved edge formwork components, inside and/or outside corner edge formwork components, transverse edge formwork components and/or suitably modified or additional components, such that with suitable modifications the apparatus described herein may be used to repair structures similar to structure 10 (FIG. 1), 210 (FIG. 5A), structure 310 (FIG. 6A) and structure 810 (FIG. 7A). As discussed above, since many structures and surfaces comprise various combinations of these structures and surfaces, it will be appreciated by those skilled in the art that with various modifications, apparatus similar to the apparatus described herein may be used to repair structures having virtually any shape and/or surface profile.

Figure 14A:
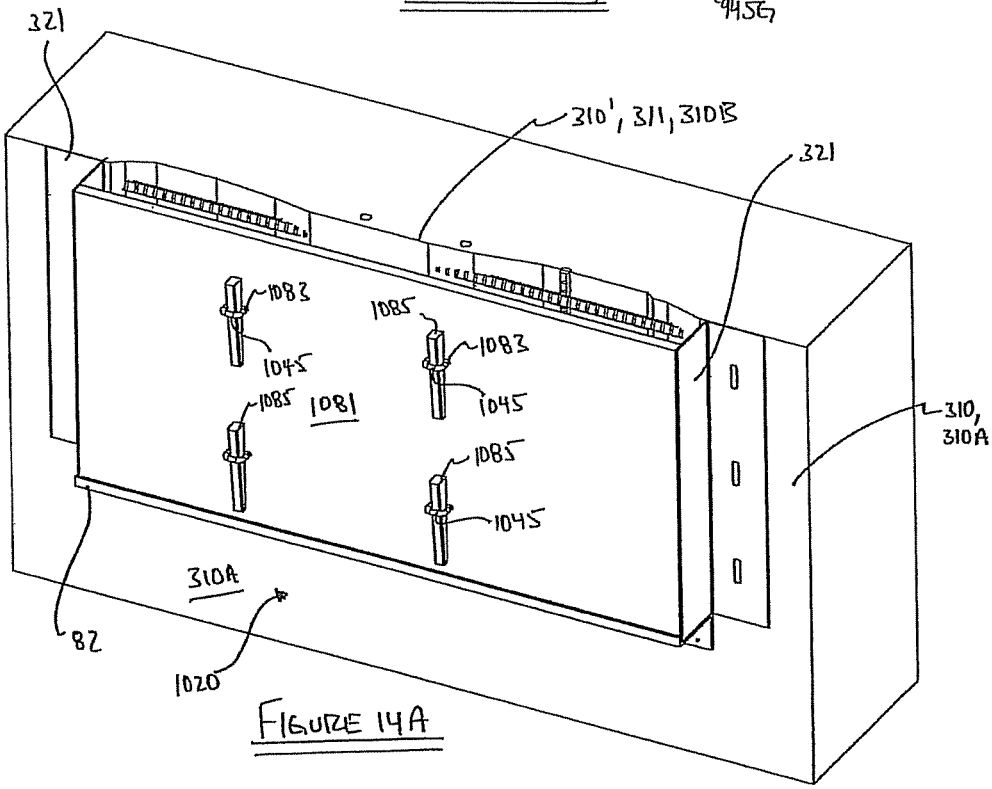
FIG. 14A is an isometric view of an apparatus for repairing the damaged surface of the FIG. 6A structure according to another embodiment.
Figures 14A, 14B, 14C, 14D, 14E:
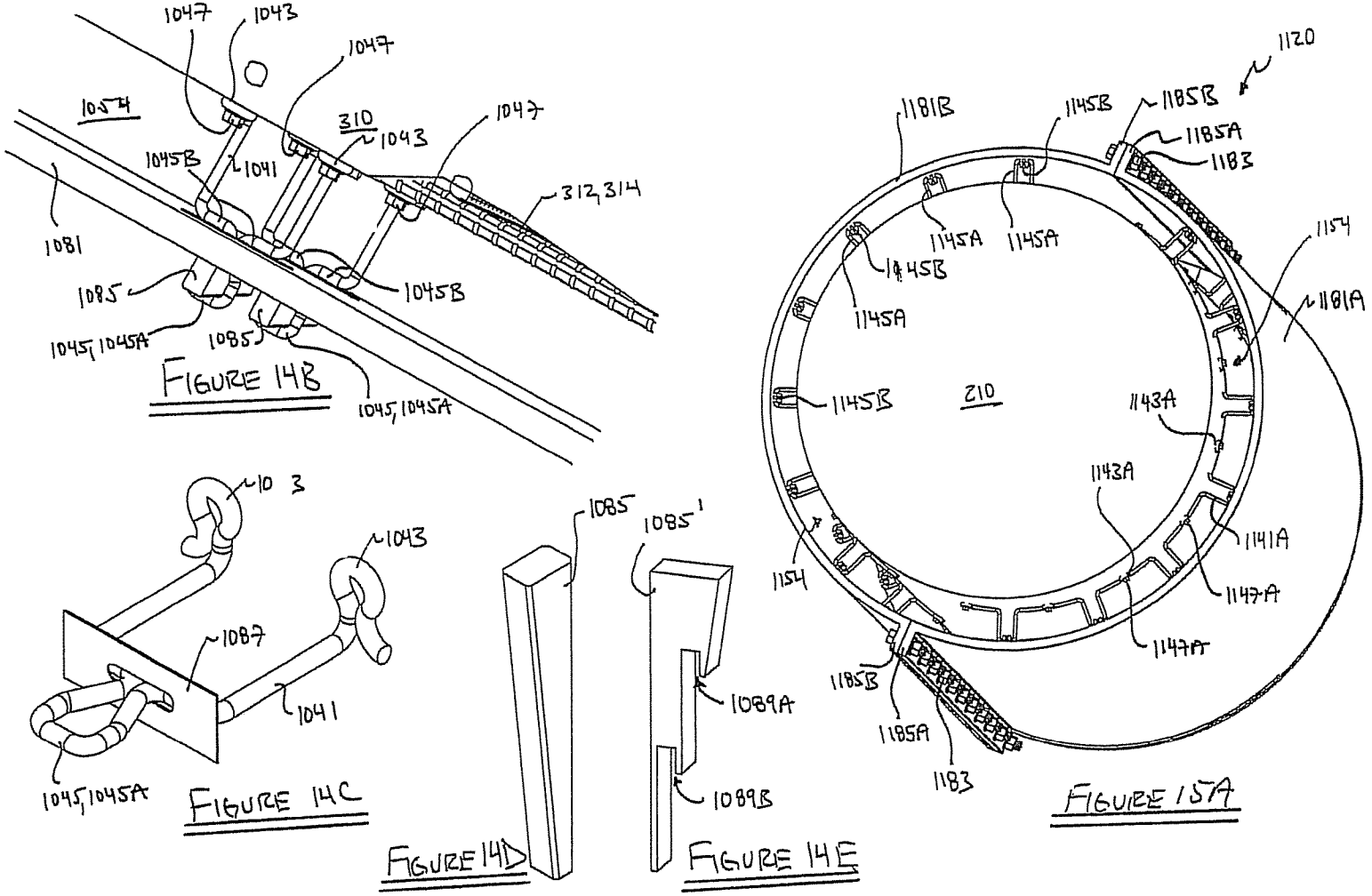
FIG. 14B is a partial isometric view of the FIG. 14A apparatus.
FIGS. 14C, 14D and 14E are respectively isometric views of a form-retainer, a first key and a second key suitable for use with the FIG. 14A apparatus.

FIG. 14A-14B are various views of an apparatus 1020 for repairing the damaged portion 310' (e.g. generally flat surface 311) of structure 310 (FIG. 6A) according to another embodiment. Apparatus 1020 includes edge formwork component 82 and transverse edge formwork components 321 which are similar to formwork component 82 and transverse edge formwork components 321 of apparatus 320 (FIG. 6B). While not expressly shown in the illustrated views, in some embodiments it may be desirable to provide apparatus 1020 with edge formwork components similar to edge formwork components 82 at its opposing (e.g. upper) edge. Apparatus 1020 differs from the embodiments described above in that apparatus 1020 does not include stay-in-place panels. Instead, apparatus 1020 comprises temporary bracing 1081 that may be removed after concrete cures in space 1054 between bracing 1081 and structure 310. Edge formwork component 82 and transverse edge formwork components 321 may also be removed after concrete cures in space 1054. In other embodiments, edge formwork component 82 and transverse edge formwork components 321 could remain attached to structure 310 and an interior surface of bracing 1081 could be lined with stay-in-place panels 22. Such other embodiments could also comprise anchoring components (e.g. anchoring components 424 of apparatus 420' (FIG. 8C)) which bond the stay-in-place panels 22 to the concrete in space 1054 as the concrete cures.

Apparatus 1020 comprises one or more form-retainers 1041 and one or more corresponding keys 1085 for retaining temporary bracing 1081 to structure 310. FIGS. 14C and 14D respectively show more detail of a form-retainer 1041 and a key 1085 of the particular types used in the illustrated embodiment. Form-retainers 1041 of the illustrated embodiment comprise elongated curved rods fabricated from suitable material(s) (e.g. suitably strong plastic, fiberglass, metallic alloys, polymeric materials, carbon fiber materials or the like). Form-retainers 1041 comprise a pair of fastener-receiving features 1043 and one or more form-engaging features 1045. In the illustrated embodiment, form-retainers 1041 are bent or otherwise fabricated such that fastener-receiving features 1043 comprise fastener-receiving curves 1043 and form-engaging features 1045 comprise faun-engaging curves 1045A and shoulders 1045B. Keys 1085 of the illustrated embodiment have a wedge shape which permits coupling to form-engaging curves 1045A as described in more detail below. Keys 1085 may be fabricated from any suitable material(s) (e.g. suitably strong plastic, fiberglass, metallic alloys, polymeric materials, carbon fiber materials or the like).

In operation, form-retainers 1041 mounted to structure 310 by abutting of fastener-receiving curves 1043 abut against structure 310 and projecting fasteners 1047 through fastener-receiving curves 1043 and into structure 310. Fasteners 1047 may have features similar to fasteners 643 described above. The type of fasteners 1047 used to fasten faun-retainers 1041 to structure 310 may depend on the type of material used to fabricate structure 310 as described above (e.g. for fasteners 643). To locate faun-retainers 1041 relative to bracing 1081, bracing 1081 may be temporarily mounted to structure 310 and markings may be made on structure 310 at the locations of apertures 1083 which may be provided in bracing 1081. Marks made through apertures 1083 may be used to provide references for the location of fasteners 1047 and to thereby locate form-retainers 1041 relative to bracing 1081.

Once form-retainers 1041 are mounted to structure 310, bracing components 1081 are mounted to form-retainers 1041. In the illustrated embodiment, bracing 1081 is provided with apertures 1083 through which form-engaging curves 1045A extend (i.e. from the inside of bracing 1081 to the outside of bracing 1081) such that bights of form-engaging curves 1045A are located on the exterior of bracing 1081 and shoulders 1045B are located on the interior of bracing 1081. In the illustrated embodiment, wedge-shaped keys 1085 are then inserted through the bights of form-engaging curves 1045A on the exterior of bracing 1081. With keys 1085 in place, bracing 1081 is wedged between keys 1085 and shoulders 1045B of form-retainers 1041. In this manner, keys 1085, form-engaging curves 1045A and shoulders 1045B act together to retain bracing 1081 to form-retainers 1041 and form-retainers 1041 are in turn mounted to structure 310. In the illustrated embodiment, keys 1085 have a wedge shape which allows them to be easily inserted into and removed from the bights of form-engaging curves 1045A. In other embodiments, however, keys 1085 and/or form-engaging features 1045 of form-retainers 1041 may have other shapes or features that allow keys 1085 to retain bracing 1081 to form-retainers 1041. FIG. 14E shows a key 1085' according to another embodiment which may be used in addition to or in the alternative to key 1085 and which comprises grooves 1089A, 1089B for receiving a bight of form-engaging curve 1045A and thereby locking bracing 1081 in place. In some embodiments, an optional gasket 1087 (e.g. of elastomeric material) may be provided on an interior and/or exterior of bracing 1081 in a vicinity of apertures 1083 to prevent concrete leak through. An example gasket 1087 is shown best in FIG. 14C. In the illustrated embodiment of FIGS. 14A and 14B, gasket 1087 is located on an interior of bracing 1081. Depending on the material used to provide gasket 1087, concrete may bond to gasket 1087 (in which case, gasket 1087 may stay in place after the concrete is cured) or concrete may not bond to gasket 1087 (in which case, gasket 1087 may be removed after the concrete is cured).

In the illustrated embodiment of FIG. 14A-14D, form-retainers 1041 comprise a pair of fastener-receiving features (e.g. curves) 1043 and a single form-engaging feature 1045. This is not necessary. In some embodiments, form-retainers 1041 may be provided with as few as a single fastener-receiving feature 1043 and/or as few as a single form-engaging feature 1045. In other embodiments, form-retainers 1041 may be provided with more than two fastener-receiving features 1043 and/or a plurality of form-engaging features 1045.

Edge formwork components 82 and transverse edge formwork components may be mounted to structure 310 in a manner similar to that described above. In embodiments where edge formwork components 82 and transverse edge formwork components 321 are going to be removed from structure 310 after the concrete cures in space 1054, it may be desirable to mount edge formwork components 82 and transverse edge formwork components 321 using adhesive and/or a relatively small number of penetrative fasteners (i.e. to avoid creating holes in structure 310). Once apparatus 1020 is assembled, concrete may be introduced into space 1054. Apparatus 1020 remains in place until the concrete solidifies, after which bracing 1081, edge formwork components 82 and transverse edge formwork components 321 may be removed. After the removal of bracing 1081, it may be desirable to remove the portions of faun-retainers 1041 that project outwardly from the cured concrete. This may be done using a hammer or the like to break away such portions of form-retainers 1041. In some embodiments, faun-retainers 1041 may be "pre-weakened" (e.g. by providing a thin cross-section) one or more regions where it is expected that they will be broken off. In some embodiments, where penetrative fasteners are used to mount edge formwork components 82 and/or transverse edge formwork components 321, holes resulting from removal of such fasteners may be spot filled with concrete or other suitable filler materials.

In the usage of apparatus 1020 described above, form-retainers 1041 are first mounted to structure 310 using fasteners 1047 and then bracing 1081 is mounted to retainers 1041 using keys 1085. This order of assembly is not necessary. In some embodiments, form-retainers 1041 may first be coupled to bracing 1081 using keys 1085. Bracing 1081 may be provided with suitably located tool-access holes (not shown) through which a fastener-driving tool may extend to penetrate through bracing 1081 and to permit form-retainers 1041 to be subsequently coupled to structure 310 using fasteners 1047. Gasket 1087 may be sized and/or shaped to cover such tool access holes. For example, gasket 1087 may be resiliently deformable to permit a tool to extend through the tool access holes, but may restore itself back into shape to cover the tool access holes after the mounting of form-retainers 1041 to structure 310.

In other embodiments, fastener-receiving features 1043 and form-engaging features 1045 could have other shapes. For example, in the illustrated embodiment, form-engaging features 1045 are bent toward one another between form-engaging curves 1045A and shoulders 1045B. In other embodiments, form-engaging features could be generally parallel between form-engaging curves 1045A and shoulders 1045B to permit greater adjustability in the thickness of bracing 1081. In other embodiments, fastener-receiving features 1043 and form-engaging features 1045 may be provided by other constructions. For example, fastener-receiving features 1043 and/or form-engaging features 1045 could comprise separate components that are coupled to a main form-retainer component where it is desirable to locate a fastener 1047 or to engage bracing 1081.

In another example, portions of form-engaging curves 1045A which extend to an exterior of bracing 1081 could be bent upward at their exterior ends and apertures 1083 could be sufficiently large to accommodate such form-engaging curves 1045A. This shape would permit bracing 1081 to "hang" on form-engaging curves 1045A without sliding off. Also, bracing 1081 could be coupled to form-retainers 1041 by screwing, bolting or otherwise extending fasteners (from an exterior of bracing 1081) through the upward bends in form-engaging curves 1045A and into or through bracing 1081. Since bracing 1081 could be coupled to form-engaging curves 1045A from the outside, this construction could omit shoulders 1045B. Shoulders 1045B could be omitted in other embodiments. Omitting shoulders 1045B could permit form-retainers 1041 to be extended through apertures 1083 prior to being mounted to structure 310 and permit bracing 1081 to be initially placed in an abutting relationship with structure 310, so that fasteners may be used to secure form-retainers 1041 to structure 1041 through suitable tool access holes (not shown). If bracing 1081 was placed in an abutting relationship with structure 310 during mounting of form-retainers 1041, form-retainers 1041 and apertures 1083 would be effectively aligned with one another and there would be no need for prior or subsequent alignment thereof. In such embodiments, threaded screws, bolts or the like could be used to pull bracing 1081 away from structure 310. Such threaded screws, bolts or the like could push off of structure 310 and be threaded through bracing 1081.

Figure 15C:
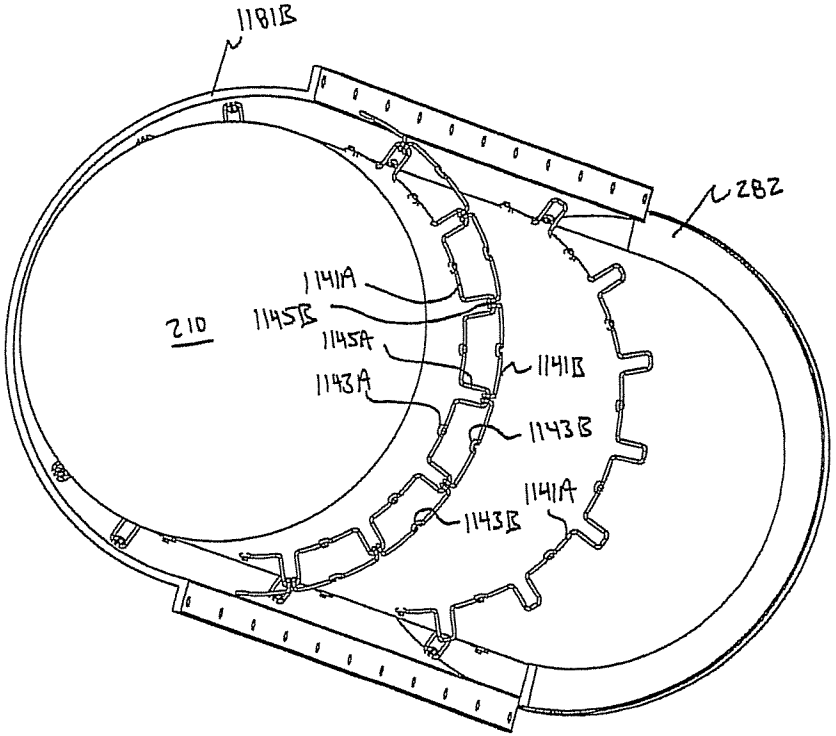
FIGS. 15B and 15C are respectively partial isometric and partially cutaway isometric views of the FIG. 15A apparatus.
Figure 15B:
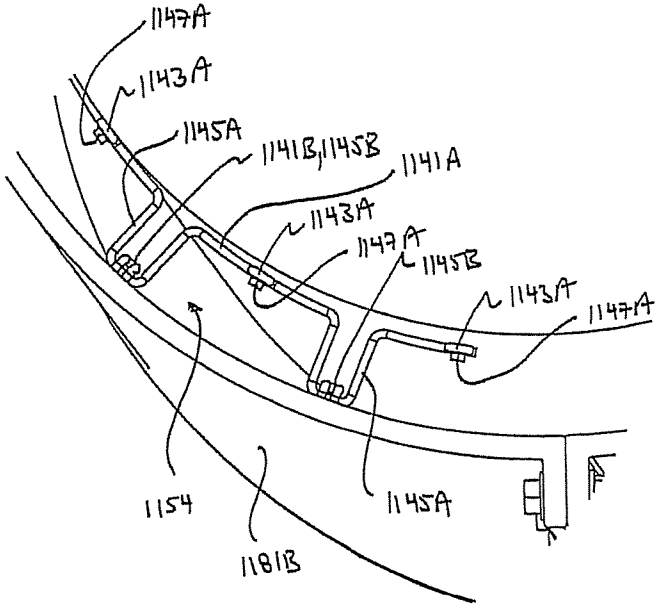

FIGS. 15A-15C depict various views of an apparatus 1120 for repairing a curved structure 210 (FIG. 5A) according to yet another embodiment. In the illustrated embodiment, apparatus 1120 comprises bracing components 1181A, 1181B (collectively, bracing components 1181), edge formwork components 282 and form-retaining assemblies 1141 for retaining bracing components 1181 to structure 210.

Bracing components 1181 of the illustrated embodiment are stay-in-place bracing components 1181, which remain in place after concrete cures in space 1154 between bracing components 1181 and structure 210. In other embodiments, bracing components 1181 could be temporary bracing components 1181 similar to bracing components 1081 (of apparatus 1120 (FIGS. 14A-14B)) which may be removed after concrete cures in space 1154. Bracing components 1181 may be fabricated from any suitable materials, such as, by way of non-limiting example, wood, suitable plastics, fiberglass, metals, alloys, polymers or other suitable material(s). Bracing components 1181 of the illustrated embodiment may have curved shapes to conform with the general shape of structure 210 and to provide the resultant structure with a similarly curved shape. In other embodiments, bracing components 1181 may differ in shape to conform with the structure to be repaired or to the desired shape of the resultant structure. Also, the number of bracing components 1181 in the illustrated embodiment is two, but this is not necessary. Other embodiments may be provided with different numbers of bracing components 1181. In some embodiments, bracing components 1181 are shaped to be nestable in one another to facilitate efficient storage and/or transport. In some embodiments, bracing components 1181 may be replaced with a suitable number of panels of the type described herein. Such panels may, but need not necessarily, comprise direct panel-to-panel connections of the type shown in apparatus 120 (FIG. 4) or 420" (FIG. 8D).

Edge formwork components 282 may be substantially similar to edge formwork components 282 described above for apparatus 220 (FIG. 5B), except that in some embodiments, edge formwork components 282 may be removable. In embodiments which incorporate removable edge formwork components 282, it may be desirable to mount edge formwork components 282 using adhesive or a relatively small number of penetrative fasteners (i.e. to avoid creating holes or indents in structure 210).

Form-retaining assemblies 1141 of the illustrated embodiment each comprise a first form-retaining component 1141A which is mounted to structure 210 and a second form-retaining component 1141B which is mounted to, or integrally formed with, bracing components 1181. First and second faun-retaining components 1141A, 1141B engage one another to couple bracing components 1181 to structure 210, so that liquid concrete may be introduced to space 1154. In the illustrated embodiment, form-retaining components 1141A, 1141B comprise elongated curved rods fabricated from suitable material(s) (e.g. suitably strong plastic, fiberglass, metallic alloys, polymeric materials, carbon fiber materials or the like).

First form-retaining component 1141A may comprise one or more fastener-receiving features 1143A and one or more connector components 1145A. In the illustrated embodiment, first form-retaining components 1141A are bent or otherwise fabricated such that fastener-receiving features 1143A comprise fastener-receiving curves 1143A and connector components 1145A comprise U-shaped features 1145A. In other embodiments, fastener-receiving features 1143A and connector components 1145A may be provided by other constructions capable of performing the functions described herein.

Second form-retaining component 1141B may comprise one or more fastener-receiving features 1143B and one or more connector components 1145B. In the illustrated embodiment, second form-retaining components 1141B are bent or otherwise fabricated such that fastener-receiving features 1143B comprise fastener-receiving curves 1143B and connector components 1145B comprise hooks 1145B. In other embodiments, fastener-receiving features 1143B and connector components 1145B may be provided by other constructions capable of performing the functions described herein.

In operation, first form-retaining components 1141A are placed against structure 210 such that at least some of fastener-receiving curves 1143A abut against structure 210. First form-retaining components 1141A are then mounted to structure 210 at desired locations using fasteners 1147A which project through, or otherwise engage, fastener-receiving curves 1143A and project into structure 210. Fasteners 1147A may have features similar to fasteners 643 described above. The type of fasteners 1147A used to fasten first form-retaining components 1141A to structure 210 may depend on the type of material used to fabricate structure 210 as described above (e.g. for fasteners 643).

At a suitable time (which may precede or occur subsequent to the mounting of first form-retaining components 1141A to structure 210), second form-retaining components 1141B are coupled to bracing components 1181. Second form-retaining components 1141B may be coupled to bracing components 1181 using suitable fasteners (not shown) which may project through, or otherwise engage, fastener-receiving curves 1143B and project into, or through, bracing components 1181. Such fasteners may include suitable nuts and bolts (e.g. hex-head bolts or carriage bolts). In other embodiments, other techniques (e.g. suitable adhesives, welding or the like) may be to couple second form-retaining components 1141B to bracing components 1181. In some embodiments, as discussed above, second form-retaining components 1141B may be integrally formed with bracing components 1181, in which case mounting is not required.

Bracing components 1181 are then mounted to structure 210, by coupling connector components 1145A to connector components 1145B. In the illustrated embodiment, this involves engaging hooks 1145E of second form-retaining components 1141B with U-shaped features 1145A of first form-retaining components 1141A. In the illustrated embodiment, bracing components 1181 may also be coupled to one another using suitable fasteners 1183 which may project through abuttingly mating flanges 1185A, 1185B (collectively, flanges 1185). In other embodiments, flanges 1185 may be coupled to one another using other techniques, such as by using suitable adhesives, welding or the like. Flanges 1185 and the coupling of flanges 1185 to one another are not necessary. In other embodiments, the coupling of bracing components 1181 to structure 210 is accomplished using only the coupling of first and second form-retaining components 1141A, 1141B (e.g. via connector components 1145A, 1145B) or using some other form of coupling as between bracing components 1181 (e.g. complementary male and female coupling components similar to those of the panel-to-panel connections in apparatus 120 (FIG. 4) or apparatus 420" (FIG. 8D) described above or to those of apparatus 1220 described below) in addition to or in the alternative to flanges 1185. Such additional or alternative couplings may be reinforced using suitable fasteners or other techniques, such as suitable adhesives, welding or the like. In the illustrated embodiment, abutting flanges 1185 extend outwardly. In some alternative embodiments, abutting flanges may extend inwardly.

Edge formwork components 282 may be mounted to structure 210 in a manner similar to that described above. Once apparatus 1120 is assembled, concrete may be introduced into space 1154. Apparatus 1120 of the illustrated embodiment remains in place after the concrete solidifies. However, in some embodiments, bracing components 1181 may be coupled to one another without form retaining assemblies 1141 in which case bracing components 1181 and edge formwork components 282 may continue to stay in place or may be removed after the concrete solidifies. In some embodiments, where penetrative fasteners are used to mount edge formwork components 282 which are subsequently removed, the holes resulting from removal of such fasteners may be spot filled with concrete or other suitable filler materials.

In the illustrated embodiment of FIG. 15A-15C, form-retaining components 1141A, 1141B comprise a plurality of fastener-receiving features (e.g. curves) 1143A, 1143B and a plurality of connector components 1145A, 1145B. This is not necessary. In some embodiments, form-retaining components 1141A, 1141B may be provided with as few as a single fastener-receiving feature 1143, 1143B and/or as few as a single connector component 1145A, 1145B. In one particular embodiment, form-retainer components 1141A, 1141B each comprise a pair of fastener-receiving features 1143A, 1143B and a single connector component 1145A, 1145B. In some embodiments, form-retaining components 1141A, 1141B are not necessary and the coupling of bracing components 1181 (e.g. at flanges 1185 or at other suitable connector components) may be sufficient to brace apparatus 1120.

Figure 16A:
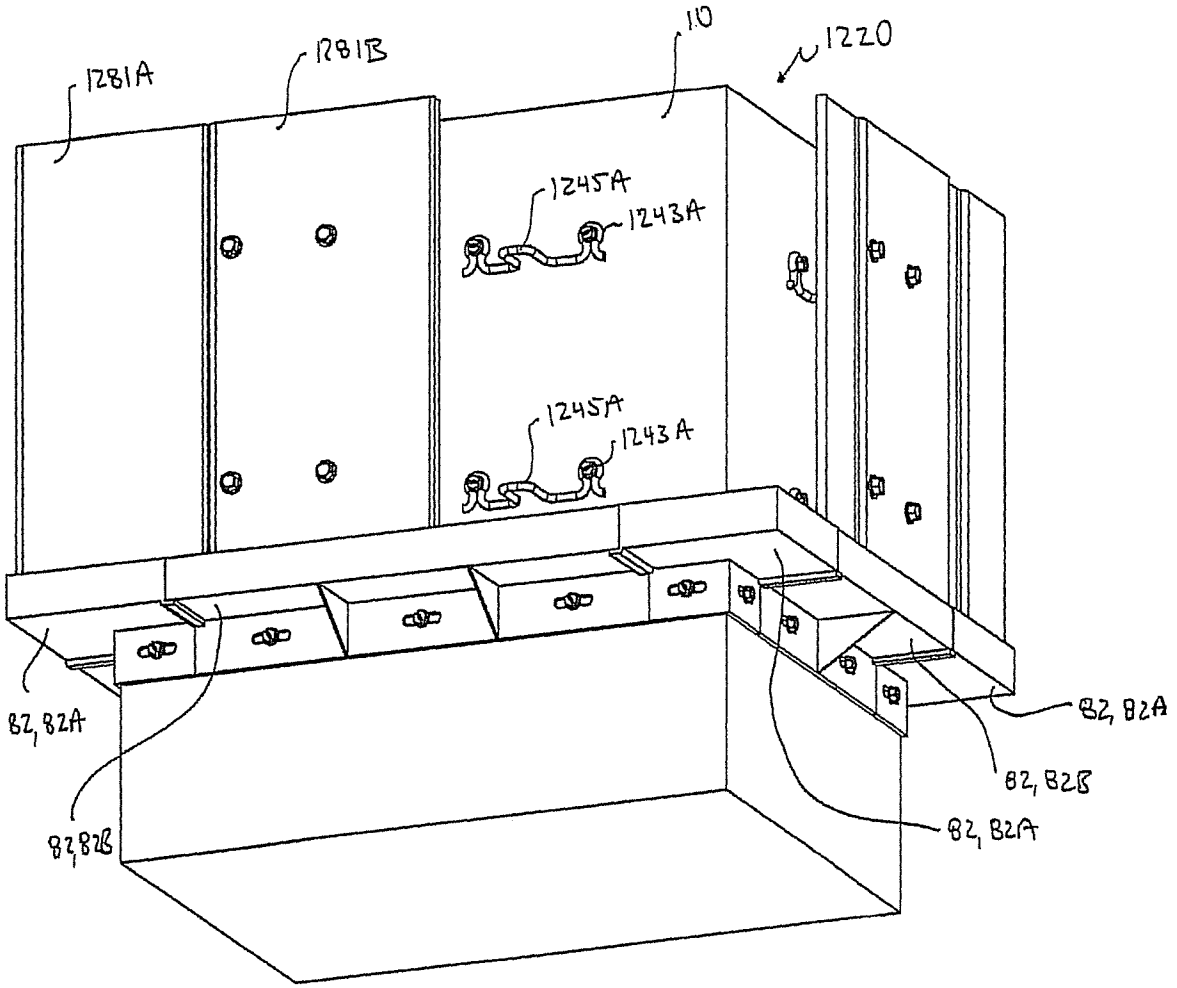
FIG. 16A is a partially cut-away isometric view of an apparatus for repairing the FIG. 1 structure according to another embodiment.
Figures 16B, 16C:
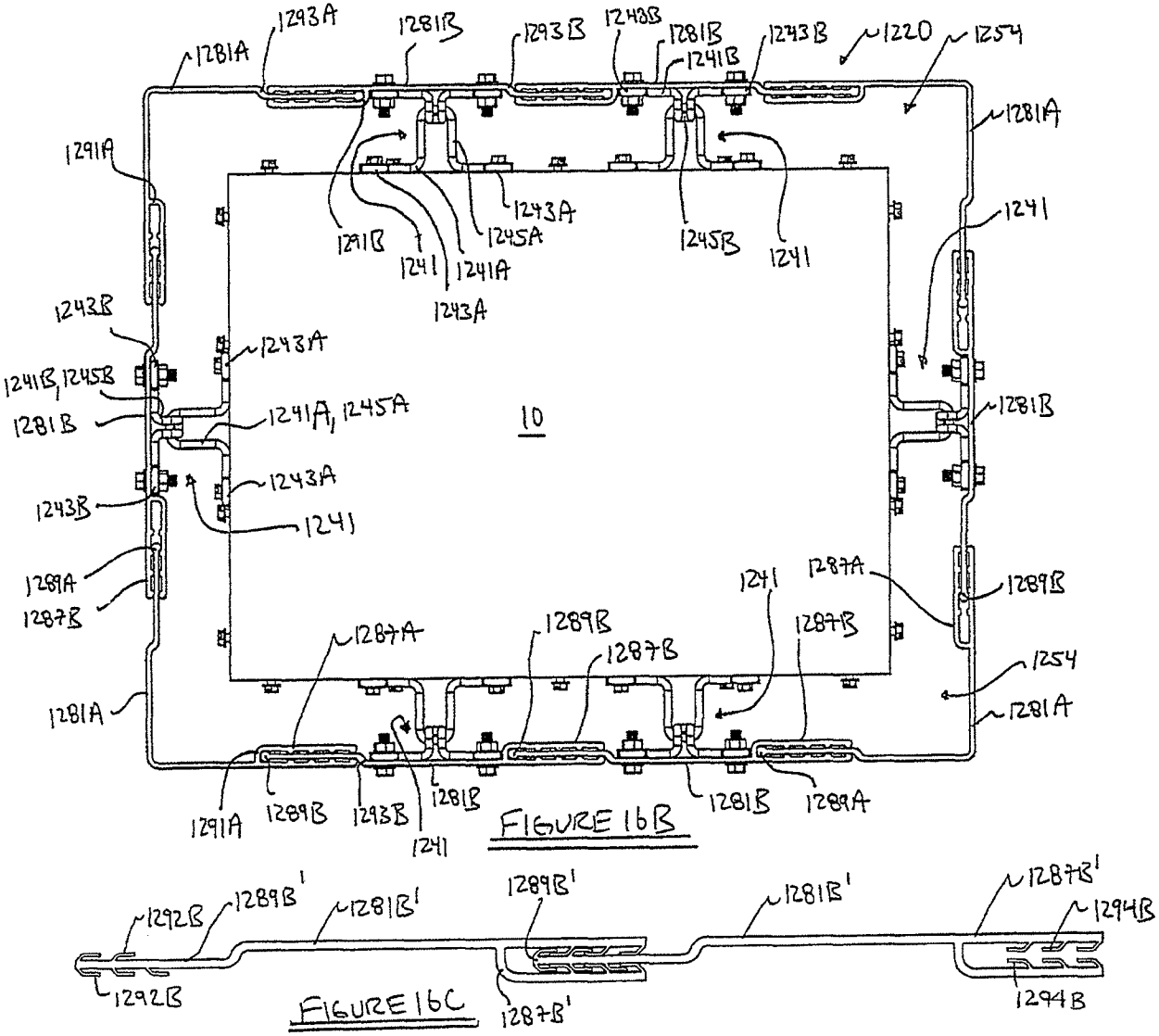
FIG. 16B is a top view of the FIG. 16A apparatus.
FIG. 16C shows a top view of a different bracing component which may be used in conjunction with a modified version of the FIG. 16A apparatus.
Figure 17A:
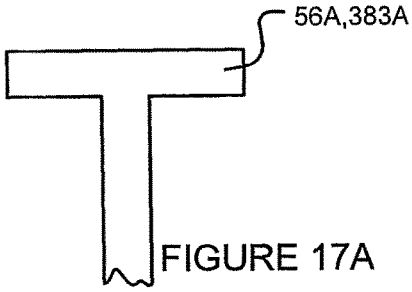
FIGS. 17A-17H show schematic plan views of heads for standoffs which may be used in various embodiments.
Figure 17B:
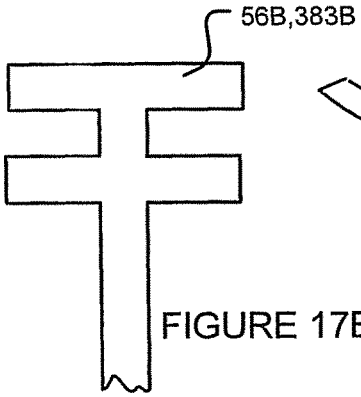
Figure 17C:
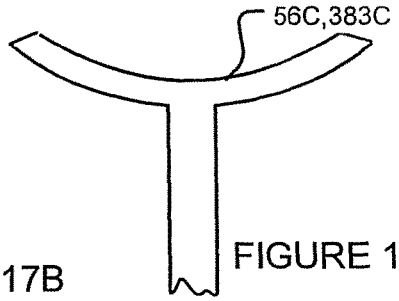
Figure 17D:
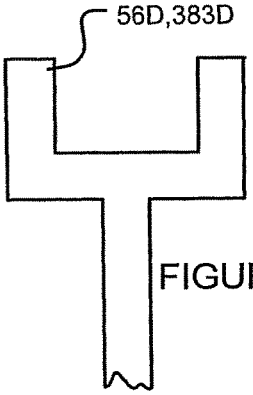
Figure 17E:
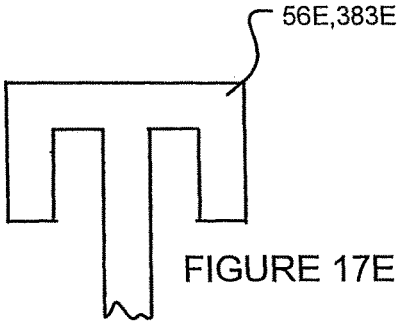
Figure 17F:
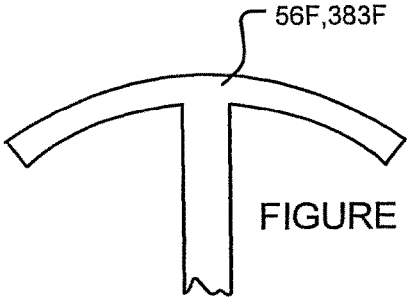
Figure 17G:
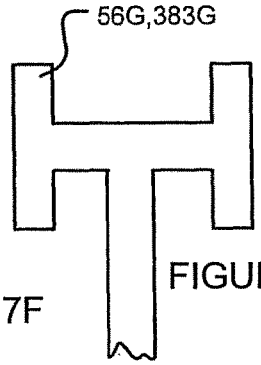
Figure 17H:
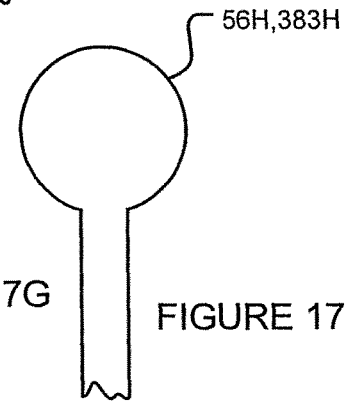

FIGS. 16A-16B depict various views of an apparatus 1220 for repairing a structure 10 (FIG. 1) having a generally rectangular cross-section according to yet another embodiment. Apparatus 1220 is similar in some respects to apparatus 1120 (FIGS. 15A-15C), except that apparatus 1220 is used to repair rectangular cross-sectioned structure 10. Apparatus 1220 comprises bracing components 1281A, 1281B (collectively bracing components 1281), edge formwork components 82A, 82B (collectively edge formwork components 82) and form-retaining assemblies 1241 for retaining bracing components 1281 to structure 10.

In the illustrated embodiment, apparatus 1220 comprises corner bracing components 1281A and generally flat bracing components 1281B which are respectively disposed adjacent to the corners and sides of structure 10. In the illustrated embodiment, two sides of apparatus 1220 comprise two flat bracing components 1281B and the other two sides of apparatus 1220 comprise a single flat bracing component 1281B. Depending on the relative sizes of the sides of generally rectangular structure 10 and/or of the desired structure (i.e. after repair), the number of side bracing components 1281B may vary between zero and any suitable number. In addition, side bracing components 1281B may be provided with modular sizing (e.g. 1, 2, 4, 6, 8, 12 and 16 inches in length) to fit various sizes of rectangular structure. Bracing components 1281 share many characteristics of bracing components 1181 described above for apparatus 1120. Bracing components 1281 differ from bracing components 1181 because of their cornered and flat shapes (as opposed to curved shape of bracing components 1181). Bracing components 1281 also differ from bracing components 1181 because bracing components 1281 comprise male connector components 1289A, 1289B on one of their edges and female connector components 1287A, 1287B on their opposing edges which engage one another and are used as alternatives to abutting flanges 1185 of bracing components 1181 as explained in more detail below. In still other embodiments, bracing components 1281 may be replaced with a suitable number of panels of the type described herein. Such panels may, but need not necessarily, comprise direct panel-to-panel connections of the type shown in apparatus 120 (FIG. 4) or 420" (FIG. 8D).

Edge formwork components 82A, 82B comprise corner edge formwork components 82A and generally straight edge formwork components 82B and may be substantially similar to edge formwork components 82 described above for apparatus 20 (FIG. 2A).

Form-retaining assemblies 1241 each comprise a first form-retaining component 1241A which is mounted to structure 10 and a second form-retaining component 1241B which is mounted to, or integrally formed with, bracing components 1281. First and second form-retaining components 1241A, 1241B engage one another to couple bracing components 1281 to structure 10, so that liquid concrete may be introduced into space 1254. In the illustrated embodiment, form-retaining assemblies 1241 are only used in association with generally flat bracing components 1281B—i.e. second form-retaining components 1241B are only mounted to generally flat bracing components 1281B. This is not necessary. In other embodiments, form-retaining assemblies 1241 may also be used in association with corner bracing components 1281A. First and second form-retaining components 1241A, 1241B are similar to and share many characteristics with first and second form-retaining components 1141A, 1141B of apparatus 1120. By way of non-limiting example, first form-retaining components 1241A comprise one or more fastener-receiving features 1243A and one or more connector components 1245A which may be similar to fastener-receiving features 1143A and connector components 1145A and second form-retaining components 1241B comprise one or more fastener-receiving features 1243B and one or more connector components 1245B which may be similar to fastener-receiving features 1143B and connector components 1145B. Form-retaining components 1241A, 1241B may differ from form-retaining components 1141A, 1141B of apparatus 1120 in that the shape of form-retaining components 1241A, 1241B may conform with the flat shape of structure 10 rather than the curved shape of structure 210.

Use of apparatus 1220 may be similar to use of apparatus 1120 and may involve mounting first form-retaining components 1241A to structure 10, coupling second form-retaining components 1241B to bracing components 1281 and mounting bracing components 1281 to structure 10 (e.g. by coupling connector components 1245A to connector components 1245B). In some embodiments, bracing components 1281 may additionally or alternatively be coupled to one another by coupling corresponding male connector components 1289A, 1289B into corresponding female connector components 1287A, 1287B. In the illustrated embodiment, female connector components 1287A, 1287B comprise several projections (not specifically enumerated) which project transversely into female connector components 1287A, 1287B and male connector components 1289A, 1289B comprise a thickened section (not specifically enumerated) to provide an adjustable "snap together" fitting which provides some adjustability to the location of male connector components 1289A, 1289B within female connector components 1287A, 1287B and to the corresponding dimensions of the shape defined by bracing components 1281A, 1281B. The connection of male connector components 1289A, 1289B and female connector components 1287A, 1287B may be augmented or otherwise reinforced by other techniques, such as by suitable fasteners, suitable adhesives, welding or the like. In some embodiments, a shim or the like may be inserted into female connector components 1287A, 1287B for preventing accidental over-extension of male connector components 1289A, 1289B into female connector components 1287A, 1287B. Male connector components 1289A, 1289B and female connector components 1287A, 1287B are not required. In some embodiments, bracing components 1281A, 1281B may comprise other interconnection features (e.g. flanges similar to flanges 1185A, 1185B of apparatus 1120 or complementary male and female coupling components similar to those of the panel-to-panel connections in apparatus 120 (FIG. 4) or apparatus 420" (FIG. 8D) described above) or bracing components 1281A, 1281B need not be connected to one another.

FIG. 16C shows a pair of alternative bracing components 12818' which may be used in the place of bracing components 1281B of apparatus 1220. Bracing components 1281W differ from bracing components 1281B in that male connector components 1289W and female connector components 1287W comprise hook features 1292B, 1294B which work together to permit male connector component 1289W to be inserted (one-way) into female connector component 1287W, but which prevent male connector component 1289W from being withdrawn (in the opposing direction) from female connector component 1287W. It will be appreciated that corner bracing components could be provided with hook features similar to those of bracing components 1281B' shown in FIG. 16C.

Edge formwork components 82 may be mounted to structure 10 in a manner similar to that described above. Once apparatus 1220 is assembled, concrete may be introduced into space 1254. Apparatus 1220 of the illustrated embodiment remains in place after the concrete solidifies. However, in some embodiments, bracing components 1281 may be coupled to one another without form retaining assemblies 1241 in which case bracing components 1281 and edge formwork components 82 may continue to stay in place or may be removed after the concrete solidifies. In some embodiments, where penetrative fasteners are used to mount edge formwork components 82 which are subsequently removed, the holes resulting from removal of such fasteners may be spot filled with concrete or other suitable filler materials.

In the illustrated embodiment, form-retaining components 1241B are coupled to bracing components 1281B using fasteners which project through fastener-receiving components 1243B and through bracing components 1281B. In some embodiments, it may be desirable to provide apparatus 1220 with a generally smooth exterior profile. In such embodiments, the connection of form-retaining components 1241B to bracing components 1281B (or to bracing components 1281A) may be accomplished using smooth-headed fasteners (e.g. carriage bolts) or using fasteners that do not project through to the exterior of bracing components 1281B—e.g. by non-penetrating fasteners. In such embodiments, form-retaining components 1241B could also be coupled to bracing components 1281B using other suitable techniques, such as by use of suitable adhesives, by welding, by integral formation of bracing components 1281A, 1281E and form-retaining components 1241B or the like.

In the illustrated embodiment, bracing components 1281A, 1281B bend inwardly (at bends 1291A, 1293A (in corner bracing components 1281A) and at bends 1291B, 1293B (in flat bracing components 1281B) in regions of female connector components 1287A, 1287B and male connector components 1289A, 1289B. These bends provide apparatus 1220 with a generally flattened profile but are not necessary. In some embodiments, these bends 1291A, 1291B, 1293A, 1293B may be omitted or replaced by similarly functioning outward bends.

Apparatus 1020, 1120 and 1220 of FIGS. 14A-14B, 15A-15C and 16A-16B respectively depict bracing 1081, 1181 and 1281 which is retained to a generally flat surface 310, a curved structure 210 and a rectangular cross-sectioned structure 10 using form retainers 1041, 1141 and 1241. As discussed above, since many structures and surfaces comprise various combinations of these structures and surfaces, it will be appreciated by those skilled in the art that with various modifications, apparatus similar to the apparatus described herein may be used to repair structures having virtually any shape and/or surface profile.

As will be apparent to those skilled in the art in the light of the foregoing disclosure, many alterations and modifications are possible in the practice of this invention without departing from the spirit or scope thereof. For example:

- Methods and apparatus described herein are disclosed to involve the use of concrete to repair various structures. It should be understood by those skilled in the art that in other embodiments, other curable materials could be used in addition to or as an alternative to concrete. By way of non-limiting example, apparatus 20 (FIGS. 2A, 2B) could be used to contain a structural curable material similar to concrete or some other curable material (e.g. curable foam insulation, curable protective material or the like), which may be introduced into space 54 when the material was in liquid form and then allowed to cure to repair structure 10.
- Many of the structures described above may have uneven surfaces (e.g. due to age, corrosion, some other form of damage or the like). For example, damaged section 10B of structure 10 is uneven and includes a portion 12 through which rebar 14 is exposed. Many of the apparatus described herein involve mounting components or fasteners to the uneven surfaces of such structures. It will be appreciated by those skilled in the art that suitable spacers, shims or the like may be used to space such components or fasteners apart from the uneven surfaces of such structures as desired. Such spacers, shims or the like, which may be fabricated from any suitable material including metal alloys, suitable plastics, other polymers, wood composite materials or the like, may effectively flatten the surface to which such components or fasteners are mounted.
- In the illustrated embodiments, standoffs 24, 624 all have the same standoff depth (e.g. standoffs 24, 624 of the illustrated embodiments extend away form their corresponding objects and/or their standoff retainers and/or their corresponding panels by the same amount). This is not necessary. In general, standoffs 24, 624 may have different standoff depths which may depend on the application. For example, standoffs 24, 624 may be provided in standard sizes—e.g. 1", 2", 3", 4", 6", 8", 12" or the like. In some embodiments, standoffs 24, 624 may be provided with different standoff depths within a particular apparatus.
- It will be understood that directional words (e.g. vertical, horizontal and the like) are used herein for the purposes of description of the illustrated exemplary applications and embodiments. However, the methods and apparatus described herein are not limited to particular directions or orientations and may be used for repairing structures having different orientations. As such, the directional words used herein to describe the methods and apparatus of the invention will be understood by those skilled in the art to have a general meaning which is not strictly limited and which may change depending on the particular application. By way of non-limiting example, panels 22 of apparatus 20 are shown to be oriented such that their longitudinal dimensions 42 are generally aligned with the vertical direction 36 (see FIG. 2A). This is not necessary and in other embodiments longitudinal dimension 42 may generally have any desired orientation.

In some of the illustrated examples, components (e.g. panels 22, 122, standoffs 24, optional braces 30 and other similar components described herein) are uniform in cross-section along their longitudinal dimensions 42. This is not necessary. A non-limiting example of this is standoff retainer 641 which is provided with notch 655 (FIG. 10C). As another non-limiting example, connector components 32, 46, 50 of panels 22 and connector components 135, 137, 46, 50 of panels 122 may be provided in one or more connector component portions which have extensions in longitudinal direction 42 which are less than the extension of panels 22, 122.

In the apparatus described above, a number of connector components are described as being slidable connector components having various shapes. Non-limiting examples of such connector components from the embodiments described above include: connector components 34 of standoffs 24; connector components 32, 46, 50 of panels 22; connector components 48 of corner panels 22C; connector components 52 of braces 30; connector components 135, 137, 146 of panels 120; connector components 329, 331 of transverse edge formwork components 321; connector components 426 of anchor components 424; connector components 651 of standoff retainers 641; connector components 634, 639 of standoffs 624; connector components 672 of standoff retainers 670; and the like. It will be appreciated that connector components having other suitably complementary male and female shapes may be used in the place of any of these connector components. Further, connector components according to various embodiments may engage one another using techniques other than sliding (e.g. deformation of portions of the connector components, pivotal motion, "snap-together" connections which take advantage of restorative deformation forces or the like). Connector components 453, 455 of apparatus 420" (FIG. 8D) represent a particular example of connector components which engage one another (at least in part) by pivotal motion and deformation of portions of the connector components. Further, any of the connector components or similar features described herein as being male or female may be suitably modified to reverse the male/female nature of the connector components—e.g. standoff connector components can be female and standoff retainer connector components can be male or vice versa.

Standoffs 24 described above are provided with heads 56 which are shown, for example, in FIGS. 2B and 2C. Heads 56 may be provided with other shapes. In currently preferred embodiments, the shape of heads 56 extends transversely from standoffs 24 (e.g. in the directions of widths 44 of panels 22) and in the longitudinal direction 42. Such shaped may provide surfaces for engaging structures. Non-limiting examples for shapes of heads 56A-56H (collectively, heads 56) are shown in FIGS. 17A-17H, in which the longitudinal direction 42 is into and out of the page. As shown in FIGS. 17A-17H, heads 56 may extend in transverse directions and in the longitudinal direction (i.e. in and out of the page in the illustrated view of FIGS. 17A-17H).

The apparatus described herein are not limited to repairing concrete structures. By way of non-limiting example, apparatus described herein may be used to repair structures comprising concrete, brick, masonry material, wood, metal, steel, other structural materials or the like. One particular and non-limiting example of a metal or steel object that may be repaired in accordance various embodiments described herein is a street lamp post, which may degrade because of exposure to salts and/or other chemicals used to melt ice and snow in cold winter climates.

Strapping systems 533 and 770 described above in connection with apparatus 520 (FIGS. 9A, 9B) and apparatus 720 (FIGS. 11A, 11B) represent two non-limiting examples of strapping systems suitable for use in the context of such embodiments. It will be appreciated by those skilled in the art that any variety of strapping systems could be used in the place of strapping systems 533, 770 to achieve similar functionality. For example, strapping system 533 could be used with apparatus 720 and strapping system 770 could be used with apparatus 520. The invention should be understood to include any suitable strapping system capable of performing the functions described herein.

Strapping system 533 described above is applied on the exterior of apparatus 520 (i.e. on the exterior of panels 22) to strap apparatus 520 to structure 10 (see FIGS. 9A, 9B). Strapping system 770 described above is applied on an exterior of standoff retainers 641 to strap standoff retainers 641 to structure 210 (see FIGS. 11A, 11B). The other components of apparatus 720 are connected directly or indirectly to standoff retainers 641. In apparatus according to other embodiments, strapping systems may extend through apertures in standoffs (e.g. apertures 58 in standoffs 24 and/or apertures 667 in standoffs 624) to strap standoffs 24, 624 to their associated structures. The other components of such apparatus may then be connected directly or indirectly to standoffs 24, 624. Strapping systems that extend through apertures 58, 667 in standoffs 24, 624 may therefore be used in any of the embodiments described herein which incorporate such standoffs.

In some applications, corrosion (e.g. corrosion of rebar) is a factor in the degradation of the existing structure. In such applications, apparatus according to various embodiments of the invention may incorporate corrosion control components such as those manufactured and provided by Vector Corrosion Technologies, Inc. of Winnipeg, Manitoba, Canada and described at www.vector-corrosion.com. As a non-limiting example, such corrosion control components may comprise anodic units which may comprise zinc and which may be mounted to (or otherwise connected to) existing rebar in the existing structure and/or to new rebar introduced by the repair, reinforcement, restoration and/or protection marketed by Vector Corrosion Technologies, Inc. under the brand name Galvanode®. Other corrosion control systems, such as impressed current cathodic protection (ICCP) systems, electrochemical chloride extraction systems and/or electrochemical re-alkalization systems could also be used in conjunction with the apparatus of this invention. Additionally or alternatively, anti-corrosion additives may be added to concrete or other curable materials used to fabricate repair structures in accordance with particular embodiments of the invention.

Panels, standoffs, braces, standoff retainers, anchoring components, form retainers, edge formwork components, transverse edge formwork components, inside corner connector components and/or bracing components of the various embodiments described herein may be fabricated from or may comprise any suitable materials, including, without limitation, various plastics, other suitable polymeric materials, fiberglass, metals, metal alloys, carbon fiber material or the like and may be fabricated using extrusion, injection molding or any other suitable technique. The longitudinal dimensions 42 (see FIG. 2A) of many of these components may be fabricated to have desired lengths or may be cut to desired lengths.

Anchor components similar to anchoring components 424 of apparatus 420' may be used many of the other embodiments described herein to help anchor their respective panels to the concrete in the repair structure. In particular embodiments, such anchoring components could be used in addition to or in the alternative to standoffs 24, 624. By way of non-limiting example, connector components 426 of anchor components 424 may engage some of interior connector components 46 of panels 22 or edge connector components 32 of panels 22 while connector components 34, 634 of standoffs 24, 624 could engage others of interior connector components 46 of panels 22 or edge connector components 32 of panels 22. In a similar manner, apparatus 420" may be modified to include one or more standoffs 24 and/or standoffs 624 and standoff retainers 641 in addition to its anchoring components 424. The provision of standoffs 24, 624 for apparatus 420" may allow apparatus 420" to incorporate rebar which may extend through the apertures 58, 667 of the standoffs 24, 624.

Methods are described herein for using the apparatus of the various embodiments of the invention. Those skilled in the art will appreciate that in many circumstances the order of the steps involved in using the apparatus described herein may be modified. By way of non-limiting example, edge formwork components 82 (FIG. 3F) may be mounted prior to one or more of the other steps associated with using apparatus 20. Where edge formwork components 82 are on a lower edge of apparatus 20, mounting edge formwork components 82 prior to mounting the other components of apparatus 20 may provide a ledge for supporting tools, other components of apparatus 20 or even, in some applications, workers and/or equipment. It may be similarly advantageous to mount edge formwork components of other embodiments prior to mounting other components of the various apparatus. In another non-limiting example, transverse edge formwork components 321 of apparatus 320 may be mounted prior to one or more of the other steps associated with using apparatus 320. In general, the invention should be understood to incorporate variations in the order of the steps involved in the methods described herein.

Some embodiments described above comprise standoff retainers and/or form retainers comprising curved rods. In other embodiments, the features of such standoff retainers and/or form retainers could be provided by components other than elongated rods. For example such curved rod standoff retainers and/or form retainers could be provided by extruded and/or injection molded components having other constructions. By way of non-limiting example, standoff retainers 941 of apparatus 920 (FIGS. 13A-13C) comprise mounting features 943 and standoff retaining features 945. Mounting features 943 could be provided by a mounting flange with optional apertures for projecting fasteners therethrough and standoff retaining features 945 could be provided by cut-outs, punch-outs or the like similar to engaging features 1351 of apparatus 1320 (FIGS. 19A-19C).

As discussed above, the various embodiments described herein are applied to provide repair structures for existing structures that have particular shapes. In general, however, the shapes of the existing structures described herein are meant to be exemplary in nature and the methods and apparatus of various embodiments may be used with existing structures having virtually any shape.

Many of the embodiments described herein use edge-connecting standoffs and/or edge-connecting anchoring components to connect edge-adjacent panels. However, panels may also be connected directly to one another to provide panel-to-panel connections, as described, for example, in apparatus 120 (FIG. 4), apparatus 420" (FIG. 8D), apparatus 1120 (FIG. 15A) and 1220 (FIG. 16B). Any of the embodiments which make use of edge-connecting standoffs and/or edge-connecting anchoring components to connect edge-adjacent panels may be modified to provide panel-to-panel connections wherein edge adjacent panels connect directly to one another.

Some of the embodiments described herein make use of rebar to provide strength to the repair structure. In some of these embodiments, the rebar is shown as extending generally in the width direction 44 and may extend through apertures in the standoffs (see FIG. 2A, for example). In some embodiments, it may also be desirable to provide rebar which extends in longitudinal directions 42. In such embodiments, the longitudinally extending rebar may be fastened (e.g. by tie strap and/or wire wrap connections) to the transversely extending rebaer).

Figure 18A:
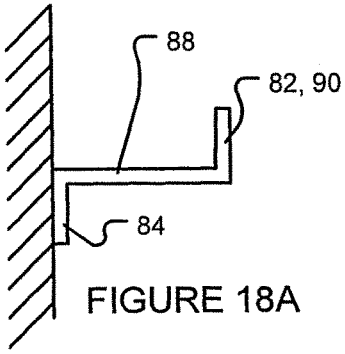
FIG. 18A is a cross-sectional view of the edge formwork component of the FIG. 2A apparatus and FIGS. 18B and 18C are alternative cross-sectional edge formwork component profiles suitable for use with the FIG. 2A apparatus.
Figure 18B:
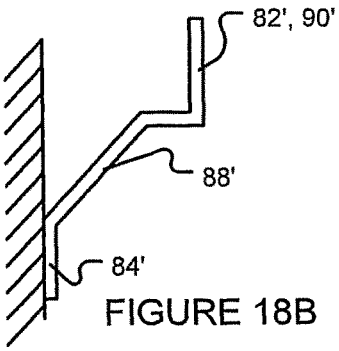
Figure 18C:
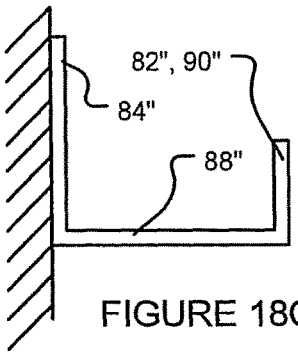

Edge formworks 82, 282, 882 of the illustrated embodiments have a particular cross-section. The particular cross-section of edge formwork component 82 is shown in FIG. 18A which shows mounting flange 84, edge component 88 and overlap flange 90. In other embodiments, edge formwork components could be provided with other cross-sectional shapes. Non-limiting examples of suitable cross-sectional shapes are shown in FIGS. 18B and 18C. FIG. 18B shows an edge formwork component 82' comprising a mounting flange 84', edge component 88' and overlap flange 90' and FIG. 18C shows an edge formwork component 82" comprising a mounting flange 84", edge component 88" and overlap flange 90". Other non-limiting examples of suitable cross-sectional shapes for edge formwork components include those of edge formwork components 182, 382 (FIGS. 2I, 2J). Further, any of the cross-sectional shapes of edge formwork components 82', 82" of FIGS. 18B and 18C could be provided with beveled braces similar to beveled brace 192, intermediate braces similar to intermediate brace 194, anchor components similar to anchor component 383.

In particular applications, apparatus according to various embodiments may be used to repair (e.g. to cover) an entirety of an existing structure and/or any subset of the surfaces or portions of the surfaces of an existing structure. Such surfaces or portions of surfaces may include longitudinally extending surfaces or portions thereof, transversely extending surfaces or portions thereof, side surfaces or portions thereof, upper surfaces or portions thereof, lower surfaces or portions thereof and any corners, curves and/or edges in between such surfaces or surface portions.

It may be desired in some applications to change the dimensions of (e.g. to lengthen a dimension of) an existing structure. By way of non-limiting example, it may be desirable to lengthen a pilaster or column or the like in circumstances where the existing structure has sunk into the ground. Particular embodiments of the invention may be used to achieve such dimension changes by extending the apparatus beyond an edge of the existing structure, such that the repair structure, once formed and bonded to the existing structure effectively changes the dimensions of the existing structure.

What is claimed is:

1. A stay in place lining for lining a structure of concrete comprising:

a plurality of panels connectable in edge-to-edge relation via complementary connector components on longitudinally extending edges of the plurality of panels to define at least a portion of a perimeter of the lining, the lining defining at least a portion of a space in which to receive the concrete;

wherein each panel comprises a first connector component comprising a protrusion on a first longitudinally extending edge thereof and a second connector component comprising a receptacle on a second longitudinally extending edge thereof, each edge-to-edge connection comprising the protrusion of a first panel from among the plurality of panels extended into the receptacle of a second panel from among the plurality of panels;

the protrusion comprising a generally straight stem extending from a base of the protrusion, a first barb extending from the stem at a first location and a second barb extending opposite the first barb from the stem at the first location;

the receptacle comprising a first catch extending into the receptacle and positioned to engage the first barb when the protrusion is extended into the receptacle, the engagement of the first barb and the first catch retaining the connector components in a first locked configuration for retaining the concrete in the space;

the receptacle comprising a second catch extending into the receptacle and positioned to engage the second barb when the protrusion is extended into the receptacle, the engagement of the second barb and the second catch retaining the connector components in the first locked configuration;

wherein the receptacle comprises a third catch extending into the receptacle and positioned to engage the first barb when the protrusion is extended into the receptacle, the engagement of the first barb and the third catch retaining the connector components in a second locked configuration for retaining the concrete in the space; and wherein for each panel, the first connector component is offset from a plane of a body of that panel.

2. A stay-in-place lining according to claim 1 wherein the edge-to-edge connection provides a generally flat surface between connected panels.

3. A stay-in-place lining according to claim 1 wherein at least one of the first connector component and the second connector component is resiliently deformed when the edge-to-edge connection is made.

4. A stay-in-place lining according to claim 1 wherein the first barb and the second barb each extend toward the base of the protrusion.

5. A stay-in-place lining according to claim 1 wherein:

the receptacle comprises a fourth catch extending into the receptacle and positioned to engage the second barb when the protrusion is extended into the receptacle, the engagement of the second barb and the fourth catch retaining the connector components in the second locked configuration.

6. A stay-in-place lining according to claim 5 wherein the first catch is opposite the second catch, the third catch is opposite the fourth catch and the first and second catches are spaced apart from the third and fourth catches in a transverse direction.

7. A stay-in-place lining according to claim 6 wherein:

the receptacle comprises a fifth catch extending into the receptacle and positioned to engage the first barb when the protrusion is extended into the receptacle, the engagement of the first barb and the fifth catch retaining the connector components in a third locked configuration;

the receptacle comprising a sixth catch extending into the receptacle and positioned to engage the second barb when the protrusion is extended into the receptacle, the engagement of the second barb and the sixth catch retaining the connector components in the third locked configuration.

8. A stay-in-place lining according to claim 7 wherein the fifth catch is opposite the sixth catch and the third and fourth catches are spaced apart from the fifth and sixth catches in the transverse direction.

9. A stay-in-place lining according to claim 1 wherein the first catch defines a first hooked concavity for receiving a portion of the first barb in the first locked configuration and the second catch defines a second hooked concavity for receiving a portion of the second barb in the first locked configuration.

10. A stay-in-place lining according to claim 9 wherein the first hooked concavity defines a first acute angle and the second hooked concavity defines a second acute angle.

11. A stay-in-place lining according to claim 1 wherein the first barb defines a first hooked concavity for receiving a portion of the first catch in the first locked configuration and the second barb defines a second hooked concavity for receiving a portion of the second catch in the first locked configuration.

12. A stay-in-place lining according to claim 11 wherein the first hooked concavity defines a first acute angle and the second hooked concavity defines a second acute angle.

13. A stay-in-place lining according to claim 1 wherein the first location comprises a tip of the stem.

14. A stay-in-place lining according to claim 1 wherein the first and second catches are spaced apart from a base of the receptacle to allow the first and second barbs to move past the first and second catches respectively when the protrusion is extended into the receptacle and before the first locked configuration is achieved.

15. A stay-in-place lining according to claim 1 wherein the protrusion comprises a third barb extending from the stem at a second location and a fourth barb extending opposite the third barb from the stem at the second location and the second location is spaced apart from the first location in a transverse direction.

16. A stay-in-place lining according to claim 1 wherein the protrusion is symmetrical about a transversely extending axis of the stem.

17. A stay-in-place lining according to claim 1 wherein the receptacle is symmetrical about a transversely extending axis of the receptacle.

18. A stay-in-place lining according to claim 1 wherein an opening of the receptacle is defined by beveled surfaces.

19. A stay-in-place lining according to claim 18 wherein surfaces of the first and second barbs are beveled and shaped to be complementary to the beveled surfaces of the opening of the receptacle.

20. A method for fabricating a structure of concrete, the method comprising:

connecting a plurality of panels in edge-to-edge relation via complementary connector components on longitudinally extending edges of the plurality of panels to define at least a portion of a lining;

assembling the connected plurality of panels such that the connected plurality of panels provides a lining which defines at least a portion of a space in which to receive the concrete; and introducing the concrete into the space in an uncured state;

wherein, connecting the plurality of panels in edge-to-edge relation comprises, for each edge-to-edge connection between a first panel and a second panel:

extending a protrusion of a first connector component on a first longitudinally extending edge of the first panel and offset from a plane of a body of the first panel into a receptacle of a second connector component on a second longitudinally extending edge of the second panel;

wherein the protrusion comprises a generally straight stem extending from a base of the protrusion, a first barb extending from the stem at a first location and a second barb extending opposite the first barb from the stem at the first location;

engaging the first barb with a first catch, the first catch extending into the receptacle and positioned to engage the first barb when the protrusion is extended into the receptacle, the engagement of the first barb and the first catch retaining the connector components in a first locked configuration for retaining the concrete in the space; and engaging the second barb with a second catch, the second catch extending into the receptacle and positioned to engage the second barb when the protrusion is extended into the receptacle, the engagement of the second barb and the second catch retaining the connector components in the first locked configuration; and engaging the first barb with a third catch, the third catch extending into the receptacle and positioned to engage the first barb when the protrusion is extended into the receptacle, the engagement of the first barb and the third catch retaining the connector components in a second locked configuration for retaining the concrete in the space.

21. A method according to claim 20 wherein at least one of the first connector component and the second connector component is resiliently deformed when the edge-to-edge connection is made.

22. A method according to claim 20 wherein the first barb and the second barb each extend toward the base of the protrusion.

23. A method according to claim 20 wherein the first catch defines a first hooked concavity for receiving a portion of the first barb in the first locked configuration and the second catch defines a second hooked concavity for receiving a portion of the second barb in the first locked configuration.

24. A stay-in-place lining according to claim 23 wherein the first hooked concavity defines a first acute angle and the second hooked concavity defines a second acute angle.

* * * * *